US006450631B1

(12) United States Patent
Hayashi et al.

(10) Patent No.: US 6,450,631 B1
(45) Date of Patent: Sep. 17, 2002

(54) STORING METHOD OF INK TANK AND INK JET HEAD CARTRIDGE, AND INK TANK AND STORING CONTAINER USED IN THE SAME METHOD

(75) Inventors: Hiroki Hayashi, Kawasaki; Shozo Hattori, Tokyo; Hajime Yamamoto, Yokohama; Hiroyuki Ishinaga, Tokyo; Eiichiro Shimizu, Yokohama; Hidehisa Matsumoto, Kawasaki; Hiroshi Koshikawa, Kawasaki; Kenji Kitabatake, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/598,957

(22) Filed: Jun. 22, 2000

(30) Foreign Application Priority Data

Jun. 24, 1999 (JP) ..... 11-179055
Jun. 24, 1999 (JP) ..... 11-179083

(51) Int. Cl.[7] ..... B41J 2/175; B41J 29/13
(52) U.S. Cl. ..... 347/86; 347/108
(58) Field of Search ..... 347/85, 86, 87, 347/49, 108

(56) References Cited

U.S. PATENT DOCUMENTS 5,619,238 A 4/1997 Higuma et al. ..... 347/86
5,850,238 A 12/1998 Karita et al. ..... 347/29
5,980,033 A 11/1999 Nakamura ..... 347/87
5,988,804 A 11/1999 Kotaki et al. ..... 347/87
6,012,808 A 11/2000 Koitabashi et al. ..... 347/86
6,347,865 B1 * 2/2002 Matsumoto et al. ..... 347/86

FOREIGN PATENT DOCUMENTS

EP 803 364 A2 * 10/1997
JP 3-176156 7/1991
JP 6-40043 2/1994
JP 6-183028 7/1994
JP 7-17056 1/1995
JP 7-125232 5/1995
JP 8-034122 * 2/1996

* cited by examiner

*Primary Examiner*—Michael Nghiem
(74) *Attorney, Agent, or Firm*—Fitzpatrick, Cella, Harper & Scinto

(57) ABSTRACT

An ink jet head cartridge stored in a closed space. The ink jet head cartridge includes a negative pressure generating member containing chamber and a liquid supply container which has a liquid containing part forming a closed space and generating negative pressure by deforming accompanied with flowing-out of the contained liquid and a box-like body with an inside surface equal to or analogous to the outside surface of the liquid containing part and with an atmosphere communicating part and which is mounted onto a mounting part so as to form the communicating part. As stored, a first sealing member seals the ejection port and a second sealing member seals the atmosphere communicating part, part of the liquid containing part is separated from the box-like body, and the interior of the liquid containing part and the liquid supply passage from the communicating part to the recording head are filled with liquid.

15 Claims, 28 Drawing Sheets

STORING METHOD OF INK TANK AND INK JET HEAD CARTRIDGE, AND INK TANK AND STORING CONTAINER USED IN THE SAME METHOD

BACKGROUND OF THE INVENTION

1. Field of the Invention

The present invention relates to a shipping package and a storing method of a trade form of selling through transportation and storing or the like in the closed and sealed state of an ink jet head cartridge and an ink tank which are exchangeable and capable of being attached to and removed from an ink jet recording device, and more particularly, it relates to a storing method and a storing container of an ink tank in which a negative pressure generating member containing chamber and an ink containing chamber are adjacent to each other and the ink containing chamber can be separate from the negative pressure generating member containing chamber, and an ink jet head cartridge to which the above described ink tank is mounted.

2. Related Background Art

The ink jet recording device is a device which ejects liquid ink from an ejection port of a recording head to perform recording of characters, images, or the like onto a recording medium such as paper, and the recording heads used in the recording device are roughly divided into two types: a permanent type; and a disposal type.

In the permanent type recording head, a recording head is assembled in the device in advance when delivering the recording device, and a service man performs exchange of heads only in trouble. In the case of such a permanent type recording head, at the time of transportation and storing, in many cases, a cap is applied to the ejection port of the recording head in a state of filling the recording head with recording ink or conservation liquid to perform the transportation and storing.

Moreover, the disposal type recording heads can further roughly divided into an integral type ink jet head cartridge which is integrated at all times with an ink tank for keeping ink to be supplied to the recording head, and a tank separable type ink jet head cartridge in which a tank holder is provided to the recording head as a mounting part of the tank and both can be separated from each other as needed. In any case, an operator can perform the exchange of heads by changing the cartridge to a new one as needed.

As for the transportation and storing of the integral type ink jet head cartridge, for example, Japanese Patent Application Laid-Open No. 3-176156 (Patent Registration No. 2683120) by the present applicant or the like is well known. The above described publication discloses a configuration in which a tank is filled with ink and an ejection port of a recording head and an atmosphere communicating port provided in the ink tank are both sealed.

On the other hand, as for the transportation and storing of the separable type ink jet head cartridge, Japanese Patent Application Laid-Open No. 6-183028 by the present applicant is well known, which proposes that a head to be exchanged and an exchangeable tank should be separated since the evaporative composition of ink is adhered to the contact part of the recording head of the electrical connecting part with the recording device to cause a functional drop of the recording head when the exchangeable tank is mounted to the head to be exchanged to be integrally packaged. In the above described publication, it is also disclosed to use an insulating member for preventing the evaporation from the gap between a handling member of the head and the head, and to seal the ejection port by a sealing member and a cap member while filling the interior of the head with ink or conservation liquid. Furthermore, Japanese Patent Application Laid-Open No. 7-17056 discloses a transportation and storing method in which a head filled with ink is contained in a closed package filled with inert gas.

On the other hand, as an ink tank single unit for keeping ink to be supplied to the above described recording head, an ink tank has been proposed and put in practical use, in which a negative pressure generating chamber for generating negative pressure to the recording head and an ink containing chamber for directly containing ink are integrated through a communicating part for the purpose of improving the storing efficiency and efficiency of use of the ink in the ink tank.

As an example of this, for example, Japanese Patent Application Laid-Open No. 7-125232 (Patent Registration No. 2684508) which discloses an invention of making the negative pressure generating member near the atmosphere communicating port to be closed an area in which no ink is kept, and Japanese Patent Application Laid-Open No. 6-40043 (Patent Registration No. 2683187) which discloses an invention of a partition wall with a structure of hastening gas-liquid exchange can be shown. The above described publications also disclose a trade form of an ink tank single unit in which the atmosphere communicating port for making the interior of the negative pressure generating chamber in the communicating state to the atmosphere and the ink supply port for supplying ink to the outside such as the recording head are both sealed, and they are excellent inventions.

Herein, recently, the ink jet recording device is required to perform more highly detailed recording onto various recording media.

Part of the present applicant and others have made an application on a type of an ink supply system more excellent in practice in which the above described negative pressure generating member containing chamber and the ink containing chamber corresponding to this are adjacent to each other and the ink containing chamber is exchangeable to the negative pressure generating member containing chamber, wherein the buffer space in the negative pressure generating member containing chamber can be reduced under various environments and in the meantime, the supplying of ink can be performed under a stable condition of negative pressure during the operation of the ink containing chamber, while increasing the allowance to gaseous expansion of the external air introduced by the gas-liquid exchange. As the ink jet head cartridge to which this new liquid supply system is applied, the following configurations or the like are proposed:

(1) a configuration in which the recording head part and the negative pressure generating member containing chamber are integrated and the ink containing chamber can be installed and removed; and (2) a configuration in which the negative pressure generating member containing chamber and the ink containing chamber can be installed to and removed from the recording head part.

The present invention is thought out by a more preferable idea of the present applicant and others, on the basis of this new ink jet head cartridge.

That is, as a result of an examination on the transportation and storing of the above described head cartridge, the following new problems have been found out:

As for the case (1), the interior of the recording head and the negative pressure generating member in the negative pressure generating member containing chamber are normally filled with ink or conservation liquid during the transportation and storing. Here, unless the communicating part with the ink containing chamber provided in the negative pressure generating member containing chamber is surely sealed, the viscosity of ink near the communicating part is increased to increase the resistance of the communicating part, and after that, even when the ink containing chamber is mounted, there is a possibility of causing a problem in the performance of supplying ink at the time of high speed supply, in the worst case.

As for the case (2), generally, in many cases, the change in atmospheric pressure and the change in temperature during the transportation and storing are larger than those during the use. Therefore, in some cases, the external air in the ink containing chamber expands to introduce the ink in the ink containing chamber to the negative pressure generating member containing chamber side. As a result of that, the internal volume in the ink containing chamber cannot be so much larger than that in the case of considering only the time when in use.

SUMMARY OF THE INVENTION

The present invention is thought out by the present inventor and others for solving the above described new technical problems, and it is an object thereof to provide a storing method of an ink jet head cartridge and an ink tank in which the supply of ink can stably be performed in service without newly increasing a member for sealing, by utilizing the characteristics of the above described liquid supply system, and a storing container of an ink jet head cartridge.

In order to attain the above described object, the storing method of an ink jet head cartridge of the present invention is a storing method of storing, in a closed space, an ink jet head cartridge including: an ink jet recording head having an ejection port for ejecting ink; and a mounting part to which an ink tank is exchangeably mounted, wherein the above described ink jet head cartridge comprises: a negative pressure generating member containing chamber which has a negative pressure generating member for generating negative pressure and has an atmosphere communicating part for communicating with the outside; a liquid supply container which has a liquid containing part forming a substantially closed space except for a communicating part communicating with the above described negative pressure generating member containing chamber and capable of generating negative pressure by deforming accompanied with flowing-out of the liquid contained in the interior and has a box-like body with an inside surface equal to or analogous to an outside surface of the above described liquid containing part and an atmosphere communicating part for introducing the atmosphere, the liquid supply container being mounted onto the above described mounting part so as to form the above described communicating part communicating with the above described negative pressure generating member containing chamber; and a first sealing member for sealing the above described ejection port and a second sealing member for sealing the atmosphere communicating part of the above described negative pressure generating member containing chamber, and wherein part of the above described liquid containing part is made in a state of being separated from the above described box-like body in advance when mounting the above described liquid supply container onto the above described mounting part, and the interior of the above described liquid containing part of the above described liquid supply container and a liquid supply passage from the above described communicating part to the above described recording head are filled with liquid.

Furthermore, the storing container of an ink jet head cartridge of the present invention is a storing container for closing and keeping an ink jet head cartridge including: an ink jet recording head having an ejection port for ejecting ink; and a mounting part to which an ink tank is exchangeably mounted, wherein the above described ink jet head cartridge comprises: a negative pressure generating member containing chamber which has a negative pressure generating member for generating negative pressure and has an atmosphere communicating part for communicating with the outside; a liquid supply container which has a liquid containing part forming a substantially closed space except for a communicating part communicating with the above described negative pressure generating member containing chamber and capable of deforming accompanied with the flowing-out of liquid contained in the interior to generate negative pressure and has a box-like body with an inside surface equal to or analogous to an outside surface of the above described liquid containing part and an atmosphere communicating part for introducing the atmosphere, the liquid supply container being mounted onto the above described mounting part so as to form the above described communicating part communicating with the above described negative pressure generating member containing chamber; and a first sealing member for sealing the above described ejection port and a second sealing member for sealing the atmosphere communicating part of the above described negative pressure generating member containing chamber, and wherein the interior of the above described liquid containing part of the above described liquid supply container and a liquid supply passage from the above described communicating part to the above described recording head are filled with liquid, and part of the above described liquid containing part is in a state of being separated from the above described box-like body.

According to the above described storing container and storing method of an ink jet head cartridge of the present invention, the storing is performed in the state where the negative pressure generating member containing chamber and the liquid supply container are connected, and therefore, it is unnecessary to mount a sealing member at the communicating part between the negative pressure generating member containing chamber and the liquid supply container, so that the packaging material may not increase. Furthermore, since the ink tank (liquid supply container) is provided in advance in the packaged and stored state, it does not take a long time until the ink jet head cartridge is mounted onto the recording device to be used since the ink jet head cartridge has been taken out of the storing container. Moreover, since the storing is performed in the state where the liquid supply passage leading to the recording head is filled with ink, the supply of ink is stable from the start of use.

Furthermore, since the state is made such that part of the liquid containing part is separated from the box-like body, the air in the negative pressure generating member containing chamber expands depending on the change of the storing environment or the like, and even in the case where part of the ink filled in the negative pressure generating member containing chamber flows into the liquid containing part of the liquid supply container, the liquid containing part absorbs the ink corresponding to the volume of expansion of the air by expanding for itself. Consequently, it is possible to prevent a big rise of the internal pressure in the liquid supply container accompanied with the environmental change.

Furthermore, in the present invention, the above described negative pressure generating member is configured by two absorbents made of fiber material, and it is configured such that a boundary surface of the above described two fellow absorbents is arranged on the atmosphere communicating part side of the above described negative pressure generating member containing chamber relative to the above described communicating part, and consequently, the interface between ink and gas in both absorbents during the operation of gas-liquid exchange becomes the boundary surface of two fellow absorbents, and as a result, the static negative pressure in the head part during the operation of supplying ink is stabilized.

Furthermore, it is also possible to make the configuration such that the main fiber direction of the above described fiber material is arranged in the approximately horizontal direction in the attitude of the above described ink jet head cartridge in use.

Furthermore, it is also possible to make the configuration such that the boundary surface of the above described two fellow absorbents is arranged near the above described communicating part.

Furthermore, the storing method of a liquid container according to another embodiment of the present invention is a storing method for storing a liquid container including: a negative pressure generating member containing chamber which has a liquid supply part for supplying liquid to the outside and an atmosphere communicating part for communicating with the atmosphere and which contains a negative pressure generating member capable of keeping liquid in the interior; and a liquid containing chamber which forms a substantially closed space except for a communicating part to the above described negative pressure generating member containing chamber and which has a liquid containing part for containing liquid, wherein the above described negative pressure generating member containing chamber and the above described liquid containing chamber are separated from each other and the communicating part to the above described negative pressure generating member containing chamber of the above described liquid containing chamber is closed in advance, and both the above described fellow containing chambers are connected to each other and the closing of the above described communicating part is released, for the first time when using the above described liquid container.

Furthermore, the liquid container according to another embodiment of the present invention is a liquid container including: a negative pressure generating member containing chamber which has a liquid supply part for supplying liquid to the outside and an atmosphere communicating part for communicating with the atmosphere and which contains a negative pressure generating member capable of keeping liquid in the interior; and a liquid containing chamber which forms a substantially closed space except for a communicating part to the above described negative pressure generating member containing chamber and which has a liquid containing part for containing liquid, wherein the above described negative pressure generating member containing chamber and the above described liquid containing chamber are separated from each other, and it further comprises: closing means for closing the communicating part to the above described negative pressure generating member containing chamber of the above described liquid containing chamber; and regulating means for regulating the connecting direction when connecting the above described negative pressure generating member containing chamber and the above described liquid containing chamber.

According to the above described configuration, the negative pressure generating member containing chamber and the liquid containing chamber are made in the separated state before an operation starts, and therefore, the ratio of the buffer to the environmental change can be reduced, so that the internal volume in the ink containing chamber may be maximized.

Furthermore, since it has regulating means for regulating the connecting direction of the negative pressure generating member containing chamber and the liquid containing chamber, it is possible to prevent the leakage or scattering of ink from occurring when installing and removing the negative pressure generating member containing chamber to and from the liquid containing chamber.

Furthermore, the configuration is made so that the regulating means may cover at least the periphery of the connecting area of the negative pressure generating member containing chamber and the liquid containing chamber, and therefore, even if leakage of ink or scattering of ink occurs from the connecting part of both fellow containing chambers, the ink is caught and gathered in the regulating means, and it is prevented from leaking out to the outside of the regulating means.

Furthermore, according to the above described liquid container of the present invention, it is prevented to connect the negative pressure generating member containing chamber and the liquid containing chamber in an inclined state, and therefore, it is possible to prevent the leakage or scattering of ink from occurring when installing and removing the negative pressure generating member containing chamber to and from the liquid containing chamber.

Furthermore, it is also possible to make the configuration such that the above described negative pressure generating member containing chamber has liquid in the interior before being connected to the above described liquid containing chamber, or it is also possible to make the configuration such that the above described negative pressure generating member containing chamber has no liquid in the interior before being connected to the above described liquid containing chamber.

Furthermore, it is also possible to make the configuration such that the above described regulating means is a sliding member capable of expanding and contracting in one direction, or it is also possible to make the configuration such that the above described regulating means is a bellows member capable of expanding and contracting in one direction.

Furthermore, by making the configuration such that each of the above described negative pressure generating member containing chamber and the above described liquid containing chamber has engaging means for keeping the mutually connected state, the connected state of both fellow containing chambers is stabilized, so that the reliability of the operation of supplying liquid may be raised.

Furthermore, the configuration is made such that the above described regulating means covers at least the periphery of the connecting area of the above described negative pressure generating member containing chamber and the above described liquid containing chamber, and therefore, even if leakage of ink or scattering of ink occurs from the connecting part of both fellow containing chambers, the ink is caught and gathered in the regulating means, and it is prevented from leaking out to the outside of the regulating means.

Furthermore, it is preferable to make the configuration so that the above described regulating means may cover the periphery except for the liquid supply port surface of the above described negative pressure generating member containing chamber and the atmosphere communicating port surface of the above described liquid containing chamber.

DETAILED DESCRIPTION OF THE PREFERRED EMBODIMENTS

Figure 1:
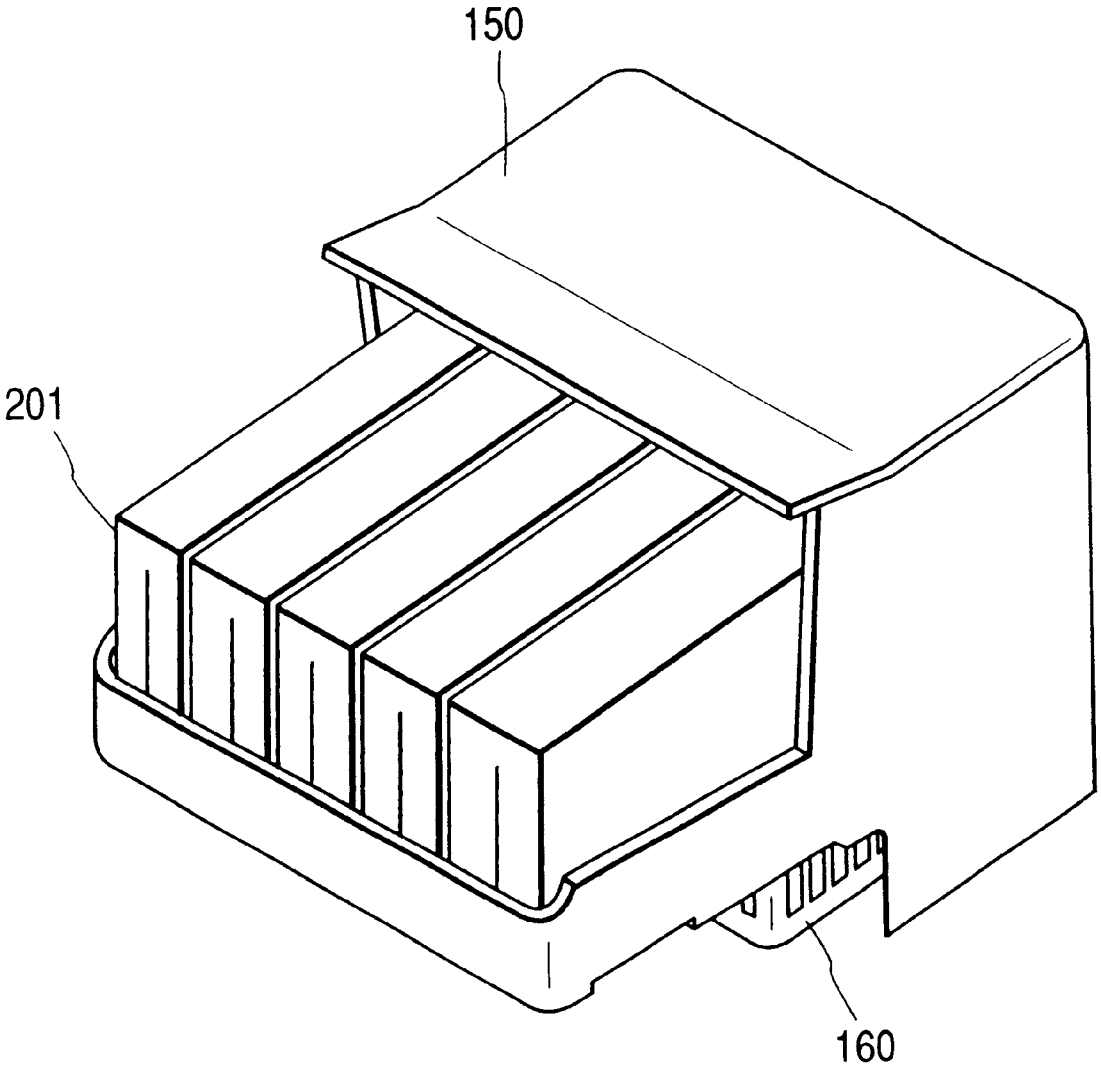
FIG. 1 is a perspective view showing an ink jet head cartridge that is one embodiment of the resent invention.

Referring to the drawings, embodiments of the present invention will be described below.

Besides, "rigidity" of a capillary force generating member in the present invention means "rigidity" when the capillary force generating member is stored in a liquid store container and is defined by the gradient of a repulsive force (unit: kgf/mm) to the distorted amount of the capillary force generating member. The magnitude of "rigidity" in two capillary force generating members is expressed as the capillary force generating member greater in the gradient of repulsive force to the distorted amount is "the more rigid capillary force generating member."

(Embodiment 1)

<Overall Configuration>

Figure 2:
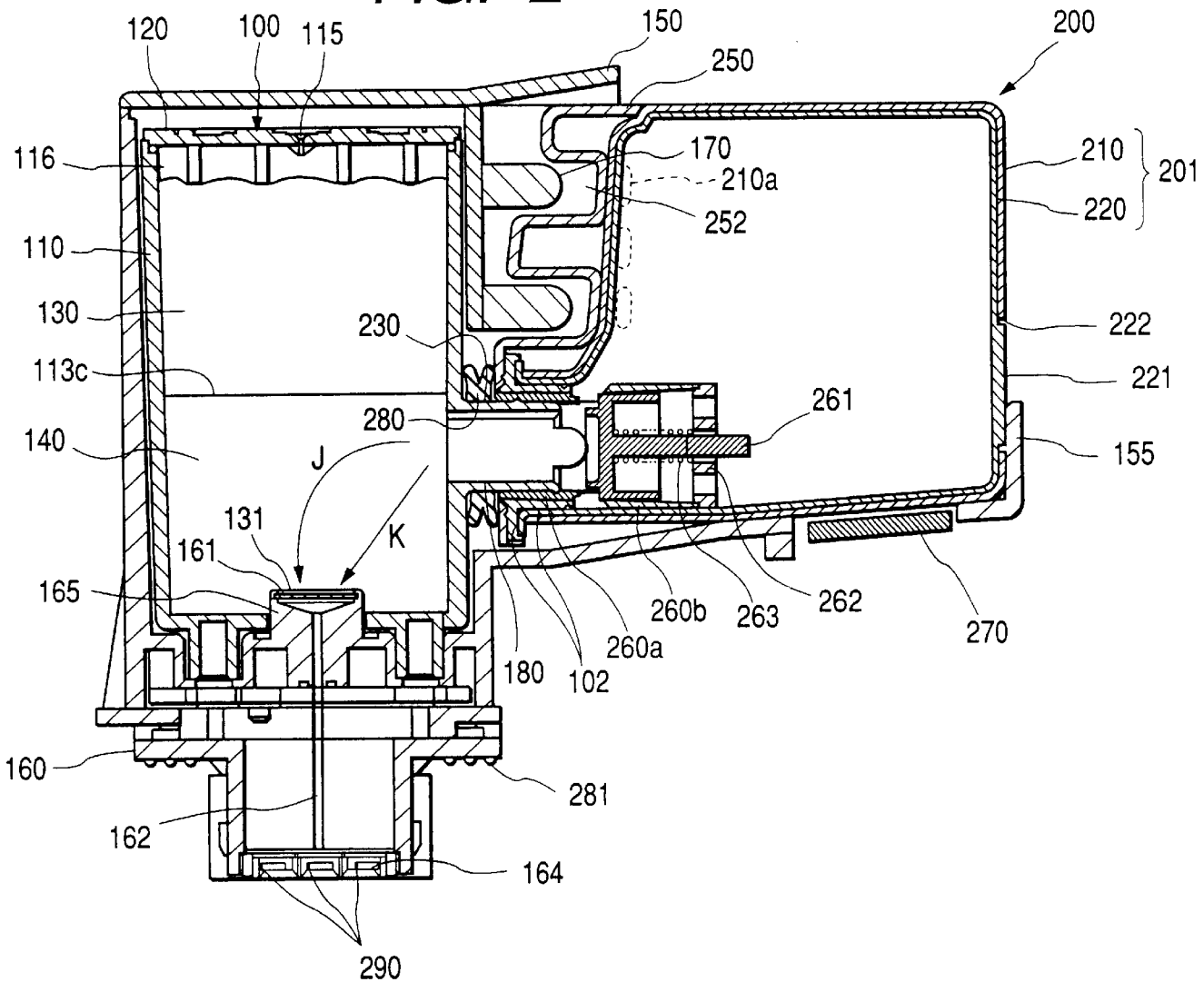
FIG. 2 is a cross sectional view of the cartridge in FIG. 1.

FIG. 1 is a perspective view of an ink-jet head cartridge according to an embodiment of the present invention and FIG. 2 is a sectional view of the same.

Embodiment 1 is cited to describe individual constituents of an ink-jet head cartridge to which to apply the present invention and their relations. Since this embodiment is a configuration to which numerous novel technique obtained at the established stage are applied, the whole invention can be described after all while explaining these constituents.

As shown in FIGS. 1 and 2, an ink-jet head cartridge according to Embodiment 1 comprises an ink-jet head unit 160, a holder 150, a negative pressure control chamber unit 100 and an ink tank unit 200. In the holder 150, the negative pressure control chamber unit 100 is fixed, under which the ink-jet head unit 160 is fixed via a holder. By the way, fixing the holder 150 and the negative pressure control chamber unit 100 and fixing the holder 150 and the ink-jet head unit 160 is effective in recycle, cost-cut for a change in configuration such as version modification or the like, e.g. by an easy of decomposition due to mutual screwed holding, mating or the like. Besides, since the service life varies with the components of individual parts, an easy of decomposition is favorable even from the viewpoint of readiness for simply replacing the component alone needing to be replaced. Under certain conditions, however, perfect fixation by fusing, heat caulking or the like is allowable without doubt. The negative pressure control chamber unit 100 comprises a negative pressure control chamber unit container 110 with an opening formed on the top surface, a negative pressure control chamber cover 120 attached to the top surface of the negative pressure control chamber container 110, and two absorbents 130 and 140 for impregnating and holding the ink filled in the negative pressure control chamber container 110. The absorbents 130 and 140 are vertically stacked at two levels, mutually closely adhering and filled in the negative pressure control chamber container 110 under using circumstances of this ink-jet head cartridge and the capillary force generated by the lower level absorbent 140 is higher than that generated by the upper level absorbent 130, so that the lower level absorbent 140 is higher in ink retaining power. Supplied to the ink-jet head unit 160 is ink in the negative pressure control chamber unit 100 via the ink supply tube 165.

A filter 161, provided at the supply port 131 in the front end of the ink supply tube 165 on the side of the absorbent 140, pressurizes the absorbent 140. The ink tank unit 200 is so arranged as to be freely attachable to and detachable from the holder 150. A joint pipe 180 as the joined part provided on the surface of the negative pressure control chamber container 110 at the side of the ink tank unit 200 is inserted in and connected to the joint port 230 of the ink tank unit 200. In such a manner that ink in the ink tank unit 200 is supplied into the negative pressure control chamber unit 100 via the connection part between this joint pipe 180 and the joint port 230, the negative pressure control chamber unit 100 and the ink tank unit 200 are arranged. In a portion above the joint pipe 180 on the surface of the negative pressure control chamber container 110 at the side of the ink tank unit 200, an ID member 170 for preventing the error in mounting the ink tank unit 200 is provided.

In the negative pressure control chamber cover 120, an atmosphere communicative port 115 for communicating the interior and the outside atmosphere of the negative pressure control chamber container 110, in this case, the absorbent 130 housed in the negative pressure control chamber container 110 and the outside atmosphere, is formed. Provided near the atmosphere communicative port 115 in the negative pressure control chamber container 110 is a buffer space 116 composed of a space formed by the rib protruding from the surface of the negative pressure control chamber cover 120 at the side of the absorbent 130 and an area free of ink (liquid) in the absorbent.

In the joint port 230, a valve mechanism is provided and comprises a first valve frame 260*a*, a second valve frame 26*b*, a valve disc 261, a valve cover 262 and an urging member 263. The valve disc 261 is scoverably supported in the second valve frame 26*b* and urged to the side of the first valve frame 260*a* by the urging member 263 as well. With the joint pipe 180 not being inserted in the joint port 230, the airtightness in the ink tank unit 200 is maintained by pressing the marginal part of the valve disc 261 at the side of the first valve frame 260*a* to the first valve frame 260*a* with the aide of urging power of the urging member 263.

A joint pipe 180 is inserted into the joint port 230 and the valve disc 261 is pressed by the joint pipe 180 to move apart from the first valve frame 260*a*, so that the interior of the joint pipe 180 communicates with that of the ink tank unit 200 via the opening formed on the flank of the second valve frame 26*b*. Thereby, the airtight of the ink tank unit 200 is released and ink in the ink tank unit 200 is supplied through the joint port 230 and the joint pipe 180 into the negative pressure control chamber unit 100. Namely, by valve opening of the joint port 230, the ink store interior of the ink tank unit 200 becomes communicative with the negative pressure control chamber unit 100 only via the above opening.

Here, like this embodiment, fixing the ink-jet head unit 160 and the negative pressure control chamber unit 100 respectively to a holder 150 by an easily decomposable method using screws or the like is desirable because the individual units can be disconnected and replaced in accordance with their respective durable period.

In other words, in an ink-jet head cartridge according to Embodiment 1, it usually does not take place to mount an ink tank storing a different type of ink on the negative pressure control chamber by errors with an ID member provided at the ink tank, but when the ID member provided at the negative pressure control chamber unit 100 is damaged or when a user intentionally mounts the ink tank of a different type on the negative pressure control chamber unit 100, only the negative pressure control chamber unit 100 has only to be replaced if this case is directly after the mounting. Besides, when a holder 150 is damaged, the holder 150 alone may be replaced.

Incidentally, when separating the negative pressure control chamber unit 100, the holder 150 and the ink-jet head unit 160 including the ink tank unit 200 respectively, it is desirable to determine the position of a fixing part so as to make the ink leakage from individual units preventable.

In the case of this embodiment, since the ink tank unit 200 is combined with negative pressure control chamber unit 100 by use of the ink tank engaging part 155 of the holder 150, it does not take place to disconnect the negative pressure control chamber unit 100 alone from the other units being fixed. Namely, at least if the ink tank unit 200 is disconnected from the holder 150, the negative pressure control unit 100 is so arranged as to be hardly separable from the holder 150. In this way, since the negative pressure control chamber unit 100 is so constructed as not to become easy to disconnect from the holder 150 until the ink tank unit 200 is disconnected from the holder 150, there is no fear of ink leakage from the connection part occurring on account of a careless separation of the ink tank unit 200 from the negative pressure control chamber unit 100.

And, at the end of the ink supply tube 165 of the ink-jet head unit 160, a filter 161 is provided and consequently there is no fear of ink in the ink tank unit 160 leaking even after separating the negative pressure control chamber unit 100. Besides, since a buffer space 116 (including the ink-free area of the absorbents 130 and 140) is provided at the negative pressure control chamber unit 100 for preventing the leakage of ink in the ink tank and the boundary surface 113*c* between two absorbents 130 and 140 different in capillary force is provided when used above the joint pipe 180 (preferably, so arranged as to keep a capillary force at and near the boundary surface 113*c* higher than that of the absorbents 130 and 140 as in this Embodiment), an integrated structure of a holder 150, a negative pressure control chamber unit 100 and an ink tank unit 200 has a scarce fear of ink leakage even if the installation direction changes, so that the ink-jet head unit 160 in this embodiment is provided with a fixing part on the bottom surface at the surface side having the connection terminal of the holder 150 and is easy to separate even when the ink tank unit 200 is mounted on the holder 150.

Incidentally, depending upon the shape of a holder 150, the negative pressure control chamber unit 100 or the ink-jet head unit 160 may be unseparably integrated with the holder 150. As a method of such integration, a method in which they are integrally formed in advance, thermal calking or the like may be used, so that they cannot be separated from each other.

Figure 3B:
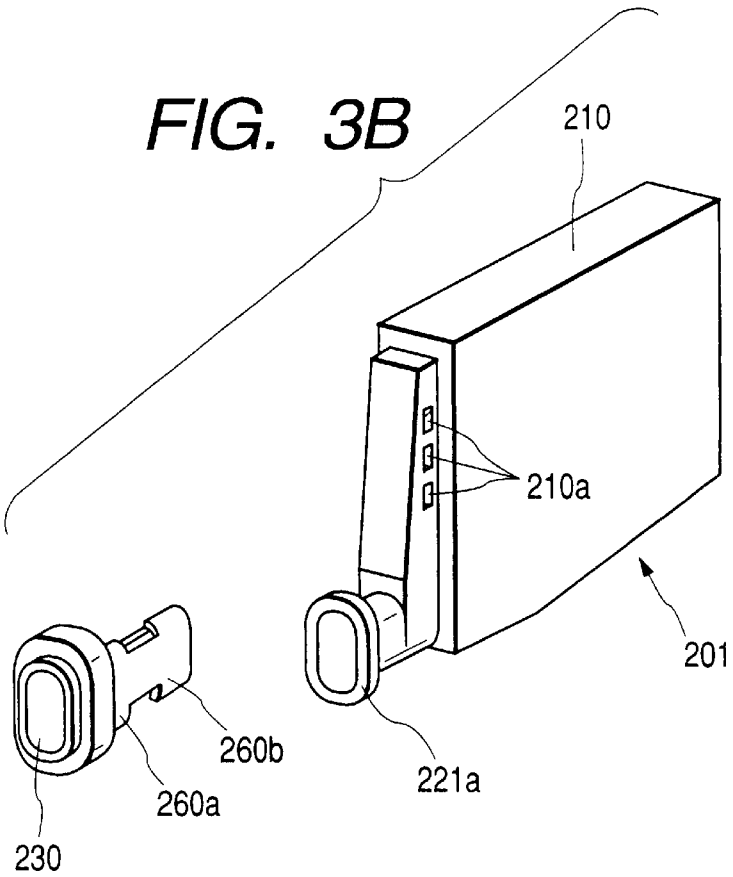
FIGS. 3A and 3B are perspective views for explaining an ink tank unit shown in FIG. 2.
Figure 3A:
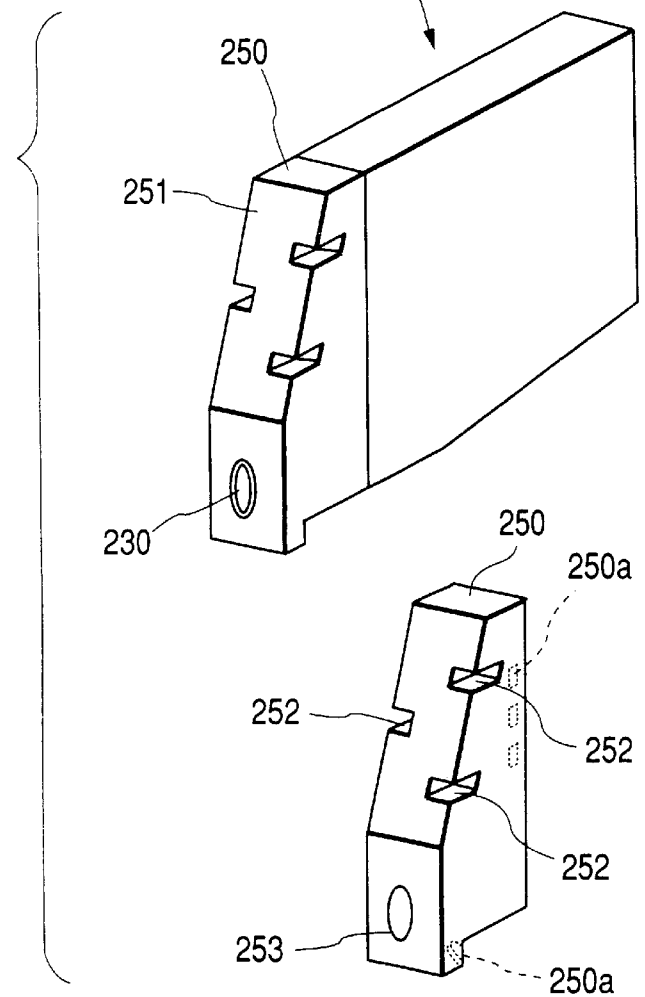

As shown in FIGS. 2, 3A and 3B, the ink tank unit 200 comprises an ink store container 201 and a valve function including a first valve frame 260*a* and a second valve frame 26*b* and an ID member 250. The ID member 250 serves to prevent erroneous mounting in the case of mounting the ink tank unit 200 and the negative pressure control chamber unit 100.

The valve mechanism, serving to control the flow of ink in the joint port 230, performs an opening/closing operation by mating with the joint pipe 180 of the negative pressure control chamber unit 100. Disorders in valve opening/closing at the mounting and demounting are prevented by the valve configuration mentioned below or by a structure or the like for regulating the operating range of a tank with the aide of an ID member 170 and an ID recess 252.

<Ink Tank Unit>

FIGS. 3A and 3B are perspective views for an illustration of the ink tank unit 200 shown in FIG. 2. FIG. 3A is a perspective view showing the ink tank unit 200. FIG. 3B is perspective view showing the decomposed ink tank unit 200.

Besides, in the front face of an ID member 250 at the side of the negative pressure control chamber unit 100, the portion above the supply port 253 forms a slant surface 251. The slant surface 251 slants from the front end surface of the ID member 250 at the side of the supply port hole 253 to the side of the ink store container 201, that is, backward. On this slant surface 251, a plurality of (in FIGS. 3A and 3B, three) ID recesses 252 for preventing the erroneous insertion of the ink tank unit 200. With Embodiment 1, the ID member 250 is disposed at the front face (surface having a supply port) of the ink store container 201 at the side of the negative pressure control chamber unit 100.

The ink store container 201 is a nearly polygonal hollow container having a negative pressure generating function. The ink store container 201 comprises a casing 210 and an inner pouch 220 (FIG. 2), both of which can be stripped from each other. The inner pouch 220 has flexibility, and the shape of the inner pouch 220 can be changed as the ink stored in the inner pouch 220 is ejected. Besides, provided near the pinch-off part 221 of the casing 210 is an outside atmosphere communicative port 222 and the atmosphere is introducible via the outside atmosphere communicative port 222 to between the inner pouch 220 and the casing 210.

Figure 19:
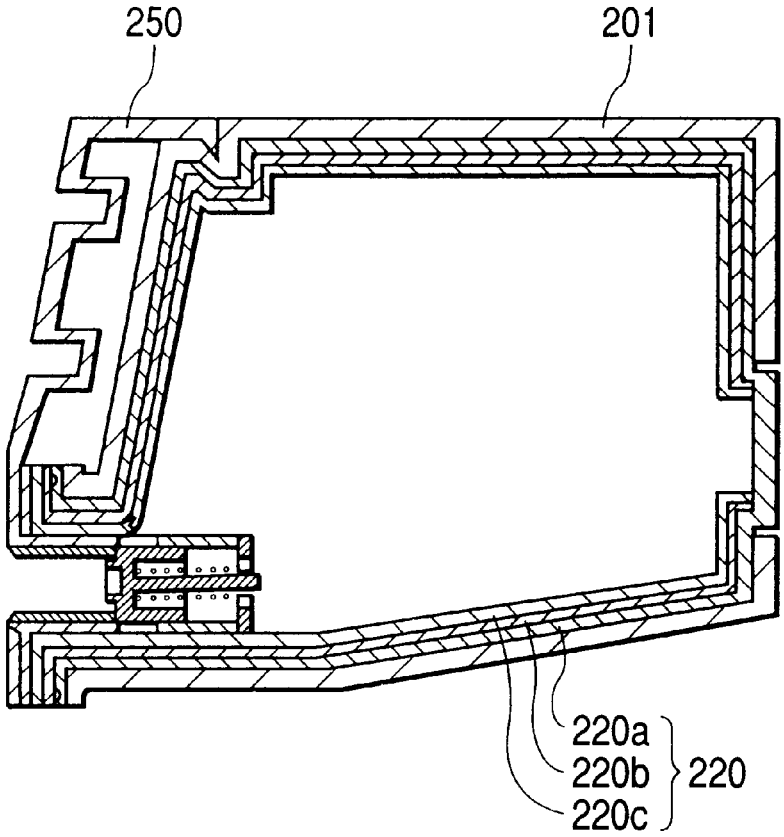
FIG. 19 is a cross sectional view showing an example of the internal configuration of an ink container shown in FIG. 2.

As shown in FIG. 19, the inner pouch 220 comprises three layers of an ink-proof liquid contact-layer 220*c*, an elastic modulus dominant layer 220*b* and a gas barrier layer 220*a* excellent in gas barrier property stacked in sequence from the inside, which are respectively separated in function as joined. With the elastic modulus dominant layer 220*b*, the elastic modulus is kept almost constant within the using temperature range of the ink store container 201, or the elastic modulus of the inner pouch 220 is kept almost constant within the using temperature range of the ink store container 201. In the inner pouch 220, it is allowable that the intermediate layer and the outside layer are exchanged, the elastic modulus dominant layer 220*b* is the outermost layer and the gas barrier layer 220*a* is the intermediate layer.

Such a constitution of the inner pouch 220 enables the inner pouch 220 to fully display the function of each layer in a few layers of a ink-proof layer, an elastic modulus dominant layer 220*b* and a gas barrier layer 220*a* and reduces the dependency of the elastic modulus or the like of the inner pouch 220 on a change in temperature. Besides, since an elastic modulus suitable for controlling the negative pressure in the ink store container 201 within the using temperature range is ensured for the inner pouch 220, the inner pouch 220 has the buffer function described below to ink in the ink store container 201 and the negative pressure control chamber unit 110 (details will be described below). Thus, the buffer chamber provided at the top of the negative pressure control chamber unit 110, that is, the portion unfilled with ink and the ink-free area in the absorbents 130 and 140, can be reduced, so that the negative pressure control chamber unit 100 can be downsized and a highly-efficient ink-jet head cartridge 70 is actualized.

In Embodiment 1, propylene is used as the material of the innermost liquid contact layer 220*c* among the layers that comprise the inner pouch 220, cyclic olefin copolymer as that of the intermediate elastic modulus dominant layer 220*b* and EVOH (saponified of EVA (ethylene vinyl acetate copolymer resin)) as that of the outermost gas barrier layer 220*a*. Here, since a functional adhesive resin contained in the elastic modulus dominant layer 220*b* eliminates the need for especial provision of an adhesive layer between the layers, the thickness of an inner pouch 220 can be reduced and a desirable result is obtained.

As the material of a casing 210, propylene similar to that of the innermost layer of an inner pouch 220 is used. Besides, propylene is used also as that of the first valve frame 260*a*.

The ID member 250 has a plurality of ID recesses 252 provided to the left and right corresponding to a plurality of ID members 170 for preventing erroneous mounting of an ink tank unit 200 and is fixed to the ink store container 201.

Since formation of ID recesses 252 on the ID member 250 corresponding to a plurality of ID members 170 provided at the side of the negative pressure control chamber unit 100 constitutes an erroneous mounting preventive mechanism, the erroneous mounting preventive mechanism obtained by an ID member 170 and ID recesses 252 is enabled to fulfill many types of ID functions by changing their shapes and positions.

Besides, the ID recesses 252 of the ID member 250 and the joint port 230 of the first valve frame 260*a* are positioned on the front face in the front direction of mounting/demounting the ink tank unit 200 and formed by the two members of ID member 250 and first valve frame 260*a*.

Besides, when an ink store container 201 is formed by blow molding, an ID member 250 and a first valve frame 260*a* are formed by injection molding and an ink tank unit 200 is configured of three members, it is made possible to shape a valve member and ID recesses 252 with good accuracy.

When forming such ID recesses 252 directly on the ink store container 201 of a blow tank prepared by blow molding, stripping of an inner pouch 220, the inner layer of the ink store container 201 may be affected, to be specific, the negative pressure generated at the ink tank unit 200 may be affected as a result of complication in the inside shape of an ink tank. When the ID member 250 as ID parts is made of a member separate from the ink store container 201 like the configuration of an ink tank unit 200 according to this embodiment, however, such an effect on the ink store container 201 caused by attaching the ID member 250 to the ink store container 201 as mentioned above is absent, thus enabling a stable negative pressure in the ink store container 201 to be generated and controlled.

The first valve frame 260*a* is bonded at least to the inner pouch 220 of the ink store container 201. The first valve frame 260*a* is bonded by fusing the inner pouch exposed part 221*a* of the inner pouch 220 corresponding to the ink introducing part of the ink store container 201 therein and the corresponding surface of a part of the joint port 230. Here, since the casing 210 is also of polypropylene as with the inner pouch 220, fusing the first valve frame 260*a* and the casing 210 is executable also around the joint port 230.

Thereby, the positional accuracy due to the fusing is enhanced and moreover the supply port of the ink store container 201 is completely sealed and ink leakage from the sealed part of the first valve frame 260*a* and the ink store container 201 at the time of mounting and demounting the ink tank unit 200 or the like is prevented. In case of bonding by the fusing like the ink tank unit 200 in this Embodiment 1, it is preferable in promoting the sealing property that the material of the layer forming the adhesive surface of the inner pouch 220 is equal to that of the first valve frame 260*a*.

Besides, in the bonding of the casing 210 and the ID member 250, the ID member 250 is fixed matingly to the ink store container 201 by mating the surface opposed to the seal surface 102 bonded to the ink store container 201 of the first valve disc 260*a* with the click part 250*a* formed at the bottom of the ID member 250 and mating the mateable part 210*a* of the flank of the casing 210 with the corresponding click part 250*a* at the side of the ID member 250.

In matingly fixing referred to as here, a structure easily decomposable obtained by mating, fitting or the like based on the ruggedness, for example, is preferable. Since making the ID member 250 into a condition matingly fixed to the ink store container 201 allows them minutely movable from each other, a force generated by a contact between the ID member 170 and ID recesses 252 at the time of mounting/demounting can be absorbed and damages to the ink tank unit 200 and the negative pressure control chamber unit 100 can be prevented.

Besides, partially mating the ID member 250 with the ink store container 201 in a matingly fixing condition like this enables the ink store container 201 to be easily decomposed and is effective in view of recycle. Besides, ID recesses provided on the flank of the casing 210 as the mateable part 210*a* like this simplifies the configuration in preparing an ink store container 201 by blow molding, simplifies a mold member at the time of molding also and facilitates the control of film thickness as well.

Furthermore, since bonding between the casing 210 and the ID member 250 is performed with a first valve frame 260*a* bonded to the casing 210 and the click part 250*a* is mated with the mateable part 210*a* in a condition of holding a first valve frame 260*a* between them at and around the joint port 230, promoting the strength of the ink tank unit 200, especially the joint part, at the time of mounting/demounting becomes achievable.

Besides, since the part covered with the ID member 250 becomes in the form of a recess and the part of a supply port protrudes, the ink store container 201 can eliminate the protruding shape on the front surface of the ink tank unit 200 by fixing the ID member 250 to the ink store container 201. Besides, the rugged relation between the mateable part 210*a* of the casing 210 and the corresponding click part of the ID member 250 may be reverse.

Besides, the vertical and horizontal positional regulation between the ink store container 201 and the ID member 250 is executable. The method for joining the ink store container 201 and the ID member 250 is not limited to a form as mentioned above, but mateable positions and a fixing method may be other positions and use other means.

Figure 22:
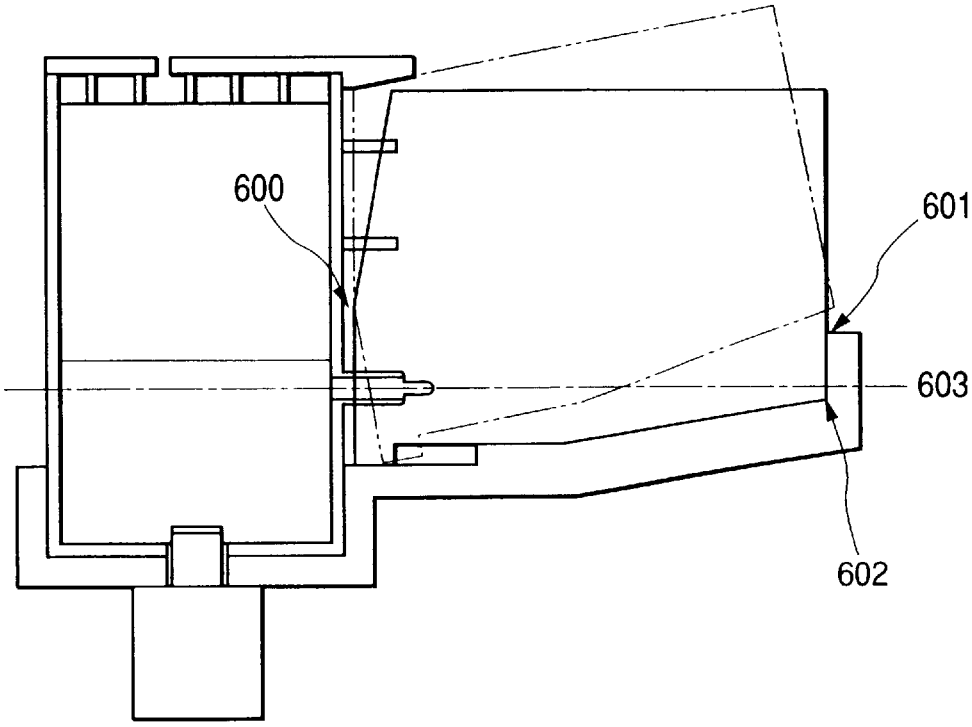
FIG. 22 is a figure for explaining the action of installation and removal by the turning of the ink tank unit shown in FIG. 2.

As shown in FIGS. 2 and 22, the bottom of the ink store container 201 is slant in the direction of an ascend backward and the lower part of the ink store container 201 opposite the joint port 230 mates with the ink tank engagement part 155 of the holder 150. The mateable part of the ink store container 201 with the ink tank engagement part 155 is so arranged as to be raised on demounting the ink tank unit 200 from the holder 150 and the ink tank unit 200 practically rotates at its mounting/demounting time. In this embodiment, the center of this rotation is almost the supply port (joint port 230). Strictly speaking, however, the center of rotation changes as a rule. In case of mounting/demounting operation of the ink tank unit 200 through such a practically rotational operation, entanglement between the ink tank unit 200 and the ink tank engagement part 155 occurs according as the distance from the fulcrum of rotation to the corner of the ink tank unit 200 at the side of ink tank engagement part 155 becomes longer than that from the fulcrum to the ink tank engagement part 155, thereby leading to occurrence of inconveniences such as an unnecessary force in mounting operation and deformations at the respective press parts of the ink tank unit 200 and the holder 150 in some cases.

As in the ink store container 201 of this embodiment, the bottom of the ink store container 201 is slanted, and the lower end of a part of the ink store container 201 on the side of the ink tank engagement part 155 is raised. Thereby, more entanglement than necessary in the rotation of the ink tank unit 200 at the respective mateable parts of the ink tank unit 200 and the holder 150 can be prevented, so that the mounting/demounting operation of the ink tank unit 200 become well performable.

In an ink-jet head cartridge according to Embodiment 1, a joint port 230 is formed at the lower part of one flank of the ink store container 201 at the side of the negative pressure control chamber unit 100 and the lower part of another flank of the ink store container 201 at the side opposed to the joint port 230, i.e. the lower side part of the rear end, mates with the ink tank engagement part 155. Besides, the upper part of the ink tank engagement part 155 extends upward to a height almost equal to the center height 603 of the joint port 230 from the bottom of the holder 150. Thereby, the horizontal move of the joint port 230 is securely regulated by the ink tank engagement part 155 and the connection between the joint port 230 and the joint pipe 180 can be securely retained. Herein, to securely retain the connection between the joint port 230 and the joint pipe 180, the top end of the ink tank engagement part 155 is disposed at a height almost equal to the upper part of the joint port 230. And, by its rotational operation around a part of the front face at the side of joint port 230, the ink tank unit 200 is demountably mounted on the holder 150. In the mounting/demounting operation of the ink tank unit 200, a part of the ink tank unit 200 butting against the negative pressure control chamber unit 100 serves for the rotational center of the ink tank unit 200. Since such a slant bottom of the rear end of the ink store container 210 enables a difference between the distance from the rotational center 600 to the ink tank engagement part top end 601 and that from the rotational center 600 to the ink tank engagement part bottom end 602 to be reduced like this, more entanglement than necessary in the rotation of the ink tank unit 200 can be reduced at the respective mateable parts of the ink tank unit 200 and the holder 150 and the mounting/demounting operation of the ink tank unit 200 becomes well performable.

Since the ink store container 201 and the holder 150 is formed in such a shape as mentioned above, an entangled area of the rear bottom end of the ink store container 201 and the ink tank engagement part 155 at the time of mounting/demounting operation of the ink tank unit 200 can be reduced even with the size of the joint port 230 increased for a speedy supply of ink. Thereby, while ensuring the fixity in mounting the ink tank unit 200 to the holder 150, a useless entanglement with the ink tank engagement part at the time of mounting the ink tank unit 200 can be avoided.

Here, detailed description will be made referring to FIG. 22. When the distance from the rotational center 600 to the ink tank engagement part bottom end 602 in the mounting/demounting operation of the ink tank unit 200 is greater above the necessary extent than that from the rotational center 600 to the ink tank engagement part top end 601, a force required for the mounting/demounting operation becomes very stronger so that the ink tank engagement part top end 601 may be shaved off or the ink store container 201 may be finally deformed. Thus, it is desirable that a difference between the distance from the rotational center 600 to the ink tank engagement part top end 602 of the ink tank unit 200 and that from the rotational center 600 to the ink tank engagement part bottom end 602 is as small as possible within an excellent extent of mounting/demounting property while displaying a moderate setting power.

Besides, if the rotational center 600 of the ink tank unit 200 is at a lower position than the center of the joint port 230, the distance from the rotational center 600 of the ink tank unit 200 to the ink tank engagement part top end 601 ends is being longer than that from its rotational center 600 to the ink tank engagement part bottom end 602, so that it becomes difficult to accurately hold the ink store container 201 at a height of the center of the joint port 230. Thus, to accurately fix the center of the joint port 230 in height, the rotational center 600 of the ink tank unit 200 is desirably positioned above the center of the joint port 230 in height.

Besides, if the rotational center 600 of the ink tank unit 200 is raised above the center height 603 of the joint port 230, the portion of the ink tank unit 200 in contact with the ink tank engagement part 155 increases in thickness and ends in spreading, so that a possibility of damaging the ink tank unit 200 and the holder 150 becomes higher. For this reason, it is desirable from the viewpoint of the mounting/demounting property of the ink tank unit 200 that the rotational center 600 of the ink tank unit 200 is near to the center of the joint port 230 in height. Besides, the height of the ink tank engagement part 155 may be appropriately determined on the basis of the mounting/demounting property of the ink tank unit 200. Since the contact distance of the matingly setting part between the ink tank unit 200 and the holder 150 is elongated and the rubbing portion related to the mounting/demounting operation is enlarged if the ink tank engagement part is set above the rotational center 600, however, the above height is preferably below the rotational center 600 of the ink tank unit 200 in consideration of the deterioration of the ink tank unit 200 and the holder 150.

Besides, in an ink-jet head cartridge according to Embodiment 1, an urging force for fixing the horizontal position of the ink store container 201 originates from an urging member 263 for urging the valve disc 261 and from the repulsive force of a rubber joint part 280 (FIG. 5A), but is not limited to such shapes alone and urging means for fixing the horizontal position of the ink store container 201 may be provided at the rear end of the ink store container 201, on the flank of the fixing part, the ink tank matingly fixing part 155 at the side of the ink store container 201 or at the negative pressure control chamber unit 100 or the like. Incidentally, with an ink store container connected thereto, the rubber joint part 280 is pressed into the wall between the negative pressure control chamber unit and the ink tank, thus ensuring the airtightness of the joint part (joint pipe perimeter) (it is only necessary to minimize the area exposed to the atmosphere even if no perfect airtightness is ensured) and moreover enabling the auxiliary role of a seal by the sealing projection described below to be fulfilled.

Next, the inside configuration of the negative pressure control chamber unit 100 will be described.

Inside the negative pressure control chamber unit 100, a member for generating a negative pressure in the two-level stacking configuration of an absorbent 130 at the upper level and an absorbent 140 at the lower level is, housed. Thus, the absorbent 130 communicates with the atmosphere communicative port 115, whereas the absorbent 140 closely contacts the absorbent 130 on the top face and the filter 161 on the bottom face as well. The boundary face 113*c* between the absorbents 130 and 140 is disposed above the top end of the joint pipe 180 as the communicative part, i.e. at the side of the atmosphere communicative port 115 in the using arrangement.

The absorbents 130 and 140 is made of fibers almost aligned in fiber direction and is housed in the negative pressure control chamber container 110 with their principal fiber direction slant to a vertical direction under the printer loading condition (more desirably, almost in a horizontal direction).

After short fibers made of a thermoplastic resin crimped as fibers (about 60 mm long, e.g. made of mix spinning fibers of polypropylene and polyethylene and so on), for example, are used and a fiber mass of these short fibers is aligned in fiber direction by using a card, such absorbents 130 and 140 aligned in the fiber direction are manufactured by heating the fibers (temperature in heating is preferably higher than the melting point of polyethylene lower in melting point and lower than that of polypropylene higher in melting point) and cutting them in a desired length. Here, a fiber material according to this embodiment in the surface layer is more aligned in fiber direction than at the center and greater also in generated capillary power than at the center, but its surface is not specula but bears some ruggedness generated mainly in bundling slivers and the fused intersections are 3-dimensionally provided also on the surface part. Accordingly, by mutual contact of the rugged surfaces, the boundary face 113*c* between the absorbents 130 and 140 aligned in fiber direction allows ink to be moderately fluid as a whole together with its neighboring surface areas of the respective absorbents 130 and 140. Namely, it is not the case that the boundary face 113*c* alone is markedly better in ink fluidity than its surrounding area and in consequence an ink passage is formed between the negative pressure control chamber unit 110 and the gap and the boundary face 113*c* between the absorbents 130 and 140. Thus, provision of the boundary face 113*c* between the absorbents 130 and 140 at the top of the joint port 180, preferably near the top of the joint port 180 as with this embodiment, permits the interface between ink and air in the absorbents 130 and 140 during the vapor-liquid exchanging operation as with this embodiment to be set to the boundary face 113*c,* thus enabling a static negative pressure in the head during the ink supplying operation to be stabilized as a result.

Figure 20:
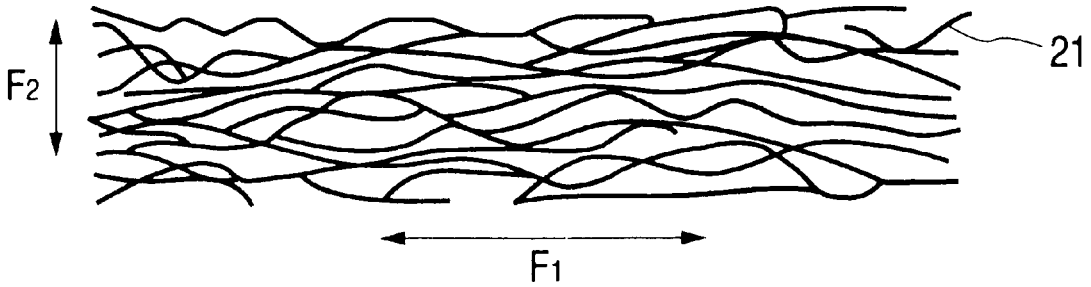
FIG. 20 is a figure for explaining an absorbent in a negative pressure control chamber container shown in FIG. 2.

Besides, with eyes to their directionality as fiber materials, the respective fibers are adjusted by means of a card and continuously aligned in length F1 and further assume a tied structure based on a fused part of intersections between fibers formed by hot molding in a perpendicular direction F2 as shown in FIG. 20. Accordingly, even if pulled in the F1 direction of FIG. 20, the absorbents 130 and 140 are hardly collapsible but are rather easily separable because the tied part between fibers are broken if pulled in the F2 direction.

Since the absorbents 130 and 140 made of fibers have a principal direction F1 like this, both the fluidity of ink and a manner of retention in a resting state differs between the principal fiber direction and a direction perpendicular thereto.

Figure 21A:
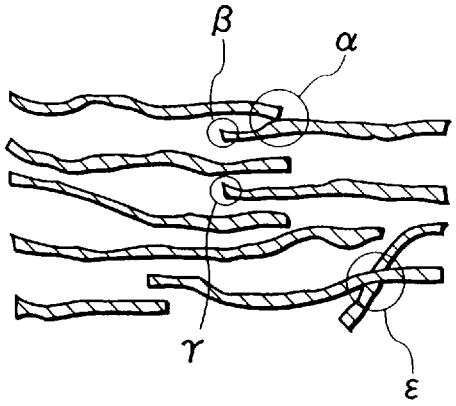
FIGS. 21A and 21B are figures for explaining the absorbent in the negative pressure control chamber container shown in FIG. 2.
Figure 21B:
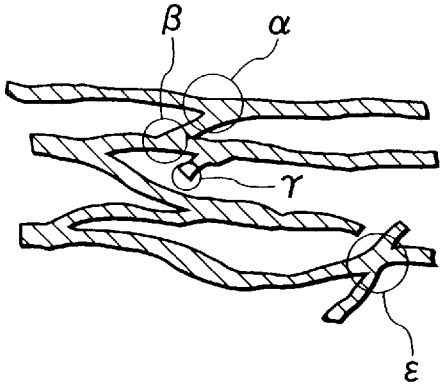

On considering the internal structure of the absorbents 130 and 140 in further details, crimped short fibers as shown in FIG. 21A becomes in a form as shown in FIG. 21B by heating with fibers aligned in direction to some extent. Here, an area a in which multiple short fibers are overlapped in fiber direction has a high probability of fused intersections as shown in FIG. 21B and as a result, hard-to-break continuous fibers are formed in the F1 direction shown in FIG. 20. On the other hand, by using crimped short fibers, the end area of a short fiber (β and γ shown in FIG. 21A) is 3-dimensionally fused to another short fiber (β) or remains unchanged as an end (γ) as shown in FIG. 21B. In addition, since all fibers are not aligned in exactly the same direction, a short fiber in slant contact with another as to intersect (ϵ shown in FIG. 21A) is fused to another as it is. In this manner, fibers highly intense also in F2 direction are formed in contrast to a conventional fiber intense in a single direction F1.

Figure 6:
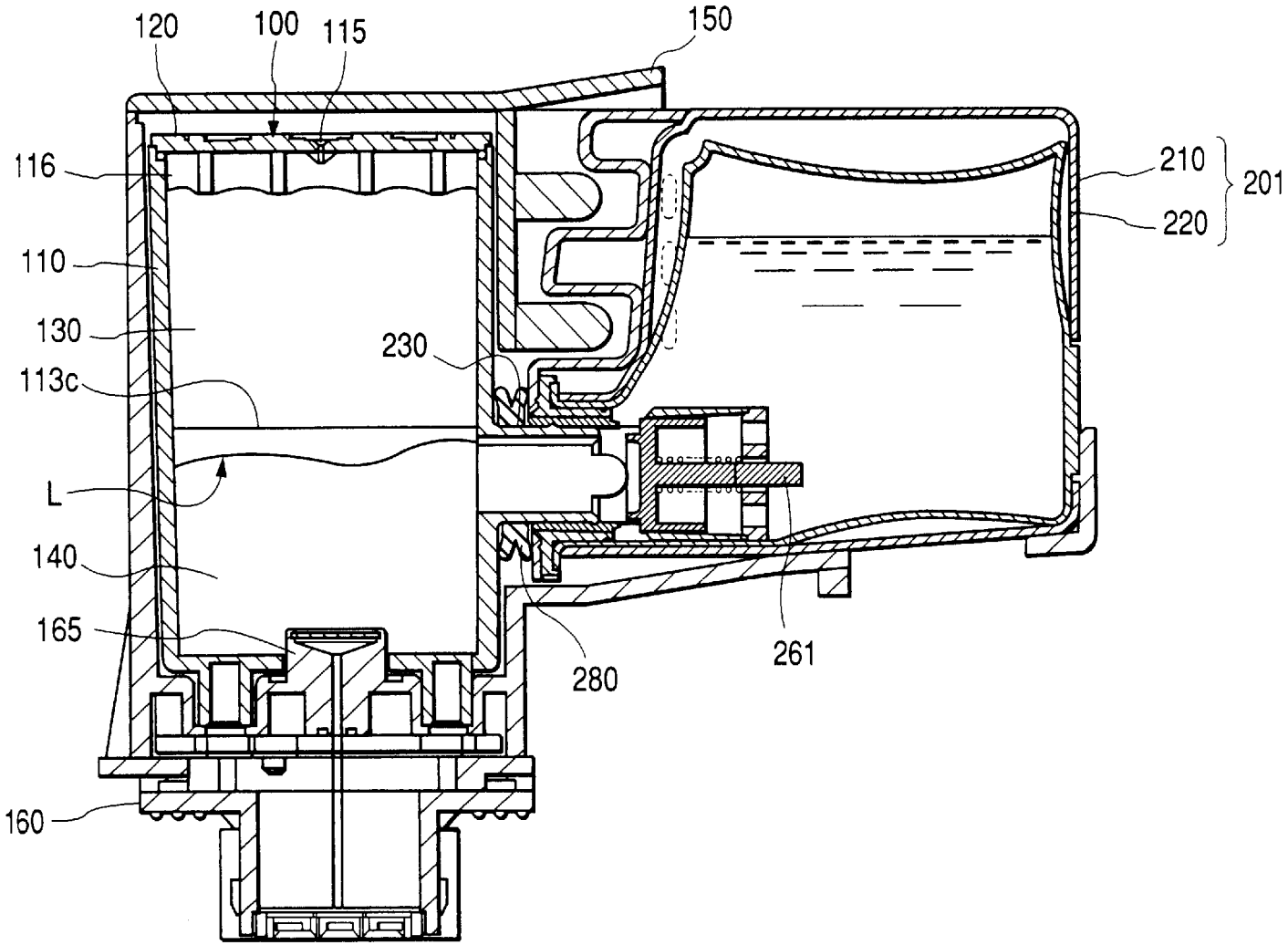
FIG. 6 is a cross sectional view for explaining an action of supplying ink in the ink jet head cartridge shown in FIG. 2.

Besides, in this embodiment, such absorbents 130 and 140 are so disposed as to make the principal fiber direction F1 nearly parallel to a horizontal direction and a direction from the communicative part to the ink supply port. Accordingly, as shown in FIG. 6, the vapor-liquid interface L (interface between ink and a vapor) in the absorbent 140 becomes in a nearly horizontal direction parallel to the direction of the principal fiber direction F1 under a connected situation of the ink store container 201, the vapor-liquid interface returns to the position of the original vapor-liquid interface to maintain a nearly horizontal direction after the environmental fluctuations converge even if fluctuations due to a change in environments occurs and no distribution relative to the gravitational direction increases corresponding to the number of cycles of changes in environments.

As a result, in case of replacement with a new ink tank unit 200 after ink in the ink store container 201 is exhausted, the vapor-liquid interface is kept almost in a horizontal direction, so that the buffer space 116 never decreases even with increasing number of exchange times in the ink tank unit 200.

Like this, to stabilize the position of the vapor-liquid interface L during the vapor-liquid exchanging operation independently of a change in environments, the top area of, more desirably, the area including the upside end of and above, the communicative part (with Embodiment 1, joint port 180), has only to include a layer having the principal fiber aligned component in a nearly horizontal direction. From another viewpoint, this layer has only to situated in the area connecting the supply joint 131 and the upside end of the communicative part, or from a still different viewpoint, this area has only to be situated on the vapor-liquid interface during the vapor-liquid exchanging operation. If the latter understood functionally, the fiber layer having this alignment directionality keeps the vapor-liquid interface horizontally in the absorbent 140 during the liquid supply operation by vapor-liquid exchange and has a function of regulating a vertical change in the absorbent 140, accompanying the liquid movement from the ink store container 201.

The presence of such a layer in the absorbent 140 enables dispersions of the vapor-liquid interface L relative to the gravitational direction to be suppressed in this area. In this case, if the principal fiber aligned direction is nearly parallel also to a longitudinal direction on a horizontal section of the absorbent 140, it is more desirable because a longitudinal direction of fibers can be effectively utilized.

Incidentally, here, if the fiber aligned direction is even slightly slant from a vertical direction, theoretically, the above effect can be produced, but a clear effect was confirmed in practical use within a range of about ±30° relative to a horizontal direction. Thus, "about" in about horizontal includes the above slant.

In this embodiment, since the principal fiber direction aligned component consists of the same absorbent 140, the area below the upside end of the communnicative part also is composed similarly. Accordingly, in a vapor-liquid exchanging operation as shown in FIG. 6, the relevant vapor-liquid interface L becomes free of unprepared dispersions in the area below the upside end of the communicative part, so that no poor ink supply due to the exhaustion of ink occurs.

Namely, in the vapor-liquid exchanging operation, the atmosphere introduced from the atmosphere communicative port 115 diffuses along the principal fiber direction after arrival at the vapor-liquid interface L. As a result, the interface during the vapor-liquid exchanging operation is kept about in a horizontal direction and can be stabilized, thus resulting in a more secure ink supply while maintaining a stable negative pressure. Besides, with respect to the vapor-liquid exchanging operation also, since the principal fiber direction is in a nearly horizontal direction with Embodiment 1, ink is almost uniformly consumed in a horizontal direction. As a result, also for ink of the negative pressure control chamber unit 110, an ink supply system with a small remainder can be provided. Thus, especially, in a replaceable system of the ink tank unit 200 for directly storing the liquid like this embodiment, the area retaining no ink in the absorbents 130 and 140 can be efficiently made out, so that the buffer space efficiency is enhanced and an ink supply system proof against environmental fluctuations can be provided.

Besides, in case of being loaded on a so-called serial type printer, an ink-jet head cartridge according to Embodiment 1 is mounted to a carriage to be reciprocally scanned. At this time, with the reciprocating operation of a carriage, a force in the moving direction component of the carriage acts on ink in the ink-jet head cartridge. To eliminate a bad effect on the property of ink supply from the ink tank unit 200 to the ink-jet head unit 160 as far as possible, the fiber direction of the absorbents 130 and 140 and the aligned directions of the ink tank unit 200 and the negative pressure control chamber unit 100 are preferably in the direction extending from the joint port 230 of the ink tank unit 200 to the supply port 131 of the negative pressure control chamber container 110.

<Tank Mounting Operation>

Next, operation of mounting an ink tank unit 200 to the holder 150 integrated with the negative pressure control chamber unit 100 will be described referring to FIGS. 4A to 4D.

FIGS. 4A to 4D are sectional views for explaining the operation of mounting an ink tank unit 200 to the holder 150 with the negative pressure control chamber unit 100 attached. The ink tank unit 200 is mounted by nearly turning it along a guide (unillustrated) in width, the bottom 151 of the holder 150, the guide part 121 provided on the negative pressure control chamber cover 120 of the negative pressure control chamber unit 100 and the ink tank engagement part 155 in the rear of the holder 150 in the direction of arrowheads F and G.

Figure 4A:
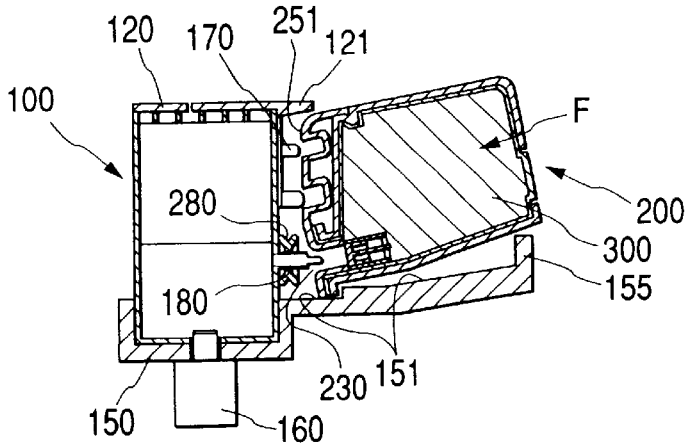
FIGS. 4A, 4B, 4C and 4D are cross sectional views for explaining an action of mounting the ink tank unit onto a holder to which a negative pressure control chamber unit in FIG. 2 is attached.

First, as the mounting operation of an ink tank unit 200, the ink tank unit 200 is moved to the position shown in FIG. 4A, i.e. to the position at which the slant face 251 of the ink tank unit 200 comes into contact with the ID member 170 provided thereon for preventing an erroneous mounting of the ink tank unit provided in the negative pressure control chamber 100. At this time point, the configuration is such that the joint port 230 does not contact the joint pipe 180. At this time point, in an attempt to mount a wrong ink tank unit 200, the slant face 251 and the ID member 170 interfere with each other, thus hindering the subsequent mounting operation of the ink tank unit 200. Since such a configuration of the ink-jet head cartridge 70 keeps the joint port 230 from contacting the joint pipe 180 as mentioned above, an unnecessary exchange or the like of a head and an ink tank in an ink-tank exchange type device can be previously prevented which originates in the color mixing of ink, the sticking of ink (for some ink components (e.g., reaction of anions or cations), cases where the occurrence of sticking to the absorbents 130 and 140 disables the negative pressure control chamber unit 100 are also thought of). Besides, since forming the ID part of the ID member 250 into a slant as mentioned above allows multiple ID members 170 to be inserted into the respective corresponding ID recesses at much the same time, identification of ID is performable, thereby enabling a secure function of preventing an erroneous mounting to be attained.

Figure 4B:
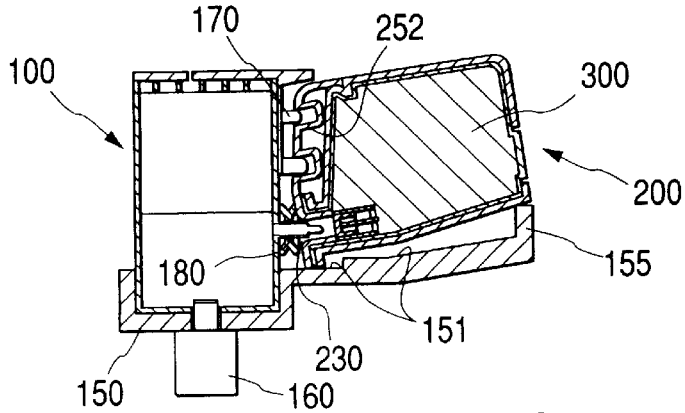
Figure 4C:
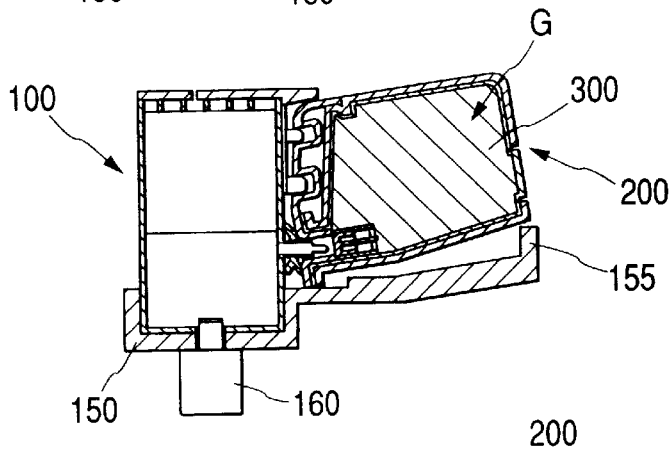

Next, as shown in FIG. 4B, the ink tank unit 200 is moved to the side of the negative pressure control chamber unit 100 in such a manner as to insert not only the ID members 170 into the ID recesses 252 but the joint pipe 180 into the joint port 230 also. Then, as installed at the position shown in FIG. 4C, i.e., at the position allowing the ID members 170 and the ID recesses 252 to correspond to each other, the ink tank unit 200 mounted to at a predetermined position is further moved to the innermost place at the side of the negative pressure control chamber unit 200. Furthermore, on turning the ink tank unit 200 in the direction of arrowhead G, the front end of the joint pipe 180 butts against the valve disc 261 and the valve disc 261 is oppressed. Thereby, the valve mechanism opens, the interior of the ink tank unit 200 and the interior of the negative pressure control chamber unit 100 communicate, thereby permitting ink 300 inside the ink tank unit 200 to be supplied into the negative pressure control chamber unit 100. The details of opening/closing operation of this valve mechanism will be described below.

Thereafter, the ink tank unit 200 is further turned in the direction of arrowhead G and the ink tank unit 200 is thrust to the position shown in FIG. 2. Thereby, the rear underside face of the ink tank unit 200 is matingly set by the ink tank engagement part 155 of the holder 150 and the ink tank unit 200 is fixed at a desired position in the holder 150. Under these circumstances, the ID members 170 are actually moved in a direction of a little departing from the ID recesses 252. An urging force backward (to the side of the holder matingly setting part 155) for fixing the ink tank unit 200 is given by the urging member 263 in the ink tank unit 200 and the rubber joint part 280 provided around the joint pipe 180.

In an ink tank unit 200 subjected to the mounting/demounting with turning operation as mentioned above, ID recesses 252 formed on the slant face 251 and a slant underside face of the ink tank unit 200 enables the mounting/demounting of the ink tank unit 200 free of erroneous mounting or ink color mixing to be securely performed in a minimum space.

Figure 4D:
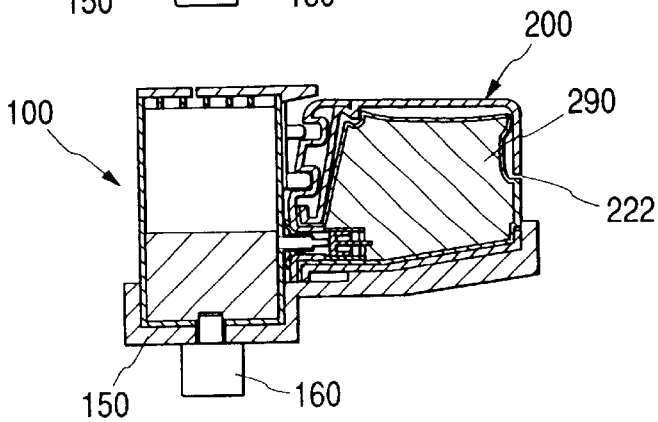

When the ink tank unit 200 is connected like this to the negative pressure control chamber unit 100, ink moves till the pressure becomes equal inside the negative pressure control chamber unit 100 and inside the ink store container 201 and an equilibrium state is effected at a negative pressure inside the joint pipe 180 and inside the joint port 230 as shown in FIG. 4D (this state is referred to as "use start state").

Such being the case, the ink movement leading to this equilibrium state will be described in details.

When a valve mechanism provided at the joint port 230 of the ink store unit 201 opens by mounting the ink tank unit 200, the ink store part comes into an actual closed state except the joint port 230. Then, ink in the ink store container 201 flows to the joint port 230 and an ink passage is formed therefrom to the absorbent 140 of the negative pressure control chamber unit 100. Once the ink passage is formed, ink movement from the ink store container 201 to the absorbent 140 starts by the capillary power, thus resulting in a rise of the ink interface in the absorbent 140. Besides, the inner pouch 220 is beginning to be deformed from the center of a maximum area surface in a decreasing direction of volume in the pouch 220.

Here, since the casing 210 acts to suppress a displacement of the corner of the inner pouch 220, a force of deforming action due to the consumption of ink and a force of restoring action to shapes prior to the mounting (initial states shown in FIGS. 4A to 4D are exerted on the inner pouch 220, so that a negative pressure corresponding to the degree of deformation is generated without a radical change. Since the space between the casing 210 and the inner pouch 220 communicates with the outside air via the outside air communicative port 222, air is introduced between the casing 210 and the inner pouch 222 according to the above deformation.

Incidentally, even if there is air in the joint port 230 and in the joint pipe 180, the air can easily move into the inner pouch 220 because the inner pouch 220 is deformed with the outflow of ink once an ink passage is formed.

The ink movement continues till the static negative pressure in the joint port 230 of the ink store container 201 becomes equal to the static negative pressure in the joint pipe 180 of the negative pressure control chamber unit 100.

As described above, the ink movement from the ink store container 201 to the negative pressure control chamber unit 100 in their connection of the ink store container 201 and the negative pressure control chamber unit 100 is carried out without introducing the vapor to the ink store container 201 via the absorbents 130 and 140. Static negative pressures in individual chambers at the equilibrium have only to be set to appropriate values according to the types of liquid ejection recording means to be connected so as to eliminate the ink leakage from liquid ejection recording means such as ink-jet head unit 160 connected to the ink supply port of the negative pressure control chamber unit 100.

Besides, since there are distributions in the quantity of ink retained by the absorbent 130 before the connection, an area not filled with ink remains in some cases inside the absorbent 140. This area can be used as the buffer area.

By contraries, if there is a fear that the pressure in the joint pipe 180 and the joint port 230 might become positive at the time of reaching the equilibrium state, countermeasures may be taken by executing a suctorial restoration by using the suctorial restoration means mentioned later and allowing some quantity of ink to flow out.

As mentioned above, an ink tank unit 200 according to Embodiment 1 is slantwise inserted with its outside bottom face placed on the ink tank engagement part 155 of the holder 150 and mounted onto the holder 150 along with the nearly turning operation to thrust its outside bottom face into the bottom face of the holder 150 after moving the rear bottom edge over the matingly setting part 155. Alternatively, by the reversed operation, the ink tank unit 200 is detached from the holder 150. And, along with the mounting/demounting operation of the ink tank unit 200, the opening/closing operation of the valve mechanism provided in the ink tank unit 200 is carried out.

<Opening/Closing Operation of the Valve Mechanism>

Figure 5A:
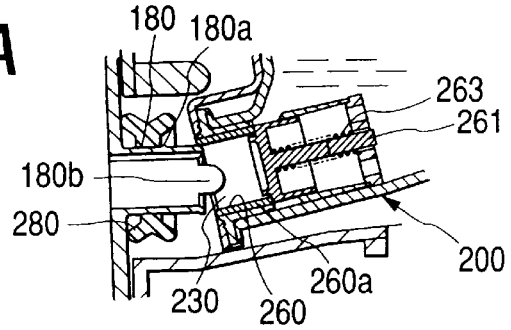
FIGS. 5A, 5B, 5C, 5D and 5E are cross sectional views for explaining the opening and closing action of a valve mechanism applicable to the present invention.

Referring to FIGS. 5A to 5E, opening/closing operation of the valve mechanism will be described below. FIG. 5A shows the situation directly before inserting the joint pipe 180 into the joint port 230 with the ink tank unit 200 inserted slantwise in the joint port 230 in a downward slant orientation.

Here, with the joint port 180, a sealing projection 180*a* is integrally provided throughout the outer periphery and the valve opening/closing projection 180*b* is provided at the front end. The sealing projection 180*a* is to butt against the joint seal face 260 of the joint port 230 when the joint valve 180 is inserted into the joint port 230 and is so slantwise provided as to keep the distance from the front upside end of the joint thereto pipe 180 greater the distance from the from downside end thereto. Since the sealing projection 180*a* scoveres over the joint seal face 260 at the time of mounting/demounting the ink tank unit 200 as mentioned later, materials good in scoverability and close adhesion to the joint seal face 260 is preferably used for it. Besides, the shape of an urging member 263 for urging the valve disc 261 to the side of the first valve frame 260*a* is not especially limited, but spring materials such as coil spring and leaf spring, expansion members such as rubber, or the like can be used. Besides, in consideration of recycling capability, elastic members such as resin are preferable.

In the situation shown in FIG. 5A, the valve opening/closing member 180*b* does not butt against the valve disc 261 and the seal part formed on the outer periphery of the end of the valve disc 261 at the side of the joint pipe 180 is pressed to the seal part of the first valve frame 260*a* by the urging force of the urging member 263. Thereby, the inside airtightness of the ink tank unit 200 is maintained.

Figure 5B:
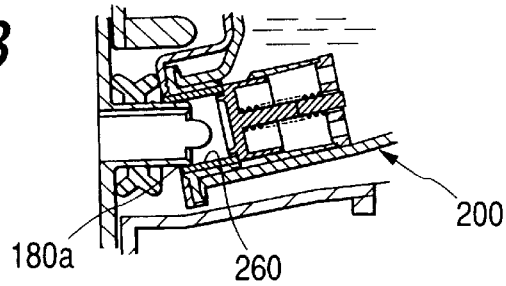
Figure 5C:
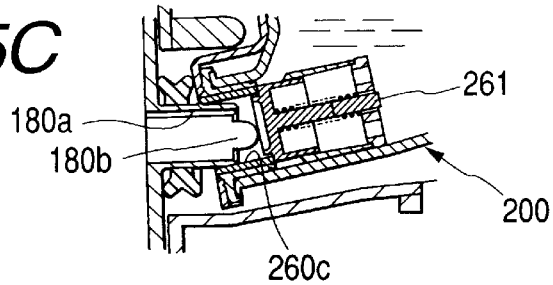

According as the ink tank unit 200 is further inserted into the holder 150, the joint seal face 260 of the joint port 230 is sealed by the sealing projection 180*a*. First, as shown in FIG. 5B, the underside end of the sealing projection 180*a* butts against the joint seal face 260, the butting area generally spreads toward the top of the sealing projection 180*a* by scovering of the ink tank unit 200 accompanying the inserting operation and finally the upside end butts against the joint seal face 260 as shown in FIG. 5C. By this inserting progress, the entire periphery of the sealing projection 180*a* butts against the joint seal face 260 and the joint port 230 is sealed by the sealing projection 180*a*.

Besides, in the situation shown in FIG. 5C, the valve opening/closing projection 180*b* does not butt against the valve disc 261 and consequently the valve mechanism is not opened. Thus, the joint port 230 is sealed before the valve mechanism opens, thereby preventing the ink leakage from the joint port 230 during the mounting operation of the ink tank unit 200.

Furthermore, as mentioned above, sealing of the joint port 230 gradually proceeds from the underside of the joint port, so that air in the joint port 230 is discharged from the gap between the sealing projection 180*a* and the joint seal face 260. Since air in the joint port 230 is discharged like this, the quantity of air remaining in the joint port 230 is minimized with the joint port 230 sealed and excessive compression of the air in the joint port 230, i.e., excessive rise of pressure in joint port 230, is prevented. As a result, an unprepared valve opening accompanying a rise of pressure in the joint port 230 prior to the perfect mounting of the ink tank unit 200 onto the holder 150 and the resultant flow of ink into the joint port 230 can be prevented.

Figure 5D:
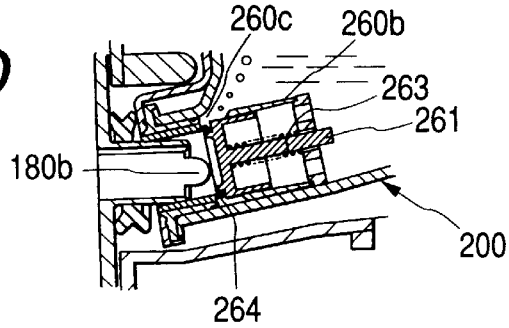

According as the ink tank unit 200 is further inserted, the valve opening/closing projection 180*b* thrusts the valve disc 261 against the urging force of the urging member 263 remaining sealed by the sealing projection 180*a* as shown in FIG. 5D. Thereby, the opening 260*c* of the second valve frame 26*b* communicates with the joint port 230, air in the joint port 230 is introduced into the ink tank unit 200 through the opening 260*c* and moreover ink in the ink tank unit 200 is supplied to the negative pressure control chamber container 110 through the opening 260c and the joint pipe 180 (FIG. 2).

Since air in the joint port 230 is introduced into the ink tank unit 200 like this, for example, by mounting the ink tank unit 200 during the course of use again, the negative pressure in the inner pouch 220 (FIG. 2) is alleviated. Accordingly, a balance of equilibrium between the negative pressure control chamber container 110 and the inner pouch 220 is improved and the resupply efficiency of ink into the negative pressure control chamber container 110 can be prevented from worsening.

Figure 5E:
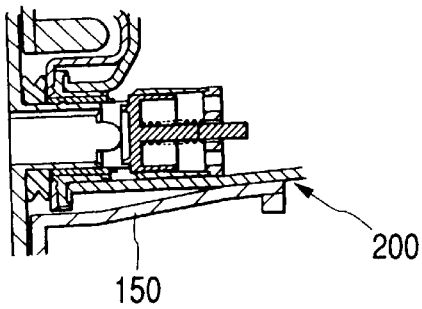

After the above operation, by thrusting the ink tank unit 200 onto the bottom face of the holder 150 and mounting the ink tank unit 200 onto the holder 150 as shown in FIG. 5E, the joint port 230 and the joint pipe 180 are perfectly connected, thus securing the vapor-liquid exchange mentioned above.

With Embodiment 1, the opening 260*c* is provided in the second valve frame 260*b* at the ink tank bottom side and near the valve disc seal part 264. According to this configuration of an opening 260c, at the opening time of the valve mechanism, i.e., directly after the valve disc 261 is pressed by the valve opening/closing projection 180*b* and moved to the valve cover 262, ink in the ink tank unit 200 begins to be supplied to the negative pressure control chamber unit 100 and the residual quantity of ink in the ink tank unit 200 can be minimized at the time of ink exhaustion.

Besides, in Embodiment 1, elastomer is used as the material constituting the joint seal face 260 of the first valve frame 260*a*, or the seal part of the first valve frame. On using elastomer as the constituent material of the first valve frame like this, a secure sealing of the joint pipe 180 with the sealing projection 180*a* can be secured by using the elastic force of this elastomer. In addition, affording a more intense elastic force to elastomer than the necessary minimum for securing the sealing between the first valve frame 260*a* and the joint pipe 180 (e.g., increasing the thickness of elastomer) enables the axial run out or torsion of the joining part by the joint pipe at the serial scanning of the ink-jet head cartridge to be suppressed by the bending of elastomer and a seal to be made with higher reliability. Furthermore, elastomer used as the constituent material can be integrally molded with the first valve frame 260*a* and the above effect is obtained without addition of parts. Besides, use of elastomer is not limited to the constituents mentioned above, but as the constituent material of a sealing projection 180*a* formed on the joint pipe 180 or as that of the seal part of a valve disc 261, elastomer may be used.

On the other hand, on demounting the ink tank unit 200 from the holder 150, release of sealing the joint port 230 and operation of the valve mechanism is carried out in reverse order to that of the above operations.

Namely, on pulling out the ink tank unit 200 from the holder 150 while turning in reverse direction to that for the mounting, first, the valve disc 261 advances by the urging force of the urging member 261 and the seal part of the valve disc 261 is pressed by the seal part of the first valve frame 260*a*, so that the valve disc 261 closes the joint port 230.

Thereafter, by further pulling out the ink tank unit 200, sealing of the joint port 230 by the sealing projection 180*a* is released. Since sealing of the joint port 230 is released like this after the valve mechanism closed, useless supply of ink to the joint port 230 is prevented.

Furthermore, since the sealing projection 180*a* is slantwise provided as mentioned above, release of seal for the joint port 230 is carried out from the upside end of the sealing projection 180*a*. Ink remains in the joint port 230 and inside the joint pipe 180 before sealing of the joint port 230 is released, but the upside end of the sealing projection 180*a* is released and the underside end remains still sealed, so that no ink leaks from the joint port 230. In addition to this, the interior of the joint port 230 and the joint pipe 180 is under negative pressure. Thus, when the upside end of the sealing projection 180*a* is released, the atmosphere intrudes from there into the joint port 230 and the ink remaining in the joint port 230 and the joint pipe 180 is drawn into the negative pressure control chamber unit 110.

Like this, in releasing the sealing of the joint port 230, the upside end of the sealing projection 180*a* is first released and the ink in the joint port 230 is next moved into the negative pressure control chamber unit 110, so that the leakage of ink from the joint port 230 at the removal of the ink tank unit 200 from the holder 150 can be prevented.

As described above, according to a connection structure between the ink tank unit 200 and the negative pressure control chamber unit 100, sealing of the joint port 230 is performed before the valve mechanism of the ink tank unit 200 is actuated, so that an unprepared leakage of ink from the joint port 230 can be prevented. Moreover, since at the connecting time and disconnecting time of the ink tank unit 200, the time difference of seal timing and release timing is provided between the top and the bottom, an unprepared operation of the valve disc 261 at the connecting time and leakage of the ink remaining in the joint port 230 at the disconnecting time can be prevented.

Besides, in this embodiment, the valve disc 261 is disposed more deeply than the opening end of the joint port 230 and this valve disc 261 is operated by the valve opening/closing projection 180*b* of the joint pipe 180, so that the stain of ink stuck on the valve disc 261 can be prevented without user's direct touch with the valve disc 261.

<Relation between Mounting/Demounting Operation of the Joint Port and the ID>

Next, the relation between mounting/demounting operation of the joint port and the ID will be described using FIGS. 4A to 4D and FIGS. 5A to 5E. FIGS. 4A to 4D and FIGS. 5A to 5E are illustrations of the mounting process of the ink tank unit 200 onto the holder 150, respectively and FIGS. 4A, 4B, 4C and 4D correspond respectively to FIGS. 5A, 5B and 5C at the same stage, FIGS. 4A to 4D show the situations of ID and FIGS. 5A to 5E show details of the joint part.

First, mounting operation is performed down to the position shown in FIGS. 4A and 5A, i.e., to the position where multiple ID members 170 provided on the negative pressure control chamber unit 100 for preventing the erroneous insertion of the ink tank unit 200 comes into touch with the slant face 251 of the ink tank. At this time point, the joint port 230 is so arranged as not to touch the joint pipe 180. At this time point, if an attempt is made to mount a wrong ink tank unit, the above slant face 251 and the above ID members 170 interfere with each other to hinder the further mounting of the ink tank unit. According to this embodiment, since the joint port 230 does not touch the joint pipe 180 by any means as mentioned above, the color mixing of ink at the joint part, sticking of ink, no ejection, image faults, failure of the device and an unnecessary exchange of the head in an ink-tank replaceable device can be prevented beforehand.

Next, as installed at the position shown in FIG. 4B, i.e., at the position allowing the above ID members 170 the ID recesses 252 to correspond to each other, the ink tank unit 200 mounted at a right position is further mounted to the innermost place (the side of the negative pressure control chamber unit 200). In the ink tank unit 200 mounted down to this position, the underside end of the sealing projection 180*a* of the joint pipe 180 butts against the seal face 260 of the joint port 230.

Subsequently, the joint part is connected and the interior of the ink tank unit 200 communicates with that of the negative pressure control chamber unit 100 like the progress mentioned above.

In the above embodiment, the sealing projection 180*a* is integrally provided at the joint pipe 180, but the sealing projection 180*a* and the joint pipe 180 may be separately configured and the sealing projection 180*a* may be so arranged as to be movable around the joint pipe 180 by nearly mating the sealing projection 180*a* with a convex or concave part. In mounting the ink tank 200 onto the holder 150, however, the movable range of the sealing projection 180*a* must be so designed that the valve disc opening/closing projection 180*b* does not butt against the valve disc 261 till the sealing projection 180*a* in the movable range butts against the joint seal face 260 completely.

In the above embodiment, the progress of mounting the ink tank unit 200 onto the holder 150 was represented by that the underside end of the sealing projection 180*a* butts against the joint seal face 260, the butting area gradually extends toward the top of the sealing projection 180*a* while the sealing projection 180*a* scoveres with the inserting operation of the ink tank unit 200 and finally the upside end of the sealing projection 180*a* butts against the joint seal face 260, but may be specified by that the upside end of the sealing projection 180*a* butts against the joint seal face 260, the butting area gradually extends toward the bottom of the sealing projection 180*a* while the sealing projection 180*a* scoveres with the inserting operation of the ink tank unit 200 and finally the downside end of the sealing projection 180*a* butts against the joint seal face 260 or may be specified by that the underside end and the upside end butt at the same time. At that time, even if the air present between the joint pipe 180 and the valve disc 261 pushes in the valve disc 261 and the valve disc 261 opens, the ink 300 in the housing container 201 does not leak outward because the joint port 230 is completely sealed by the sealing member 180*a* and the joint seal face 260. That is, the point of the present invention is that the valve mechanism is released after the joint pipe 180 and the joint port 230 are completely sealed and according to this embodiment, ink 300 in the store container does not leak outward at the mounting time of the ink tank unit 200. Since the further pushed in air enters the ink tank unit 200 to push out ink 200 in the ink store container 201 to the joint port 230, the supply of ink from the ink store container 201 to the absorbent 140 is speedily performed.

<Ink Supply Operation>

Next, the supply operation of ink in the ink-jet head cartridge shown in FIG. 2 will be described referring to FIG. 6. FIG. 6 is a sectional view for illustrating the supply operation of ink in the ink-jet head cartridge shown in FIG. 2.

As mentioned above, by dividing the absorbent in the negative pressure control chamber unit 100 into multiple members and disposing the boundary surface between the divided members above the top end of the joint pipe 180 in the using arrangement, after the ink in the upper absorbent 130 is consumed, ink in the lower absorbent 140 becomes consumable if ink is present in both of the absorbents 130 and 140 for the ink-jet head cartridge shown in FIG. 2. Besides, when the vapor-liquid interface L varies with a change in environments, first, ink is filled in the absorbent 140 and near the boundary surface 113*c* between the absorbents 130 and 140, then intrudes into the absorbent 130. Thus, together with the fiber direction of absorbent 140, a buffer space except the buffer one 116 in the negative pressure control chamber unit 100 can be secured stably. Furthermore, as with Embodiment 1, by keeping the capillary power of the absorbent 140 higher than that of the absorbent 130, ink in the upper absorbent 130 can be securely consumed at the time of use.

Furthermore, with this embodiment, since the absorbent 130 is pushed to the side of the absorbent 140 by the rib of the negative pressure control chamber cover 120, the absorbents 130 and 140 are in pressure contact with each other at the boundary surface 113*c* and the compressibility is higher and the capillary power is stronger near the boundary surface 113*c* between the absorbents 130 and 140 than elsewhere. In other words, letting P1, P2 and PS be the capillary power of the absorbent 140, that of the absorbent 130 and that of the region (boundary layer) at and near the boundary surface 113*c* between the absorbents 130 and 140, P2<P1<PS holds. Like this, by having the boundary layer strong in capillary power provided, the capillary power satisfying the above conditions is present at the boundary surface even if the capillary power ranges of P1 and P2 overlaps on account of dispersions of fiber density inside the absorbents 130 and 140, so that the above effect can be securely displayed. Besides, as mentioned above, having the joint pipe 180 disposed near beneath the boundary surface 113*c* between the absorbents 130 and 140 makes it possible to stably keep the liquid surface at the time of vapor-liquid exchange at this position.

Such being the case, a method for constituting a boundary layer 113*c* in this embodiment will be described. With this embodiment, the olefin resin fiber (2 denier) of capillary power P1=−110 mm Aq. is used as the constituent material of the absorbent 140 serving for a capillary power generating member and its rigidity is 0.69 kgf/mm. Here, the rigidity of the absorbents 130 and 140 is evaluated by measuring the repulsive force when pushing a 15 mm ϕ push bar into the absorbent in a stored situation in the negative pressure control chamber container 110 and deriving the gradient of repulsive forces to the pushed degrees. On the other hand, an olefin resin fiber similar in material to the absorbent 140 was used as the constituent material of the absorbent 130, but P2 of the absorbent 130 is weaker than that of the absorbent 140, its capillary force is P2=−80 mm Aq., while the fiber diameter of its fiber material is large (6 denier) and the rigidity of the absorbent 130 is as high as 1.88 kgf/mm. Like this, the absorbent 130 weaker in capillary power is set more rigid than the absorbent 140 stronger in capillary force and by bring these absorbents into pressure contact with each other and combining them, the absorbent 140 is collapsed near the boundary surface 113*c* between the absorbents 130 and 140 and the strength of capillary power can be arranged as P2<P1<PS. Furthermore, a difference between P2 and PS can be set to be greater than a difference between P2 and P1.

<Ink Consuming Operation>

Figure 7A:
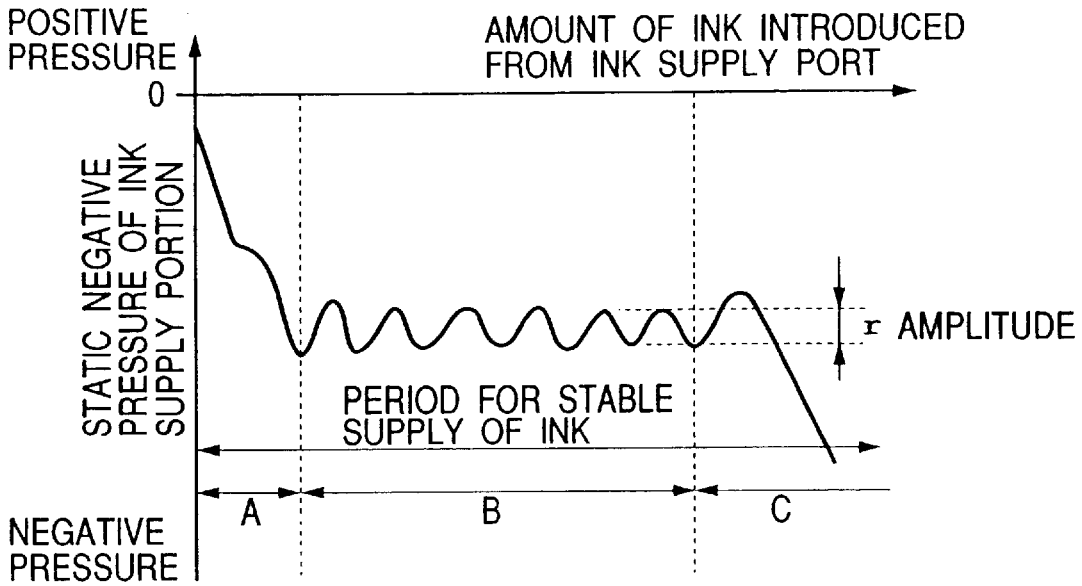
FIGS. 7A and 7B are figures for explaining the state of ink in the action of consuming ink that is explained on the basis of FIG. 6.
Figure 7B:
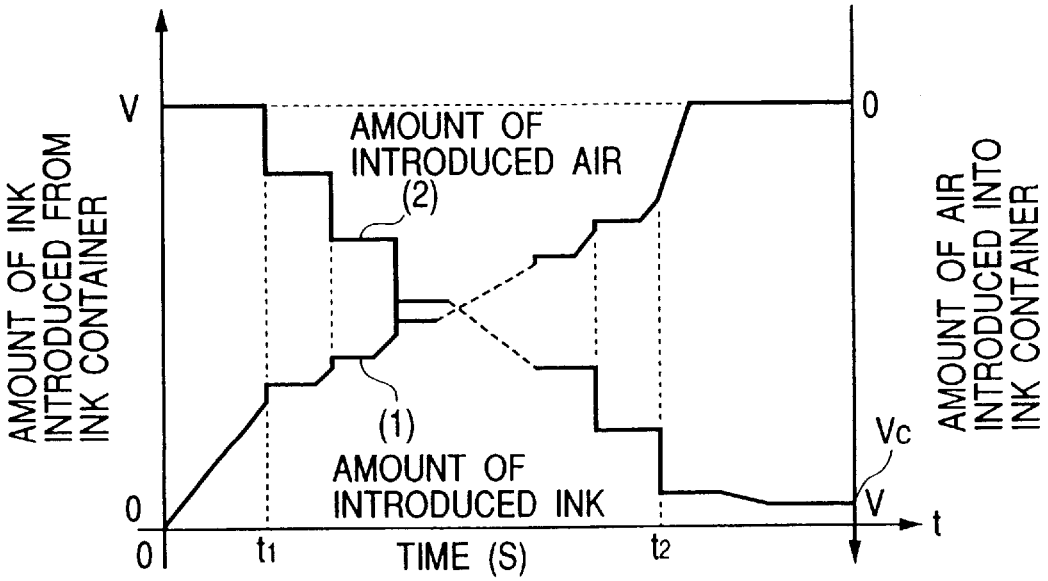
Figure 8A:
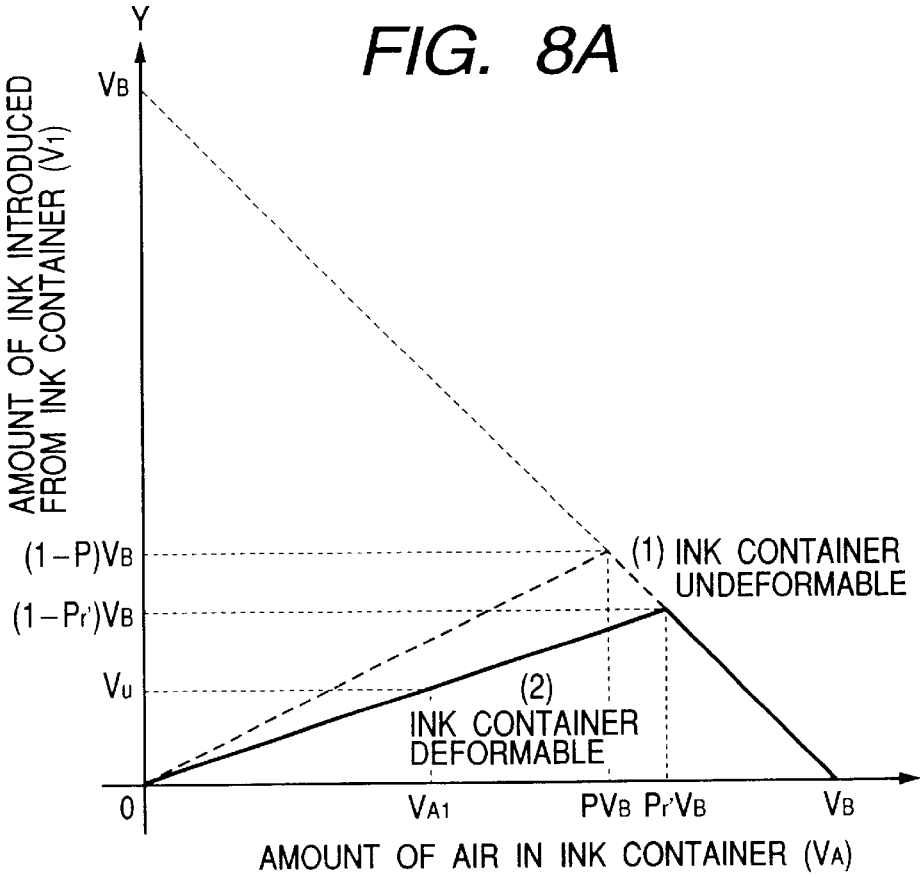
FIGS. 8A and 8B are figures for explaining the restraining effect of the fluctuation of the internal pressure by the deformation of an inside bag in the action of consuming ink that is explained on the basis of FIG. 6.
Figure 8B:
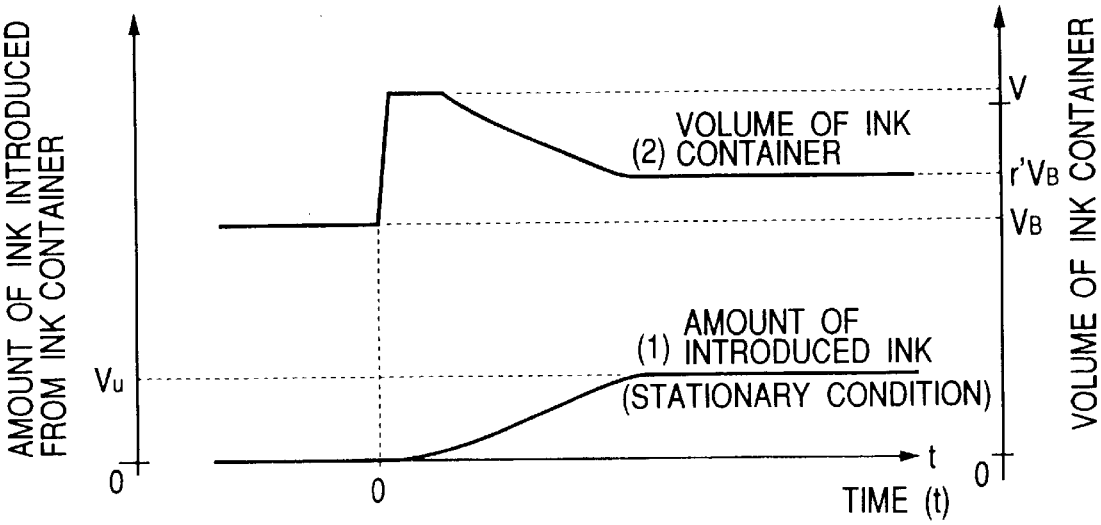

Next, an outline of the ink consuming operation from installation of an ink tank unit 200 in a negative pressure control chamber unit 100 as well as a holder 150 to when the ink inside the ink absorption container 201 is consumed will be described with reference to FIG. 6 and FIGS. 8A and FIG. 8B. FIGS. 7A and 7B are drawings to describe conditions of the ink in the ink consuming operation to be described based on FIG. 6, and FIGS. 8A and 8B are drawings to describe the controlling effects on inner pressure changes due to deformation of the inner bag 220 during the ink consuming operation.

First, as described above, the ink containing container 201 is brought into connection with the negative pressure control chamber unit 100 so that the ink inside the ink containing container 201 travels into inside the negative pressure control chamber unit 100 until pressures inside the negative pressure control chamber unit 100 and the ink containing container 201 become equal to get ready for use. Next, when the ink jet head unit 160 starts consuming ink, the ink maintained inside both the inner bag 220 and the absorption body 140 is consumed while the static vacuum values generated by both of inside the inner bag 220 and the absorption body 140 are balanced in the direction that the values increase (the first ink supply status: the region A of FIG. 7A). Here, when the ink is maintained in the absorption body 130, the ink in the absorption body 130 will be consumed as well. Incidentally, FIG. 7A is a drawing to describe an example of vacuum changes inside the ink supplying tube 165 at that time, and in FIG. 7A, the horizontal axis depicts quantities of ink lead out outside the negative pressure control-container 110 from the ink supplying tube 165, and the vertical axis depicts the value of vacuum (static vacuum) inside the ink supplying tube 165.

Next, a gas is introduced into the inner bag 220 so that the absorption bodies 130 and 140 will consume the ink remaining inside the capillary force generating member containing room 10 (the region C in FIG. 7A) via a gas-liquid conversion status (the second ink supplying status: the region B in FIG. 7A) maintaining an approximately constant vacuum against introduction of ink while maintaining gas-liquid boundary surface L.

Thus, the ink jet head cartridge of the practical embodiment hereof has a stage in which the ink inside the inner bag 220 is used without introducing outside air into inside the inner bag 220 so that limits on the inner volume of the ink containing container 201 in this ink supplying stage (the first ink supplying status) had be better to be considered only on the air introduced into inside the inner bag 220 when combination takes place. Consequently, it has an advantage that environmental changes such as temperature changes can be coped with in spite that limits on the inner volume of the ink containing container 201 may be eased.

In addition, when the ink containing container 201 is replaced in any status among the above-described regions A, B, and C in FIG. 7A, the negative pressure can be generated stably so that the certain ink supplying operation can be implemented. That is, with an ink jet head cartridge of the practical embodiment hereof, the ink inside the ink-containing container 201 can be almost completely consumed. Also in addition thereto at the time of replacement of the ink tank unit 200, the joint pipe 180 as well as the joint port 230 may contain the air inside and the ink-containing container 201 can be replaced regardless of the maintained quantity of ink of the absorbing bodies 130 and 140, and therefore a residual inspection mechanism do not always have to be installed so that an ink jet head cartridge with the ink jet head cartridge in which the ink containing container 201 is replaceable can be obtained.

Here, the operation in a series of ink consumption process that has been described so far will be described further from another point of view with FIG. 7B.

In FIG. 7B, which is a drawing to describe an example of operation in a series of the ink consuming process, the horizontal axis depicts time, and the vertical axes depicts quantities of ink lead out from the ink containing section and the air introductory quantities inside the inner bag 220 respectively. In addition, the ink supplying quantities into the ink jet head unit 160 over the laps of time is set constant.

The operation of a series of ink consumption process will be described from the point of view of quantities of the ink lead out as well as the air introductory quantities shown in FIG. 7B. In FIG. 7B, a full line (1) depicts quantities of the ink lead out from the inner bag 220 while a full line (2) depicts the air introductory quantities into the ink containing section. The time t=0 to the time t=t1 is equivalent to the region A prior to air-liquid exchange shown in FIG. 7A. In this region A, the ink is lead out from the head in a manner that from the absorption body 140 and from the inner bag 220 are balanced as described above.

Next, the time t=t1 to the time t=t2 is equivalent to the air-liquid exchange region (the region B) shown in FIG. 7A. In this region B, the air-liquid exchange is implemented based on the vacuum balance as describe above. As shown in the full line (1) in FIG. 7B, the air is introduced into the inner bag 220 (shown by a step form in the full line (2)) so that the ink is lead out from inside the inner bag 220. In that occasion, the quantity of the ink equivalent to the introduced air accompanied by introduction of the air is not immediately lead out from inside the inner bag 220, but after a predetermined time is lapsed from for example introduction of the air, the quantity of the ink equivalent to the introduced air is arranged to be lead out from inside the inner bag 220 at last. As obvious from this FIG. 7B, such an operation tends to give rise to a lag in timing compared with the operation of an ink tank in which the inner bag 220 does not exist and the ink containing section does not undergo deformation. As described above, this operation is repeated in the air-liquid exchange region. As the ink lead out inside the inner bag 220 increases, the air quantity and the ink quantity inside the inner bag 220 will be reversed at a certain time point.

Passing the time t=t2, the process will enter the region after the air-liquid exchange (the region C) shown in FIG. 7A. In this region C, as described above, the pressure inside the inner bag 220 will reach the atmospheric pressure. Accompanied thereby, the operation will return to the initial state (the state prior to the starting of the use) by the elastic force of the inner bag 220. Incidentally, so-called buckling will not bring the inner bag 220 into the complete initial state. Therefore, the final air introductory quantity Vc into the inner bag 220 will fall within the range fulfilling V>Vc. Also the region C will be brought into the state that the ink from the inner bag 220 is used out.

As described so far, the phenomena of the air-liquid exchange operation in the configuration of the ink jet head cartridge of the practical embodiment hereof can be cited as characteristics by comparatively large pressure dispersion (an amplitude r in FIG. 7A) when compared with the ink tank system undergoing the conventional air-liquid exchange.

As a reason hereof, the ink lead out from inside the inner bag 220 prior to the air-liquid exchange serves to bring the inner bag 220 into a state so that it is deformed toward inside the tank. Consequently the elastic force of the inner bag 220 applies a force outward all time in the wall section of the inner bag 220. Therefore, in many cases the air that enters inside the inner bag 220 in order to relieve the pressure difference between inside the absorption body 140 and inside the inner bag 220 at the time of the air-liquid exchange may enter as described above with more than a predetermined quantity. That tends to serve to increase the ink lead out to the negative pressure control chamber unit 100 as well from the inner bag 220. On the other hand, in the case where inside section of the ink tank unit 200 is configured by having such an ink containing section that will not undergo deformation unlike the inner bag 220 inside the ink tank unit 200, a predetermined quantity of air enters that ink containing section so that the ink will be immediately lead out to the vacuum controlling room unit 100.

For example, in the case where printing of 100% duty (solid mode) is implemented, a large quantity of ink is ejected at a time from the ink jet head unit 160. This will cause ink to be lead out rapidly both from inside the negative pressure control chamber unit 100 and the ink containing container 201, but in the ink jet head cartridge of the practical embodiment hereof, since a comparatively large quantity of ink is lead out due to the air-liquid exchange, there are no needs to concern that ink is run out so that reliability thereon increases.

In addition, according to the configuration of the ink jet head cartridge of the present embodiment hereof, the ink is lead out under a state that the inner bag 220 is deformed inward, giving rise to, as an advantage, a high buffer effect against vibration of the carriage, etc., and external factors due to environmental changes.

As described above, the ink jet head cartridge of the practical embodiment hereof can relieve tiny changes of negative pressure with the inner bag 220, and moreover according to that configuration, in such a case of the second ink supplying state where the air is contained inside the inner bag 220, a solution method different from the conventional methods will become capable of coping with environmental changes such as temperature changes, etc.

Next, in the case where the environmental conditions of the ink jet head cartridge shown in FIG. 2 have been changed, the mechanism to hold liquid stably inside the unit will be described with reference to FIG. 8. In the following description, the absorption bodies 130 and 140 are called as a capillary force generating member as well.

Decrease in atmospheric pressure or increase in atmospheric temperature expands the air inside the inner bag 220 so that the wall section configuring the inner bag 220 and the liquid surface inside the inner bag 220 are pressed. This causes the inner volume of the inner bag 220 to increase and a part of the ink inside the inner bag 220 to flow out from inside the inner bag 220 to inside the negative pressure control container 110 through the joint port 230 as well as the joint pipe 180. Here, the inner volume of the inner bag 220 increases so that the quantity of the ink flowing out to the absorption body 140 will sizably decrease compared with the case where the section in which the ink is contained cannot undergo deformation.

Here, the quantity of the ink flowing out to inside the negative pressure control container 110 through the joint port 230 and joint pipe 180 relieves the negative pressure inside the inner bag 220 and increases the inner volume of the inner bag 220 in the case where the air pressure changes rapidly so that influence from the resisting power of the wall surface given rise to by relieving deformation of the wall section of the inner bag 220 inward and the resisting power to cause the ink to move to be absorbed by the capillary force generating member is initially dominant.

In particular, in the case of the present configuration, since the capillary force generating member (the absorption bodies 130 and 140) has a flow resistance bigger than the resistance against restoration of the bag, the inner volume of the inner bag 220 will increase at first with air expansion. In addition, in the case where the volume increase due to air expansion is larger than the upper limit of this increased portion, the ink will flow out from inside the inner bag 220 to the party of the negative pressure control container 110 via the joint port 230 as well as the joint pipe 180. That is, the wall surface inside the inner bag 220 functions as a buffer against environmental changes so that the movement of the ink inside the above-described capillary force generating member becomes smooth and the vacuum characteristics in the vicinity of the ink supplying tube 165 will be stabilized.

Incidentally, in the practical embodiment hereof, the ink flowing out into the negative pressure control container 110 is arranged to be held by the above-described capillary force generating member. In this case, the quantity of the ink in the negative pressure control container 110 temporally increases and causes the air-liquid boundary surface to rise so that the inner pressure shifts to somewhat positive party temporally than in the period when the inner pressure of the ink is stable as in the initial period of use, but the ejecting characteristics of the liquid ejection recording means such as the ink jet head unit 160 are influenced little, giving rise to no problems for actual use. In addition, when the atmospheric pressure is restored to the level prior to decompression (back to 1 air pressure or in the case where the original temperature is restored), the ink, which has leaked out to the negative pressure control container 110 has been held by the above-described capillary force generating member, will be returned to inside the inner bag 220 again and the inner volume of the inner bag 220 will be returned to the original state.

Next, the theoretical performance in the case where the operation reaches the ordinary state under the air pressure subject to changes after the initial performance after a change in the air pressure will be described.

What is characteristic under this state is that the interface of the ink held by the above-described capillary force generating member changes so as to maintain the balance against not only the quantity of the ink lead out from inside the inner bag 220 but also the change in the negative pressure due to the change in the inner volume of the inner bag 220 itself. Here, as concerns the relationship between the quantity of ink absorbed by the above-described capillary force generating member and the ink containing container 201, from the point of view that the above-described decompression or leakage of the ink from the atmosphere communication port, etc., at the time of a temperature change is prevented, the flow out of the ink from the ink containing container 201 under worst condition as well as the quantity of the ink to be held by the negative pressure control container 110 at the time when the ink is supplied from the ink containing container 201 are considered to determine the maximum quantity of ink absorption of the negative pressure control container 110 and to make the negative pressure control container 110 have the volume to contain the capillary force generating member at least for that portion so as to give rise to a good result.

FIG. 8A shows by the dotted line (1) the relationship between the initial space volume (the air volume) inside the inner bag 220 scaled by the horizontal axis (X) prior to decompression in the case where the shape inside the inner bag 220 does not change at all against air expansion and the ink flowing-out quantity scaled by the vertical axis (Y) in the case where the air pressure is reduced to P air pressure ($0<P<1$).

Accordingly, for estimation under the worst condition on the ink flowing-out quantity from inside the inner bag 220, for example, with the maximum decompression condition for the atmospheric pressure being 0.7 air pressure, the ink flowing-out quantity from the ink containing container 201 is maximized when the ink equivalent to 30% of the volume VB of the inner bag 220 is left inside the inner bag 220, and the ink under the lowest section of the inner wall of the inner bag 220 may well be regarded to be absorbed by the capillary force generating member of the negative pressure control container 110 as well so that all the ink left in the inner bag 220 (30% of the VB) leaks out.

On the other hand, in the practical embodiment hereof, the inner bag 220 undergoes deformation inside against the air expansion, and consequently compared with the inner volume of the inner bag 220 prior to expansion, the inner volume of the inner bag 220 after expansion increases so that the ink holding level inside the negative pressure control container 110 changes to keep balance against variation of the negative pressure due to deformation inside this inner bag 220. In addition, under the normal conditions, the ink from inside the inner bag 220 will keep balance on the negative pressure with the capillary force generating member in which the negative pressure is reduced compared with prior to air pressure variation. That is, the quantity of the ink lead out is reduced by the expanded quantity inside the inner bag 220. As a result, an example is shown with the full line (2). As apparent from these dotted line (1) and the full line (2), the estimate under the worst condition on the quantity of the ink lead out from inside the inner bag 220 can be made less than in the case where the inner bag 220 is not deformed inside at all for air expansion. The above-described phenomena are similar to that in the case of temperature changes of the ink tank, but even with temperature increase around 50 deg. the flowing-out quantity is less than that at the time of the above-described decompression.

Thus, according to the ink tank of the present invention, expansion of the air inside the ink containing container 201 due to environmental changes can be accepted not only by the negative pressure control container 110 but also by the ink containing container 201 with the buffer effects increasing the volume of the ink containing container 201 itself until the outlook shape inside the inner bag 220 is substantially equal to the shape of the inner surface of the box 210 at the maximum so that an ink supplying system which can cope with environmental changes in spite that the ink containing quantity of the ink containing container 201 sizably increases can be provided.

In addition, FIG. 8B shows as a model the quantity of the ink lead out from inside the inner bag 220 as well as the inner volume of the inner bag 220 over a lapse of time in case where the environment of the tank is caused to change from under the atmospheric pressure at t=0 to under the decompressed environment of P air pressure (0<P<1) at the time when the initial volume of the air is VA1. In FIG. 8B, the horizontal axis depicts time (t), and the vertical axis depicts the quantity of the ink lead out from inside the inner bag 220 as well as the inner volume of the inner bag 220, and the full line (1) depicts the changes over time on the quantity of the ink lead out while the full line (2) depicts the changes over time on the volume inside the inner bag 220.

As shown in FIG. 8B, for a dramatic environmental change, the air expansion can be coped with mainly by the ink containing container 201 before the negative pressure control container 110 finally enters the normal status to keep the negative pressure balance with the ink containing container 201. Accordingly, for a dramatic environmental change, the timing of the ink lead out from the ink containing container 201 to the negative pressure control container 110 can be delayed.

Accordingly, such an ink supplying system can be provided that can increase acceptability against the gas expansion of the external air introduced by air-liquid exchange and can supply the ink under the stable negative pressure condition during the use of the ink containing container 201 even under environments for various uses.

According to the ink jet head cartridge of the practical embodiment hereof, materials for the capillary force generating member (the ink absorption bodies 130 and 140) as well as inside the inner bag 220 are appropriately selected so that the volume ratio of the negative pressure control container 110 to inside the inner bag 220 can be determined optionally even with larger than 1:2 for actual use. Particularly, in the case where the buffer effects inside the inner bag 220 are considered important, increase in quantity of deformation inside the inner bag 220 under the air-liquid exchange state for the use starting state within the range where elastic deformation can take place will give rise to a good result.

Thus, according to the ink jet head cartridge of the practical embodiment hereof, even in the case where the capillary force generating member occupies a little volume together with the configuration of the negative pressure control container 110, effects can be extended in a multiplied fashion for the changes in the external environments.

In the ink jet head cartridge of the practical embodiment hereof, as shown in FIG. 2, the joint pipe 180 is provided upper than the lowest section of the negative pressure control container 110. This can result in an effect to reduce the dispersion in the ink component inside the absorption bodies 130 and 140 inside the negative pressure control container 110. This effect will be described further in detail as follows.

The ink from the ink tank unit 200 is supplied to the ink jet head unit 160 via the joint port 230 as well as the absorption bodies 130 and 140, and there exist various routs from the joint port 230 to the ink supplying tube 165. There will give rise to a vast difference in the rout in the case where the ink is directly supplied with the shortest distance compared with in the case where for example the increase in liquid surface inside the absorption body 140 due to the above-described environmental changes, etc., causes the ink to once reach the upper section of the absorption body 140 and then is lead to the ink supplying tube 165. That happens to give rise to an influence to recording performance due to dispersion in the ink components. As in the configuration of the ink jet head cartridge of the practical embodiment hereof, the joint pipe 180 is disposed at the upper section of the absorption body 140 so that the dispersion in the ink traveling rout, that is, the difference in the rout distance can be limited and thus the dispersion in the ink components can be limited. That can serve to limit the dispersion component to the recording performance. Thus, the joint pipe 180 as well as the joint port 230 is preferably disposed at the upper section as much as possible, however, to be limited preferably to a certain degree as in the practical embodiment hereof in order to secure the buffer function. This position is appropriately determined under conditions such as the absorption bodies 130 and 140, the ink, the ink supplying quantity, and the ink quantity, etc.

Incidentally, inside the negative pressure control container 110 of the ink jet head cartridge of the practical embodiment hereof, as described above, the absorption body 140 with the capillary force of P1 and the absorption body 130 with the capillary force of P2 are brought into contact by pressure and housed so that the boundary surface 113*c* with the capillary force of PS is formed. The relationship among respective capillary forces is P2<P1<PS, that is, giving rise to a relationship that the capillary force of the boundary surface 113*c* is strongest, and then the capillary force of the absorption body 140 disposed at the lower step is less strong, and the capillary force of the absorption body 130 disposed at the upper step is least strong. Since the capillary force of the boundary surface 113*c* is the strongest and the capillary force of the absorption body 130 disposed at the upper step is the least strong, even if the ink supplied from the communication port 231 flew into the absorption body 130 at the upper step over the boundary surface 113*c*, the ink will be drawn strongly to the direction of the boundary surface 113*c* party so as to return to the direction of the boundary surface 113*c*. Thus the existence of the boundary surface 113*c* can reduce the difference between the distance of a rout K and the distance of a rout J without the rout J tracing a line so as to pass both the absorption body 140 and the absorption body 130 and thus together with the communication port 230 being formed upper than at the supplying port 131. Thus, the difference in the influence that the absorption body 140 gives the ink to take place at the time when the rout of the ink flowing inside the absorption body 140 is different can be reduced to a small level.

In addition, in the practical embodiment hereof, the ink absorption body being housed in the negative pressure control container 110 and being a negative pressure generating member is configured by two members. The practical embodiment hereof is configured by comprising the absorption bodies 130 and 140 having respectively different capillary forces with the absorption body of stronger capillary force at the lower section being used. In addition, the joint pipe 180 is disposed at the lower section in the vicinity of the interface of the boundary surface 113*c* between the absorption bodies 130 and 140 so that the dispersion in the ink routs will be able to be limited and the reliable buffer portions will be able to be secured.

In addition, the supplying port 131 is exemplified as that being formed in the vicinity of the center of the lower wall of the negative pressure control container 110, but without being limited hereby, if necessary, that with the supplying port being formed in the direction so as to be departed from the communication port 231, that is, at the left end party of the lower wall or the side wall at the left side in FIG. 2 will do. In this relation, the ink jet head unit 160 provided in the holder 150 as well as the ink supplying tube 165 may be disposed at the position corresponding to the supplying port formed at the left end party of the lower wall or at the side wall at the left side.

<Valve Mechanism>

Next, the valve mechanism provided inside the joint port 230 of the above-described ink tank unit 200 will be described with reference to FIGS. 9A to 9D.

Figure 9D:
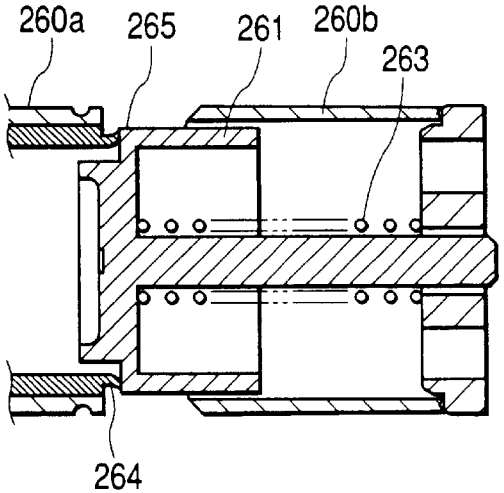
FIGS. 9A, 9B, 9C and 9D are figures showing the relation between a valve frame and a valve body in the valve mechanism applicable to the present invention.
Figure 9C:
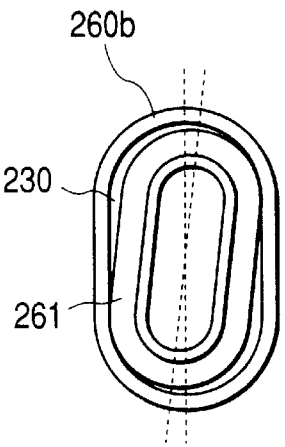
Figure 9B:
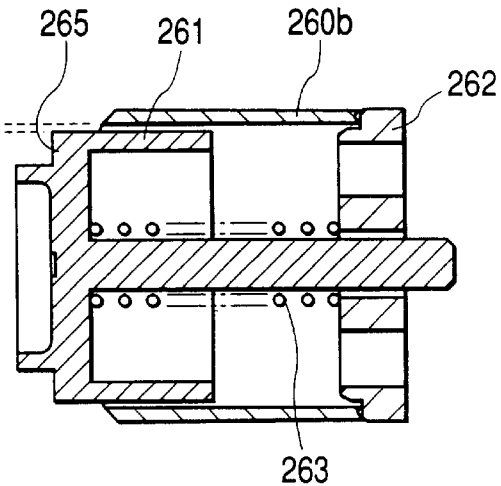
Figure 9A:
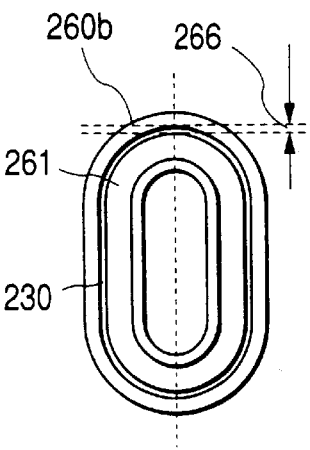

FIG. 9A is a front view on the relationship between the second valve frame 26*b* and the valve body 261, FIG. 9B is a side sectional view of FIG. 9A, FIG. 9C is a front view on the relationship between the second valve frame 26*b* and the rotated valve body 261, and FIG. 9D is a side sectional view of FIG. 9C.

As shown in FIGS. 3A and 3B and FIG. 9A as well as FIG. 9B, the opening of the joint port 230 is shaped as an elongated hole expanding in one direction in order to improve the ink supplying performance of the ink containing container 201 so that the open area of the joint port 230 is enlarged. However, the opening width of the joint port 230 is enlarged in the horizontal direction perpendicular to the elongating direction of the joint port 230 and then the space occupied by the ink containing container 201 will increase, resulting in voluminousness of the device. This tendency is particularly effective in the case where the ink tanks are arranged in parallel in the horizontal direction (in the carriage scanning direction) coinciding with recent tendency toward colorization and photographic quality. Thus, in the practical embodiment hereof the joint port 230 being the ink supplying port of the ink containing container 201 is shaped as an elongated hole.

Moreover, in the ink jet head cartridge of the practical embodiment hereof, the joint port 230 has a role to supply the ink to the negative pressure control chamber unit 100 and a role to introduce the atmosphere into inside the ink containing container 201. Accordingly, the elongated shape of the joint port 230 having the elongating direction in the direction perpendicular to the direction of gravity will be able to easily separate functionally the lower section of the joint port 230 as the ink supplying path from the upper section of the joint port 230 as the atmosphere introductory path so that the ink supply as well as the air-liquid exchange can be certainly attained.

As described above, the joint pipe 180 of the negative pressure control chamber unit 100 is inserted into inside the joint port 230 coinciding with installation of the ink tank unit 200. This causes the valve body 261 to be pushed by the protrusion 180*b* to open/close the valve at the tip of the joint pipe 180 so as to open the valve mechanism of the joint orifce 230 so that the ink inside the ink containing container 201 is supplied to inside the negative pressure control chamber unit 100. According to the posture of the ink tank unit 200 being installed in the joint pipe 180, also in the case where the protrusion 180*b* to open/close the valve undergoes die facing against the valve member, the sectional shape at the tip section of the sealing protrusion 180*a* disposed on the side surface of the joint pipe 180 is shaped a semicircle so that twisting of the valve body 261 can be prevented. At this time, in order to enable the valve body 261 to slide in a stable fashion, the clearance 266 is provided as shown in FIG. 9A as well as FIG. 9B between the joint seal surface 260 inside the joint port 230 and the external periphery at the portion of the side of the first valve frame 260*a* of the valve body 261.

Moreover, the joint pipe 180 has at least its upper portion being open at the tip portion, and therefore in the case where the joint pipe 180 is inserted into the joint port 230, without formation of any main atmosphere introducing path being interrupted inside the joint pipe 180 as well as at the upper section inside the joint port 230, the smooth air-liquid exchange can be operated. On the contrary, at the time when the ink tank unit 200 is removed, the joint pipe 180 is separated from the joint port 230 so that the valve body 261 slides forward in the first valve frame 260*a* by the elastic form applied by the urging member 263, and as shown in FIG. 9(D), the valve frame seal section 264 of the first valve frame 260*a* and the valve body seal section 265 of the valve body 261 is brought into engagement so as to block the ink supplying path.

Figure 10:
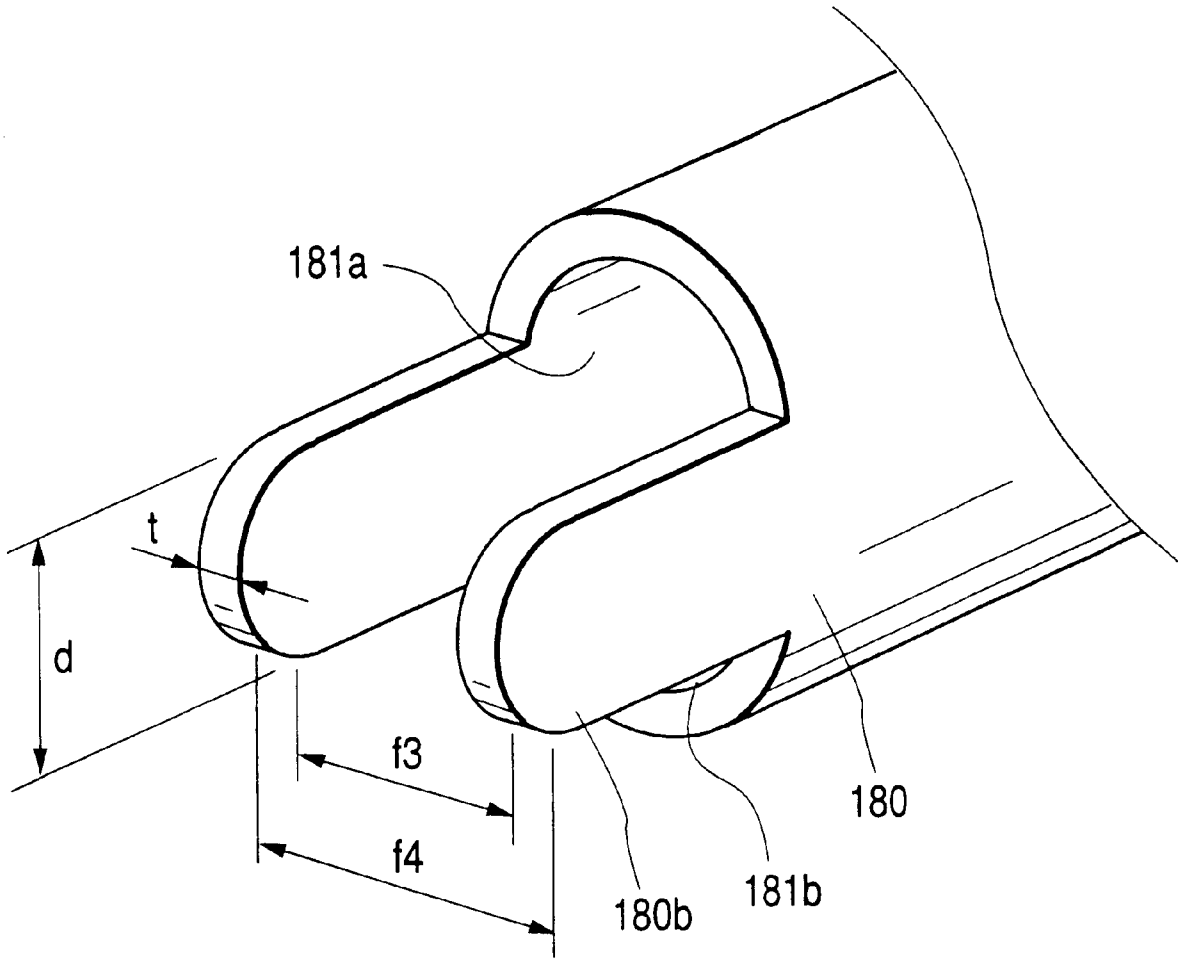
FIG. 10 is a perspective view showing one example of the shape of the tip part of a joint pipe to be engaged at the time of opening and closing action of the valve mechanism applicable to the present invention.

FIG. 10 is a perspective view showing an example of the shape of the tip section of the joint pipe 180. As shown in FIG. 10, at the upper portion in the tip section of the elongated joint pipe 180, an upper opening 181*a* is formed and at the lower portion in the tip section a lower opening 181*b* is formed. The lower opening 181*b* is an ink path while the upper opening 181*a* is for a path for the air, but sometimes the ink travels through the upper opening 181*a*.

In addition, the value of the pressure to the first valve frame 260*a* is set so that the urging force of the valve body 261 is maintained approximately at a constant even if there takes place any difference between pressures inside and outside of the ink containing container 201 under environmental changes for use. In the case where such an ink tank unit 200 is used in the high land of 0.7 air pressure and afterward the valve body 261 is closed and relocated under the environment of 1.0 air pressure, the inner space of the ink containing container 201 will be decompressed than the atmospheric pressure so that a force will be applied to that valve body 261 in the direction that the valve body 261 is pushed open. In the case of the practical embodiment hereof, the force FA of the atmosphere pushing the valve body 261 will be:

$$FA=1.01\times10^5[N/m^2] \text{ (1.0 air pressure)}$$

In addition, the force FB of the gas inside the ink tank pushing the valve body 261 will be:

$$FB=0.709\times10^5[N/m^2] \text{ (0.7 air pressure)}$$

In order to cause the valve body 261 to generate an urging force all the time over such environmental changes, the urging force FV of the valve body 261 needs to fulfill:

$$FV-(FA-FB)>0$$

That is, in the practical embodiment hereof, the following will be given:

$$FV>1.01\times10^5-0.709\times10^5=0.304\times10^5[N/m^2]$$

This value is for the case where the valve body 261 and the first valve frame 260*a* are brought into engagement. When the valve body 261 and the first valve frame 260*a* are separated, that is, the displacement quantity of the urging member 263 in order to generate an urging force toward the valve body 261 becomes intensive so that the value of the urging force to urge the valve body 261 toward the first valve frame 260*a* party will apparently become further intensive.

With a valve mechanism in such a configuration, the coefficient of friction of the sliding surface on the valve body 261 of the protrusion 180*b* to open/close the valve happens to become grater due to fixation of the ink, etc., and in that occasion, the valve body 261 does not slide on the sliding surface of the protrusion to open/close the valve, and thus so-called complicating phenomena that the valve body 261 is pushed up upward in the drawing by the protrusion 180*b* to open/close the valve and implements stroking while the rotational operation is underway might take place.

In this relation, a mode of a valve which can cause influence onto the seal performance because the complication phenomena takes place to be taken into consideration will be described as follows with a comparative embodiment.

Figure 11:
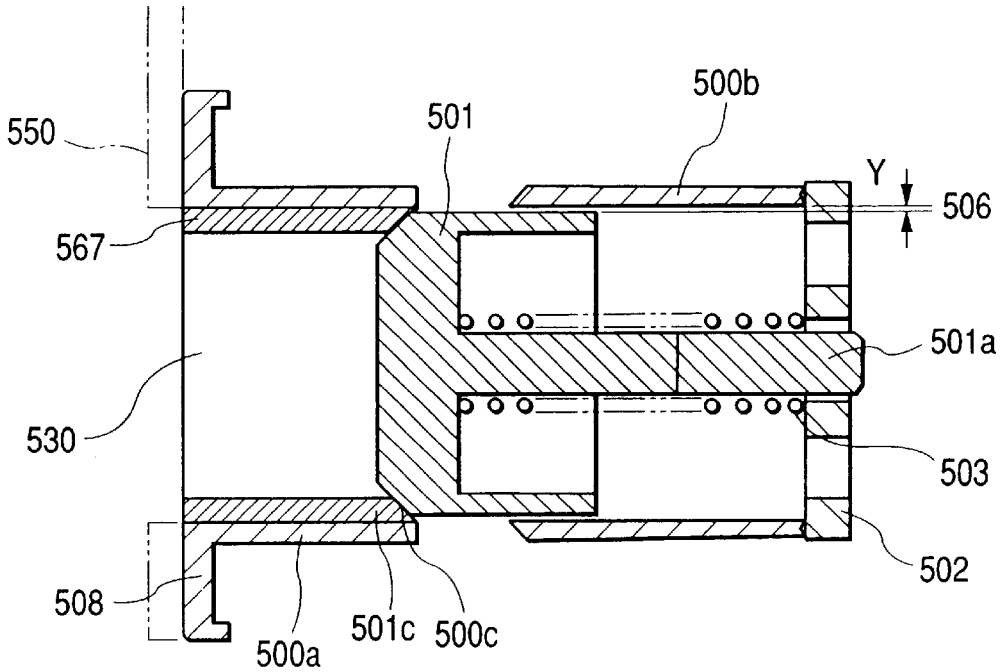
FIG. 11 is a figure showing an example of a form for being compared with the valve mechanism applicable to the present invention.
Figure 12:
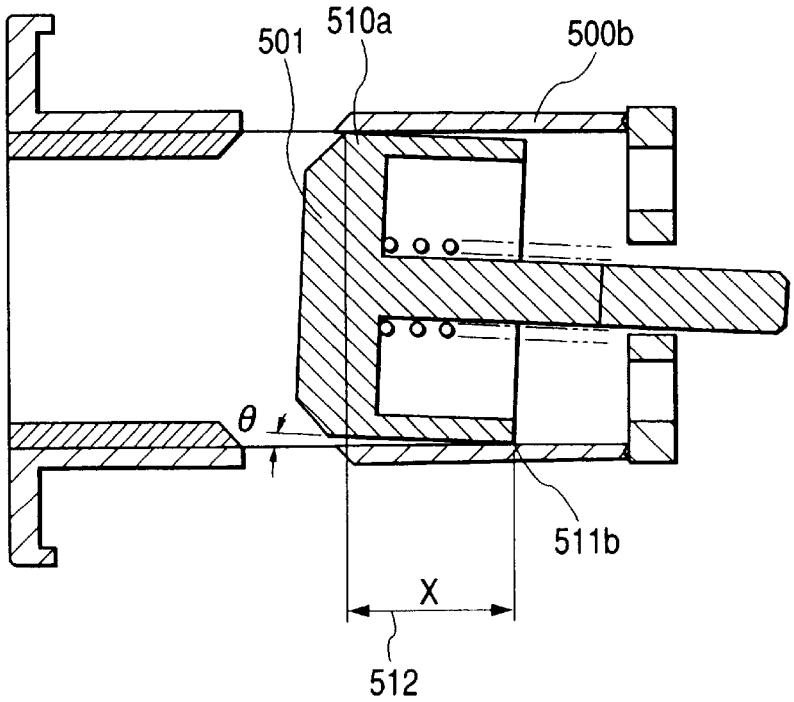
FIG. 12 is a figure showing the state of twisting in the valve mechanism in FIG. 11.
Figure 13:
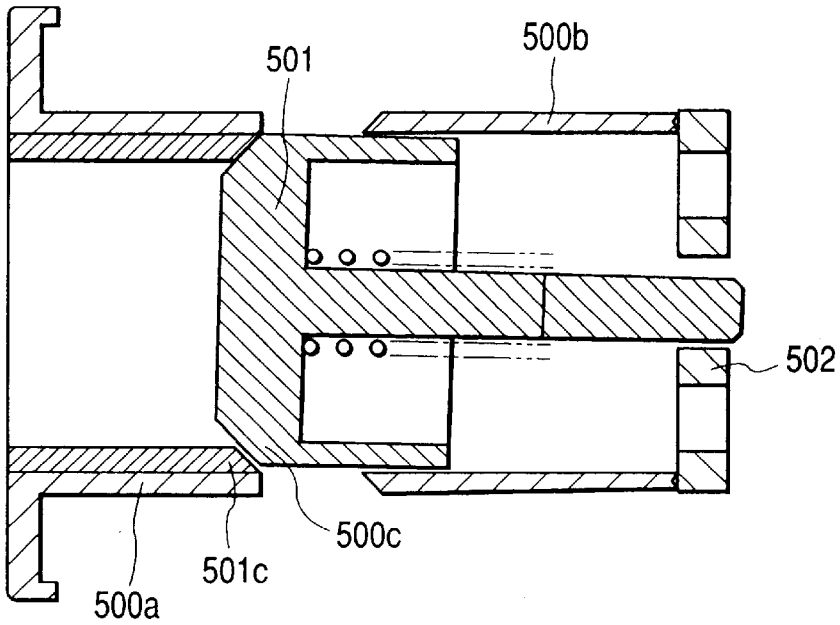
FIG. 13 is a figure showing the sealing state in the valve mechanism in FIG. 11.

FIG. 11 shows an example of a mode to be compared with the valve mechanism of the present invention, and FIG. 12 as well as FIG. 13 shows complication and seal status in the valve mechanism of FIG. 11. In the comparative embodiment in FIG. 11, clearance 506 between the valve body 501 shaped as an elongated hole and the second valve frame 500*b* for sliding is provided with a fixed quantity. The valve body 501 is pushed onto the first valve frame 500*a* with the urging member 503 so as to seal the joint port 530 subject to tight contact between the taper-like valve body seal section 501*c* at the second valve frame 500*b* party of the valve body 501 and the taper-like seal section 500*c* of the first valve frame 500*a*. When the above-described complication phenomena take place in the configuration of such a comparative embodiment, as shown in FIG. 12, the valve body 501 and the second valve frame 500*b* are brought into contact at two places, namely the contact surface 510*a* and the contact surface 511*b*. X, the distance between these to contact surfaces, and Y, the clearance quantity, give the complication angle θ ($\theta=\tan-1(2Y/X)$), which can be made smaller as the distance X between the contact surfaces becomes greater for the same quantity of clearance. However, in the case of this comparative embodiment, the distance X between the contact surfaces is comparatively short (compared, for example, with the diameter of the valve body) and thus the complication angle θ is comparatively large. In other words, the rotational operation of a comparatively large angle is necessary for correction of complication, and therefore the complication taking place is judged to undergo correction under lower probability.

Without this complication being corrected the taper-like valve body seal section 501*c* as well as the first valve frame seal section 500*c*, in particular, in their R portions in the elongated shape, which are again brought into contact with the first frame body 500*a* as shown in FIG. 13, the contact radius of the both parties will become different each other and thus the contact portion will not be brought into complete tight contact but the ink leakage will take place.

In addition, the second valve frame 500*b* and the valve cover 502 are sealed ultrasonically, but the valve cover of the comparative embodiment, which is a simple plane, give rise to positional displacement due to ultrasonic vibration, and could disperse accuracy with respect to the center position of the hole of the valve cover 502 into which the sliding shaft 501*a* of the valve body 501 is inserted. Therefore, it will become necessary that the hole of the valve cover 502 is made large so that the hole of the valve cover 502 and the sliding shaft 501*a* of the valve body 501 should not be brought into contact. The minimum radius of the urging member 503 is determined by the diameter of the hole in the valve cover 502, making it difficult to miniaturize the urging member 503 and consequently to miniaturize the enter valve mechanism.

Figure 14:
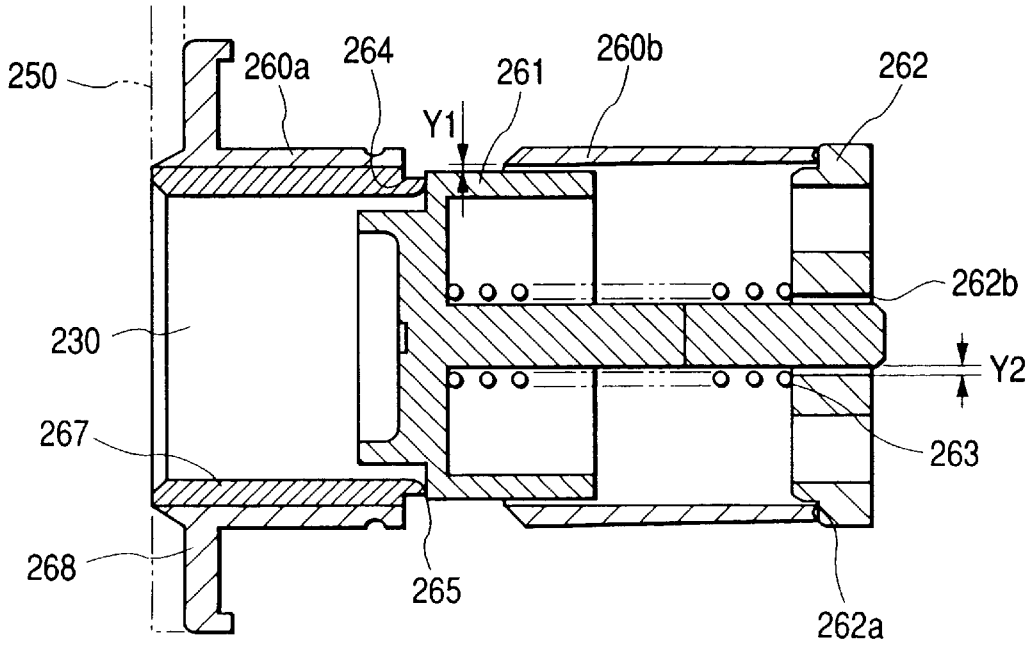
FIG. 14 is a figure showing the valve mechanism applicable to the present invention.
Figure 15:
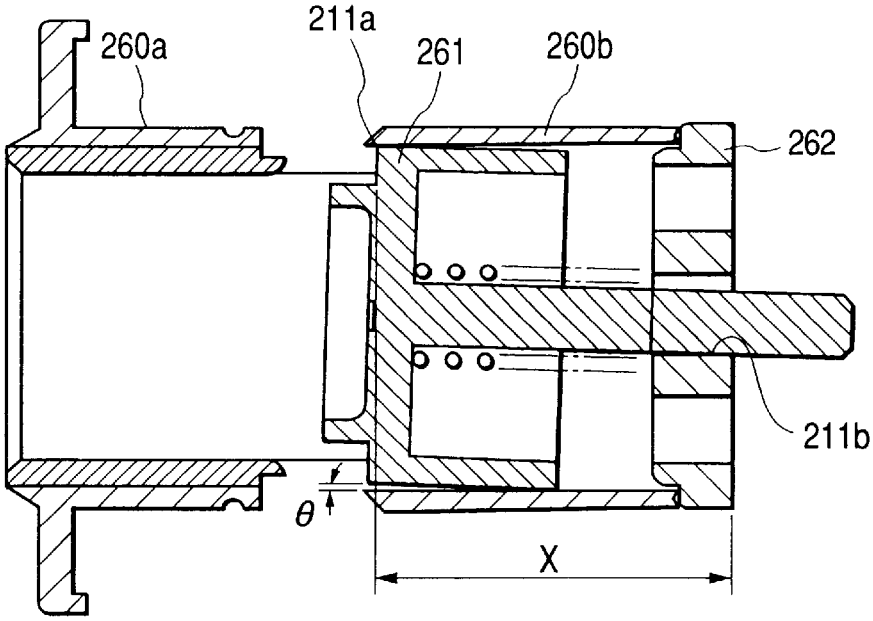
FIG. 15 is a figure showing the state of twisting in the valve mechanism in FIG. 14.
Figure 16:
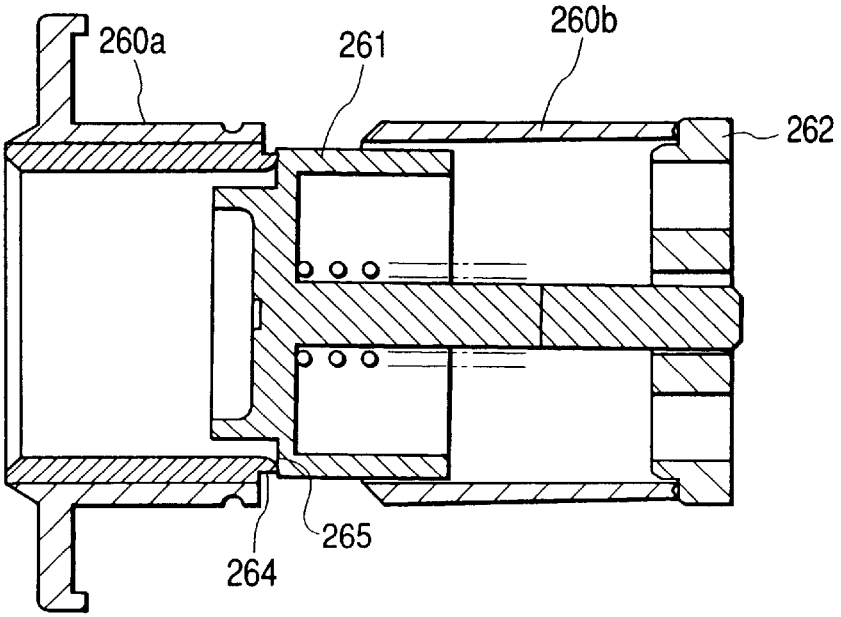
FIG. 16 is a figure showing the sealing state in the valve mechanism in FIG. 14.

Unlike such a comparative embodiment, the valve mechanism of the practical embodiment hereof is configured as follows. FIG. 14 shows a valve mechanism according to the practical embodiment of the present invention, and FIG. 15 as well as FIG. 16 shows complication and seal status in the valve mechanism in FIG. 14. As shown in FIG. 14, in the practical embodiment hereof, the valve body 261 is provided with a taper in the direction of the stroke (rightward in the drawing) where its diameter (at least longer diameter) gets smaller. The inner peripheral section of the second valve frame 260*b* is likewise provided with a taper in the direction of the stroke where its inner diameter gets larger. In this configuration, when the valve body 261 gets complicated, in order that the valve body 261 and the second valve frame 26*b* are brought into contact at the position of the contact surface 511*b* of the comparative embodiment in FIG. 12, greatly large angle is necessary, and before that angle is attained, the sliding shaft of the valve body 261 is brought into contact with the hole in the valve cover 262 (See FIG. 15). Thus serves to enable the distance of contact surfaces X to be set long, and thus the complication angle θ can be made small. Therefore, without the complication being corrected, as shown in FIG. 16, the valve body 261 is brought into contact with the first frame body 500*a*, and nevertheless since the complication angle θ is very small compared with the comparative embodiment, the valve seal section 265 and the first valve frame seal section 264 are brought into good tight contact.

But, with X being the distance between contact surfaces, Y1 being the clearance between the valve body 261 and the second valve frame 26*b*, and Y2 being the clearance between the sliding shaft of the valve body 261 and the hole in the valve cover 26*b*, the complication angle in this case will become $\theta=\tan-1(Y1+Y2/X)$.

In addition, the valve cover 262 is provided with a valve cover sealing guide 262*a* being a step section (with the valve cover's entering quantity of 0.8 mm) capable of causing the valve cover 252 to enter inside the second valve frame 206*b* as well as of being brought into contact with the end section of the second valve frame 26*b*. Therefore, in the valve cover 262, the diameter of the hole to which the sliding shaft of the valve body 261 enters is made smaller than that in the comparative embodiment. That is, the valve cover sealing guide 262*a* makes smaller the positional divergence of the valve cover 262 due to vibration at the time when the second valve frame 26*b* and the valve cover 262 are ultrasonically sealed and accuracy of the center position of the hole of the valve cover 262 can be improved. This can make the hole diameter of the valve cover 262 smaller, and can make the minimum diameter of the urging member 263 further smaller so that miniaturization of the valve mechanism can be pursued. In addition, even if complication of the valve body 261 applies a force onto the valve cover 262 via the sliding shaft of the valve body 261, the valve cover sealing guide 262*a* can secure rigidity of the valve cover 262.

Moreover, an R section 262*b* is provided on the ridgeline of the hole of the valve cover 262. This R section 262*b* is provided only on the non-sealing surface (rightward in the drawing) in the ridgeline of the hole. This configuration can reduce contact resistance between the sliding shaft of the valve body 261 and the valve cover 262 at the time of the operation of the valve body 261 left complicated, in particular when the valve is closed.

In addition, the end portion being brought into contact with the first valve frame 260*a* party of the valve body 261 is a valve body seal section 265 having plane surface. On the other hand, the portion contacted by the valve seal section 265 of the first valve frame 260*a* is the first frame body seal section 264 made of elastomer 267 provided inside the first valve frame 260*a*. Thus, the valve body 261 and the seal portion of the first valve frame 260*a* are made flat to implement complete contact since the contact radius for the first frame body 260*a* of the R section of the valve body 261 shaped as an elongated circle even if the valve body is brought into contact in a complicated manner. Moreover, the first valve frame seal section 264 is shaped to protrude like a tongue so that the sealing at the time of that contact will be made more certain.

In addition, in the case where a clearance for sliding is provided between the valve body 261 and the second valve frame 26*b* in the valve mechanism in such a configuration, in the installation/removal operation of the ink tank unit 200, as shown in FIG. 9C, the valve body 261 could rotate inside the second valve frame 260*b* with the shaft of the valve body 261 as the center. However, in the practical embodiment hereof, if the valve body 261 rotates around its shaft as the center and is urged to the first valve frame 260*a* under the state with the maximum rotational angle, the valve frame seal section 264 and the valve body seal section 265 will be brought into contact on their surfaces so that the valve mechanism is tightly sealed in a secured manner.

Moreover, the joint port 230 as well as the valve mechanism is shaped as elongated holes so that the rotational angle of the valve body 261 can be limited to a minimum toward sliding of the valve body 261 and response of the valve can be improved, and thus the sealing performance of the valve mechanism of the joint port 230 will become securable. In addition, the joint port 230 as well as the valve mechanism is shaped to be elongated holes so that, in the installation/removal operation of the ink tank unit 200, the protrusion 180*a* for sealing disposed on the side surface of the joint pipe 180 as well the valve body 261 slides swiftly inside the joint port 230 and the stable connection operation is implemented.

Figure 17A:
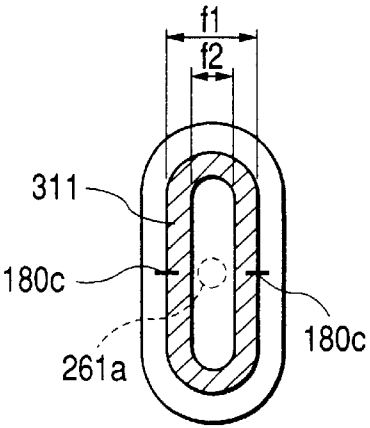
FIGS. 17A, 17B, 17C and 17D are figures for explaining the shape of the engagement with the tip part of the joint pipe of the valve body in the valve mechanism in FIG. 14.
Figure 17B:
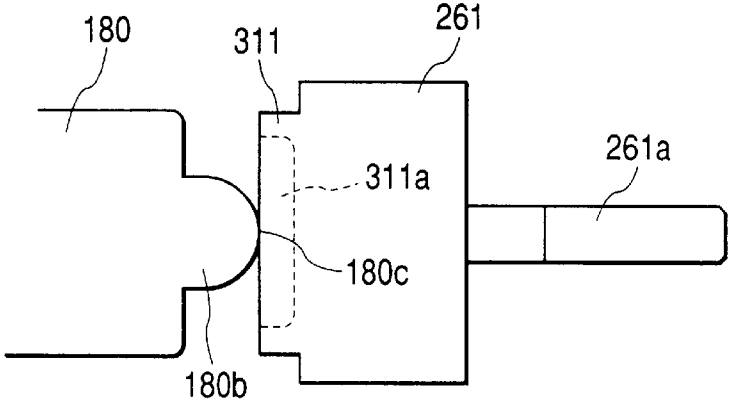
Figure 17C:
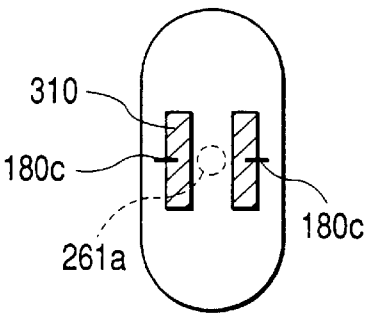
Figure 17D:
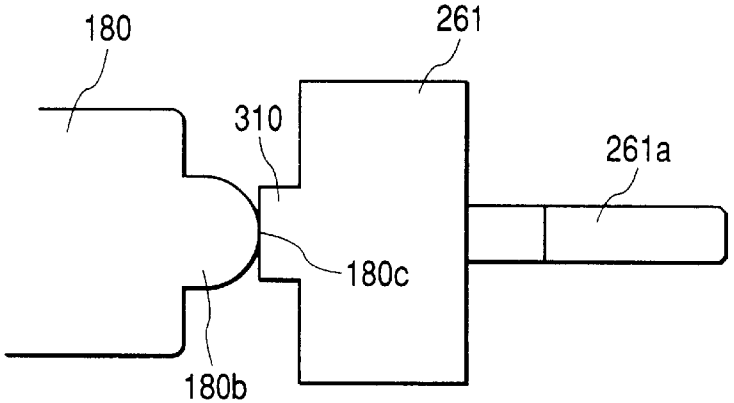

In addition, as shown in FIG. 10, the contacting end sections of the joint pipe 180 with the valve body 261 are two protrusions 180*b* to open/close the valve disposed rightward and leftward in an opposing fashion to form the upper opening 181*a* and lower opening 181*b* for the purpose of air-liquid exchange and liquid supply. For that reason, as shown in FIGS. 17C as well as 17D, two contact ribs 310 corresponding with the protrusions 180*b* are considered to be provided at the spots of the valve body 261 to be brought into contact with the protrusions 180*b* except the valve seal section 265 to tightly sealed with the first frame body seal section 264. However, at the time when the valve opens, the valve body 261 is pushed back against the pushing pressure of the urging member 263, and thus that rib sections are required to have rigidity to a degree that no deformation takes place. In addition, as concerns dispositions and shapes of the contact rib sections, even if positions of the contact rib sections of the valve body 261 against the two protrusions 180*b* to open/close the valve of the joint pipe 180 be shifted around axial periphery of the sliding shaft 261*a* of the valve body 261, the moments applied to the two contact positions are required to set off with the sliding shaft 261*a* as a center from the view point of reliability. Therefore, in the practical embodiment hereof, as shown in FIGS. 17A and 17B, the valve body 261 is provided with a circular rib 311 (for example with the width of 0.6 mm and the height of 1.3 mm) being similar to the joint pipe 180 shaped in an elongated hole. In other words, a recess 311*a* shaped an elongated hole is provided at the center of the valve body 261 being the spot where the valve body seal section 265 tightly sealed with the first frame body seal section 264 is removed. This configuration will provide the valve body 261 with strength and reliability at the time when it is brought into contact with the protrusions 180*b* to open/close the valve. Incidentally, the ribs being shaped circular and the concave section is provided at the center so that the valve body become more effectively moldable. In addition, from this point of view, a tiny curved surface is preferably provided in the region at the side where the concave section of the base end section of the circular rib is formed.

In addition, as shown in FIG. 2 and FIGS. 3A and 3B, the ink tank unit 200 is to be fittingly assembled with the ID member 250 by sealing and engagement after the valve mechanism including the first valve frame 260*a* as well as the second valve frame 260*b* is inserted into the supplying port section of the ink containing container 201. In particular, an inner bag 220 is exposed at the opening periphery surface of the supplying port of the ink containing container 201 and a flange section 268 of the first valve frame 260*a* of the valve mechanism is sealed with this inner bag exposing section 221*a*, and moreover the ID member 250 undergoes sealing at the spot of the flange section 268 and undergoes engagement at the engaging section 210*a* of the tank box body 210.

With such a mode of fitting and assembly, no elastomer 567 will exist inside the supply port hole provided in the ID member 550 in the case where the first valve frame flange 508 to be brought into junction with the ID member 550 as in the comparative embodiment in FIG. 11 for example is flat, and a seal leakage might take place at the time of the connecting operation of the joint pipe 180 as shown in FIGS. 5A and 5B. Under the circumstance, in the practical embodiment hereof, the sealing surface of the ID member 550 of the first valve frame flange section 508, which has existed on the same surface as the opening surface of the joint port 530, is arranged to be recessed to the tank mounting side and the opposite side. That is, as shown in FIG. 2 and FIG. 14, etc., the first valve flange section 268 is disposed so that the external surface of the ID member 250 matches the opening surface of the joint port 230 when the ID member 250 is brought into tight fitting with the first valve flange section 268. According to this configuration, the elastomer 267 certainly exists inside the supplying port hole provided in the ID member 250 so that the valve mechanism will become highly reliable without any possibilities of the above-described seal leakage to take place. In addition, the first frame body flange section 268 is shifted from the opening surface of the joint port 230 so that the opening section of the joint port 230 protrudes from the flange surface of the first frame body flange section 268, and thus at the time when the ID member 250 is fitting assembled the opening section of the joint port 230 guides the position of the ID member 250 so that the positioning can be easily determined.

Moreover, the respective ink containing container 201 of the ink tank unit 200 according to the practical embodiment hereof are installed inside the holder 150 to implement liquid supply toward the respective negative pressure control container 110 via the joint pipe 180 as well as the valve mechanism of the joint port 230 of the container 201. Thus, the holder 150 in which the ink containing container 201 is mounted is as described later installed in the carriage in the case of a recording device of a serial scan type (see FIG. 24) and undergoes reciprocal movement in the direction in parallel along the recording paper. In this case, in order that the seal status between the inner surface of the joint port 230 of the ink containing container 201 and the external surface of the joint pipe 180 of the negative pressure control container 110 may not get worse due to complications in the connecting spots because of vibrations of the shaft of the joint pipe 180 at the time of the reciprocal movement of the carriage or the positional shift of the ink containing container 201, etc., preventive measures in that respect are preferably implemented from the point of view of product reliability.

Therefore, in the practical embodiment hereof, the thickness of the elastomer 267 inside the first valve frame 260*a* of the valve mechanism shown in FIG. 2 and FIG. 14, etc., is made equal to or thicker than the thickness necessary at least to implement only sealing between the first valve frame 260*a* and the joint pipe 180, so that the bending of the elastomer controls the axial shift or complication at the spot of the joint pipe connection at the time of the reciprocal movement of the carriage to secure further highly reliable seal. In addition, as other measures, the rigidity of the valve frame into which the joint pipe 180 is inserted may be made more rigid than the joint pipe 180 so as to control the axial shift or complication at the spot of the joint pipe connection at the time of the reciprocal movement of the carriage to secure further highly reliable seal.

Next, sizes of respective components to realize the above-described valve mechanism will be described with reference to FIG. 10, FIGS. 17A to 17D, and FIG. 25.

Figure 25:
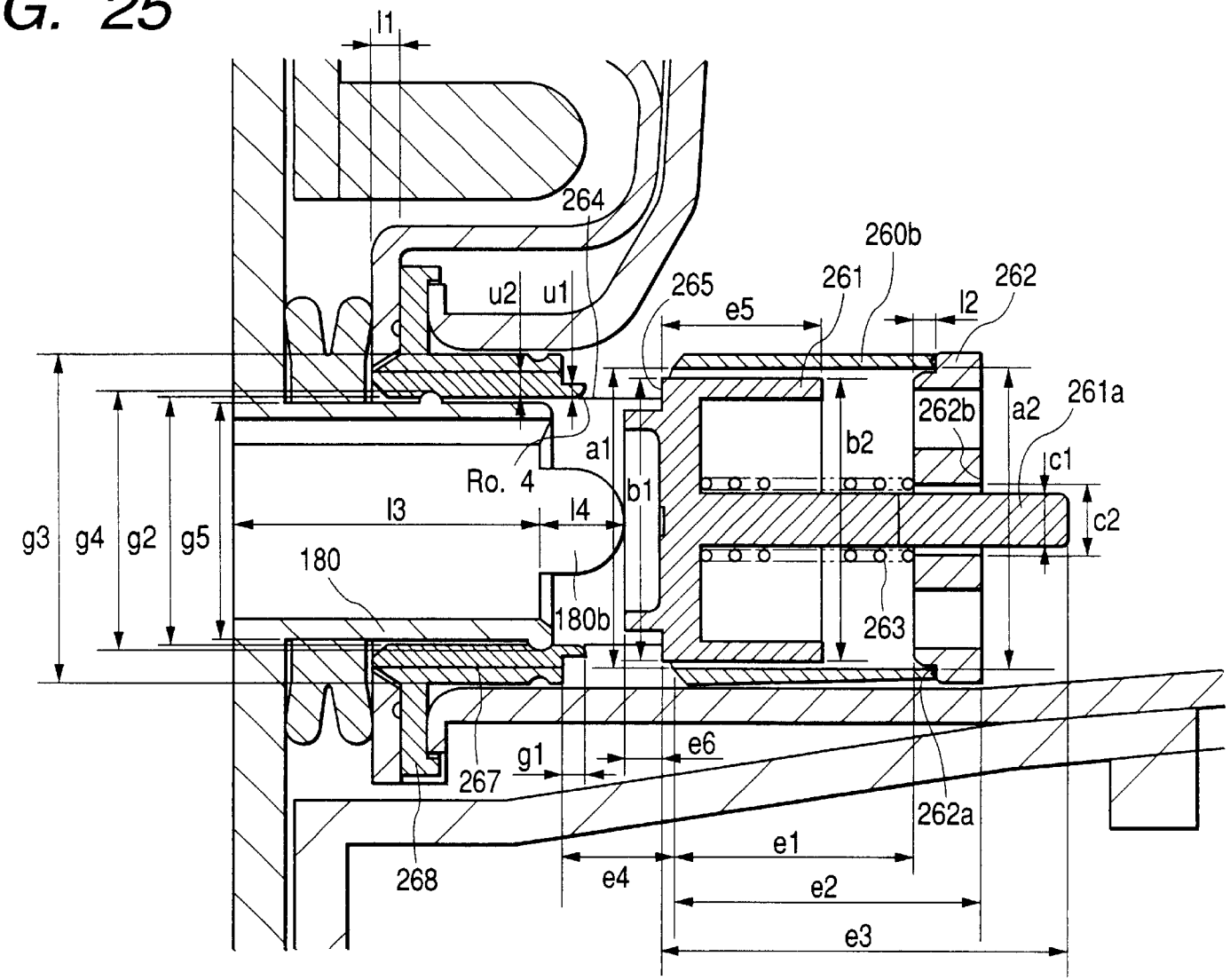
FIG. 25 is a figure for explaining the size of the component at the connecting place of the ink tank unit applicable to the present invention.

In FIG. 25, the length e5 of the vale body 261 in the elongating direction is 5.7 mm, the length e3 from the valve body seal section 265 to the valve body sliding shaft 261*a* is 14.4 mm, the length e1 from the second valve frame 26*b* to the inside surface of the valve cover 262 is 8.7 mm, the length e2 from the second valve frame 26*b* to the external surface of the valve cover 262 is 11.0 mm, the length e4 of the opening section between the first valve frame 260*a* and the second valve frame 26*b* is 3.0 mm, the quantity of protrusion e6 of the rib section from the seal section 265 of the valve body 261 is 1.3 mm, the length 12 of the valve cover sealing guide 262*a* is 0.8 mm, the length b1 of the seal section 265 of the valve body 261 in the elongating direction is 9.7 mm, the length b2 of the valve body 261 in the side of the valve cover 262 in the elongating direction is 9.6 mm, the length a1 of the second valve frame 26*b* in the side of the first valve frame 260*a* in the elongating direction is 10.2 mm, the length a2 of the second valve frame 26*b* in the side of the valve cover 262 in the elongating direction is 10.4 mm, the shaft diameter c1 of the valve body sliding shaft 261*a* is 1.8 mm, the diameter c2 of the hole into which the valve body sliding shaft 261*a* is inserted the valve cover 262 is 2.4 mm, the length of the spring as the urging member 263 is 11.8 mm (the spring constant: 1.016 N/mm), the R section 262*b* of the valve cover 262 is R0.2 mm (the whole round), the length g1 of the first valve frame seal section 264 being a portion of the elastomer 267 is 0.8 mm, the R section of the first valve frame seal section 264 is R0.4 mm, the thickness u1 of the first valve frame seal section 264 is 0.4 mm, the thickness u2 of the elastomer 267 is 0.8 mm, the inner diameter g2 of the elastomer 267 in the elongating direction is 8.4 mm, the external diameter g3 of the first valve frame 260*a* in the elongated direction is 10.1 mm, the external diameter g5 of the joint pipe 180 in the elongated direction is 8.0 mm, the external diameter g4 of the joint pipe 180 including the protrusion 180*a* for sealing in the elongated direction is 8.7 mm, the recess quantity 11 of the first valve frame flange section 268 is 1.0 mm, the length 13 of the joint pipe 180 is 9.4 mm, and the length 14 of the protrusion 180*b* to open/close the valve is 2.5 mm.

The length g1 of the first valve frame seal section 264 is 0.8 mm, but is preferably such a quantity that the first valve frame seal section 264 is bent to go out of the valve frame at the time when it is brought into contact with the seal section valve body seal section 165, and in addition complete sealing can be implemented. For that purposes, the length g1 of the first valve frame seal section 264 had better be within a range to fulfill $(g3-g2)/2>g1>(b1-g2)/2$.

In addition, as sizes for the protrusion 180*b* to open/close the valve of the joint pipe 180 and the rib 311 of the valve body 261 under a relationship of contact as shown in FIG. 10 and FIGS. 17A to 17D, the thickness t of the joint pipe 180 as well as the rib 311 is 0.75 mm, the inner opposing distance f3 of the protrusions 180*b* to open/close the valve is 1.7 mm, the external distance f4 of the protrusions 180*b* to open/close the valve is 3.2 mm, the external distance f1 of the elongated hole-shaped rib 311 of the valve body 261 in the shrinking direction is 2.6 mm, the inner distance f2 of the rib 311 in the shrinking direction is 1.4 mm, and the length d of the rib 311 is 3.6 mm.

In addition, as concern the elastomer 267 inside the first frame body 260*a* in the shape of an elongated hole has preferably its thickness u2 so as to be constant at the circumference shaped as the elongated hole and at the straight line portion from the point of view on accuracy in molding. In addition, in the upward and downward direction of the joint port 230, the quantity of biting due to seal between the elastomer 267 and the portion with the largest diameter of the joint pipe 180 (the spot including the protrusion 180*a* for sealing) is $g4-g2=0.3$ mm, which quantity is absorbed by the elastomer 267. At that time, the substantial thickness for absorption is 0.8 mm×2=1.6 mm, but the above-described biting quantity is 0.3 mm, and thus deformation of the elastomer 267 does not need much force. On the other hand, also in the horizontal direction of the joint port 230, the quantity of biting for sealing is set to be 0.3 mm so that the elastomer 267 with the substantial thickness of 0.8 mm×2=1.6 mm absorbs that quantity of biting. Here, as concerns in the vertical direction, the outer diameter g5 of the joint pipe<the inner diameter g2 of the elastomer in the elongating direction is conditioned and also as concerns in the horizontal direction, $g5<g2$ is conditioned likewise, under status shown in FIG. 25, the elastomer, which is brought into contact only with the protrusion 180*a* for sealing of the joint pipe, can implement smooth insertion as well as certain sealing in the joint portion. Looseness of the ink containing container 201 in the holder 150 in the horizontal direction may be within a range that can be absorbed by the thickness of the elastomer (±0.8 mm in the case of the practical embodiment hereof), and the permissible range of looseness of the practical embodiment hereof is set at ±0.4 mm as maximum. Here, in the case of the practical embodiment hereof, in the case where the quantity of looseness in the horizontal direction (quantity of looseness from the central position) is larger than a half of the absolute value of the difference between the outer diameter g5 of the joint pipe and the inner diameter g2 of the elastomer in the elongating direction (that is, looseness in the horizontal direction in the practical embodiment hereof is not less than ±0.2 mm), the outer wall of the tube other than the protrusion 180*a* for sealing of the joint pipe is brought into contact with the elastomer over a wide range so as to push, and thus elastic force of the elastomer will apply a force for restoration toward the central position.

Adopting sizes described above, such a valve mechanism can be realized that gives rise to the above-described effects.

<Effects in Accordance with the Place where the Valve Mechanism is Disposed>

In addition, in the ink jet head cartridge of the practical embodiment hereof, the valve cover 262 as well as the second valve frame 26*b* in the valve mechanism installed in the joint port 230 of the ink tank unit 200 deeply enters inside the inner bag 220. This will serve to control deformation in the portion in the vicinity of the joint port 230 in the inner bag 220 with the portion deeply inserted into inside the inner bag 220 of the valve mechanism, that is the valve cover 262 or the second valve frame 26*b* even if the portion in the vicinity of the joint port 230 in the inner bag 220 is peeled off from the box body 210 when the inner bag 220 undergoes deformation coinciding with consumption of ink inside the inner bag 220. Thus, deformation in the portion of the inner bag 220 in the vicinity of the valve mechanism and its circumference is controlled with that valve mechanism even if the inner bag 220 undergoes deformation coinciding with consumption of ink so that the flow path of ink around the valve mechanism inside the inner bag 220 as well as the path for bubbles to cope with the uprising bubbles at the time when the air-liquid exchange operation takes place is secured. Therefore, supply of ink from inside the inner bag 220 to the negative pressure control chamber unit 100 as well as uprising movement of the bubbles inside the inner bag 220 will not be prevented at the time when the inner bag 220 is deformed.

As described above, in the ink jet head cartridge comprising the ink tank unit 200 having the deformable inner bag 220 and the negative pressure control chamber unit 100, it is preferable in order to increase the buffer space inside the box body 210 that the negative pressure inside the inner bag 220 is balanced with the negative pressure inside the negative pressure control container 110 so that the ink tank unit 200 and the negative pressure control chamber unit 100 undergo the air-liquid exchange operation subject to as much deformation of the inner bag 220 as possible. In addition, for the purpose of rapid ink supply, the joint port 230 of the ink tank unit 200 had better be made larger. Of course, it is preferable that the region in the vicinity of the joint port 230 inside the inner bag 220 is largely spacious and the path for ink supply in that region is sufficiently secured.

In that way, when the inner bag 220 undergoes substantial deformation in order to secure the buffer space inside the box body 210 to house the inner bag 220, the space in the vicinity of the joint port 230 inside the inner bag 220 will normally become narrower coinciding with deformation of the inner bag 220. In the case where the space in the vicinity of the joint port 230 inside the inner bag 220 becomes narrower, prevention of the upward movement of the bubbles inside the inner bag 20 and shrinkage of the ink supply path in the vicinity of the joint port 230 could take place and consequently rapid ink supply could not be coped with. Accordingly, as in the ink jet head cartridge of the practical embodiment hereof, in the case where the valve mechanism does not deeply enter inside the inner bag 220 and the deformation in the portion surrounding the joint port 230 of the inner bag 220 is not regulated, in order to comply with the rapid ink supply, the quantity of deformation of the inner bag 220 must be limited to the quantity of deformation within a range not influencing the ink supply substantially so that the negative pressure inside the inner bag 220 is balanced with the negative pressure inside the negative pressure control container 110.

In contrast, in the practical embodiment hereof, as described above, the valve mechanism enters the inner bag 220 to a deep degree so that valve mechanism regulates deformation of the inner bag 220 in the portion in the vicinity of the joint port 230. This will enable the region in the vicinity of the joint port 230 inside the inner bag 220, that is the ink supply path communicating with the joint port 230, to be secured sufficiently even if deformation of the inner bag 220 becomes larger so that it will become possible to cope with both security of the large buffer space inside the box body 210 and ink supply of a rapid flow.

In addition, an electrode 270 to be used as the remaining ink detection means to detect the remaining quantity of ink inside the inner bag 220 as described later is disposed downward the bottom of the ink tank unit 200 in the above-described ink jet head cartridge. The electrode 270 is fixed on the carriage of the printer in which the holder 150 is installed. Here, the joint port 230 where the valve mechanism is installed is provided at a lower portion of the front end surface being the negative pressure control chamber unit 100 party of the ink tank 200 and the valve mechanism is deeply inserted into inside the inner bag 220 in the approximately parallel direction along the bottom surface of the ink tank unit 200 so that deformation of the bottom portion of the inner bag 220 is regulated with the deeply inserted portion of the valve mechanism at the time when the inner bag 220 is deformed. Moreover, a portion of the bottom section of the ink containing container 201 comprising the box body 210 as well as the inner bag 220 is inclined so that the deformation of the bottom portion of the inner bag 220 is regulated at the time when the inner bag 220 is deformed. In addition to an advantage that such inclination in the bottom portion of the ink containing container 201 regulates the deformation of the inner bag 220 in the bottom portion, the deformation of the inner bag 220 in the bottom portion is further regulated by the valve mechanism so that movement of the bottom portion of the inner bag 220 toward the electrode 270 is regulated and further accurate detection of the ink remaining quantity becomes possible. Accordingly, as described above, the deformation in the portion in the vicinity of the joint port 230 of the inner bag 220, which is regulated by the valve mechanism, copes with both security of the large buffer space inside the box body 210 by way of enlarging the deformation of the inner bag 220 and ink supply of rapid flow, and moreover, a liquid supplying system enabling further accurate detection of ink remaining quantity can be obtained.

In the practical embodiment hereof, as described above, the valve mechanism is caused to enter deeply inside the inner bag 220 so that the deformation in the portion in the vicinity of the joint port 230 is regulated, but another member different from the valve mechanism may be caused to enter inside the inner bag 220 so that the deformation of that portion of the inner bag 220 is regulated. In addition, a plate member, etc., may be caused to enter inside the inner bag 220 from the joint port 230 so that the deformation in the portion in the vicinity of the electrode 270 in the bottom portion of the inner bag 220 is prevented and that plate member may be extended along the bottom surface inside the inner bag 220. This makes it possible to implement further accurate detection on the ink remaining quantity when the remaining quantity of ink inside the inner bag 220 is detected using the electrode 270.

Moreover, in the practical embodiment hereof, in the valve mechanism installed in the joint port 230, the configuring component of that valve mechanism enters deeply the inner bag 220 further than to the opening 260*c* being the ink flow path communication with the joint port 230. This serves to give rise to such a configuration that the ink tank unit 200 can certainly secure the ink flow path in the vicinity of the joint port 230 inside the inner bag 220.

<Production Method of the Ink Tank>

Figure 18C:
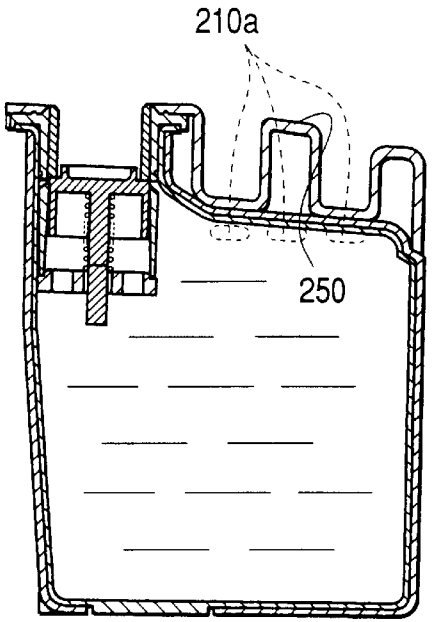
FIGS. 18A, 18B, and 18C are figures for explaining the manufacturing method of an ink tank applicable to the present invention.

Next, the production method of the ink tank of the mode hereof will be described based on FIGS. 18A to 18C. At first, as shown in FIG. 18A, the inner bag exposed portion 221*a* of the ink containing container 201 is directed upward against the direction of the gravity, and the ink 401 is injected into the ink containing container 201 from the ink supplying opening with the ink injection nozzle 402. The configuration of the present invention enables injection of ink under atmospheric pressure.

Figure 18B:
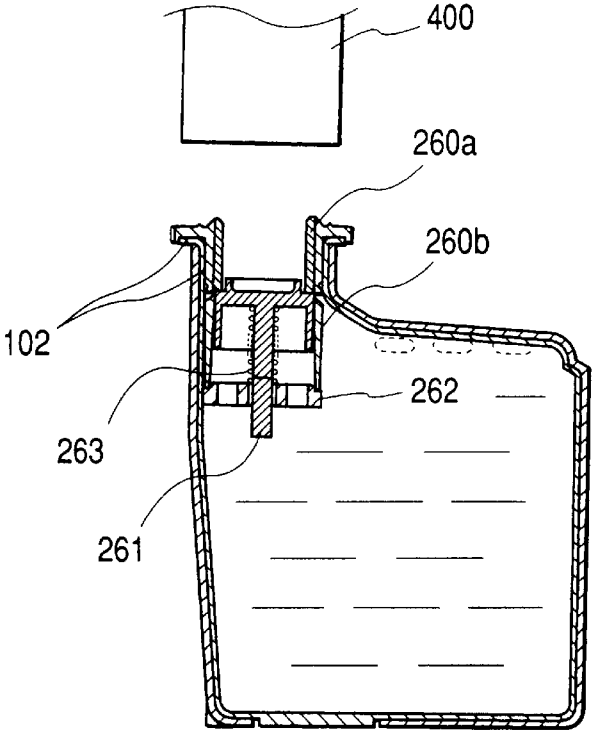
Figure 18A:
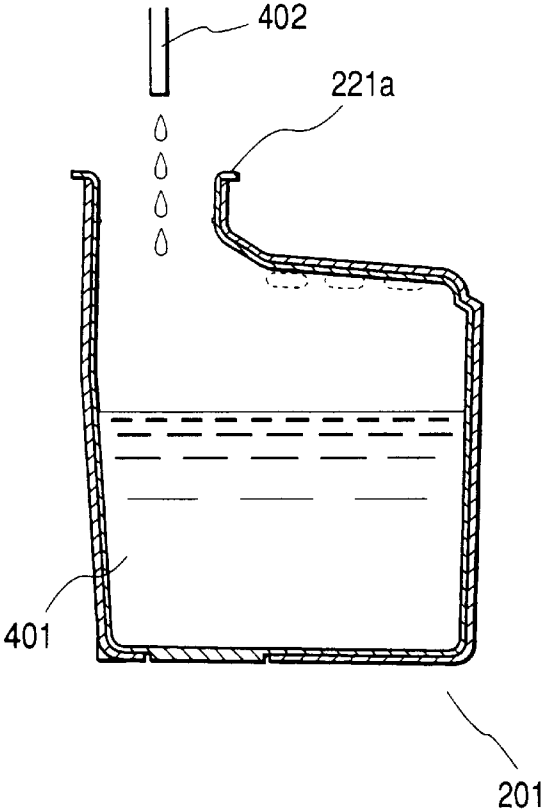

Next, as shown in FIG. 18B, the valve body 261, the valve cover 262, the urging member 263, the first valve frame 260*a*, and the second valve frame 26*b* are assembled in advance into a valve unit and this valve unit is dropped into the supply port portion of the ink containing container 201.

At that time, the outer periphery of the seal surface 102 of the ink containing container 201 is surrounded by the step shape in the outside portion of the sealing surface of the first valve frame 260*a* so that the positions of the ink containing container 201 and the first valve frame 260*a* and it becomes possible to enhance accuracy in positioning. In addition, the sealing horn 400 is applied to the outer periphery of the joint port 230 of the first valve frame 260*a* from upward, and the first valve frame 260*a* and the inner bag 220 of the ink containing container 201 are sealed on the seal surface 102, and at the same time, such sealing becomes possible that the first valve frame 260*a* and the box body 210 of the ink containing container 201 are certainly sealed in the outer periphery of the seal surface 102. Incidentally, the present invention is applicable to ultrasonic sealing as well as vibration sealing. In addition, it is applicable to thermal sealing and adhesives, etc. as well.

Next, as shown in FIG. 18C, the ink containing container 201 sealed with the first valve frame 260*a* is covered with the ID member 250. At that time, the engaging portion 210*a* to be formed in the side party of the box body of the ink containing container 201 and the click portion 250*a* of the ID member 250 are brought into engagement, and at the same time, the click portion 250*a* in the lower surface party of the ID member 250 brings the box body 210 located in the opposing direction of the seal surface 102 of the ink containing container 201 into engagement in such a manner that the first valve frame 260*a* are sandwiched (see FIGS. 3A and 3B).

<Detection of Quantity of Remaining Ink Inside the Tank>

Next, detection of the quantity of remaining ink inside the ink tank unit will be described.

As shown in FIG. 2, downward under the region of the holder 150 where the ink tank unit 200 is installed, a plate-like electrode 270 having width narrower than the width of the ink containing container 201 (in the direction of the depth in the drawing) is provided. This electrode 270 is fixed in the carriage (not shown) of the printer in which the holder 150 is installed, and is connected with the electric control system of the printer via the wiring 271.

On the other hand, the ink jet head unit 160 comprises an ink flow path 162 communicating with the ink supply tube 165, nozzles (not shown) respectively comprising energy generating elements (not shown) generating energy for ejecting the ink, and a common liquid room 164 to hold the ink supplied by the ink flow path 162 temporally and supply each nozzle with it. The energy generating element is connected with the connection terminal 281 provided in the holder 150, and the holder 150 is mounted on the carriage so that the connection terminal 281 is brought into connection with the electric control system of the printer. The recording signals from the printer are sent to the energy generating element via the connection terminal 281 to drive the energy generating element so that the ejecting energy is given to the ink inside the nozzle so that the ink is ejected from the spilling-outlet being the opening tip of the nozzle.

In addition, inside the common liquid room 164, an electrode 290, which is brought into connection with the electric control system of the printer likewise via the connection terminal 281, is provided. These two electrodes 270 and 290 configure the ink remaining quantity detecting means inside the ink containing container 201.

Incidentally, in the practical embodiment hereof, in order that detection of the quantity of the remaining ink by such means to detect the quantity of the remaining ink can be implemented more precisely, the joint port 230 of the ink tank unit 200 is provided in the lowest end of the surface sandwiched by the surfaces with maximum area of the ink containing container 201 as shown in FIG. 2 under the state of use. In addition, a part of the bottom surface of the ink supplying container 201 is caused to be inclined against the horizontal surface under the state of use. In particular, with the front end being the end at the side where the joint port 230 of the ink tank unit 200 is provided and the rear end being the opposite side of it, the vicinity of the front end portion in which the valve mechanism is provided is made to be a surface in parallel with the horizontal surface, and the region from there to the rear end is made to be a inclined surface uprising in the direction from the front end to the rear end. Considering the later described deformation of the inner bag 220, this inclination angle of the bottom surface of the ink containing container 201, an angle constituting with the rear end surface of the ink tank unit 200 is preferably an obtuse angel, and is set to be not less than 95 degrees in the practical embodiment hereof.

In addition, matching the shape of the bottom surface of such an ink containing container 201, the electrode 270 is disposed in a position opposing the inclined region of the bottom surface of the ink containing container 201 so as to be positioned in parallel with this inclined region.

The detection of the quantity of remaining ink inside the ink containing container 201 by means of this detection means on the quantity of remaining ink will be described as follows.

Detection of the quantity of remaining ink is implemented by applying pulse voltages between the electrode 270 at the holder 150 party and the electrode 290 inside the common liquid room 164 and detecting capacitance (electrostatic capacity) varying in accordance with the opposing area of the electrode 270 against the ink then. For example, the rectangular wave pulse voltage of the pulse frequency of 1 kHz with the peak value of 5V is applied between the both electrodes 270 and 290, and the time constant as well as the gain of that circuit undergoes arithmetic processing so that the existence of the ink inside the ink containing container 201 can be detected.

As the quantity of remaining ink inside the ink containing container 201 decreases due to consumption of ink, the ink liquid surface goes down toward the bottom surface of the ink containing container 201. As the quantity of remaining ink further decreases, the ink liquid surface reaches the inclined region of the bottom surface of the ink containing container 201 so that, coinciding with consumption of ink, the opposing area between the electrode 270 and the ink gradually gets smaller (with approximately constant distance between the electrode 270 and the ink) and the capacitance begins to be reduced.

In the end, no ink will exist in the region opposing the electrode 270 so that decrease of gain as well as increase in electric resistant due to the ink can be detected by changing the pulse width of the pulse to be applied and changing the pulse frequency to calculating the time constant, and with this it is judged that the ink inside the ink containing container 201 is very little.

The above is an outline on detection of the quantity of remaining ink, but actually, the ink containing container 201 of the practical embodiment hereof comprises the inner bag 220 and the box body 210, and together with the ink consumption, the air-liquid exchange between the negative pressure control container 110 and the ink containing container 201 so as to keep balance between the negative pressure inside the negative pressure control container 110 and the negative pressure inside the ink containing container 201 and introduction of the air into between the box body 210 and the inner bag 220 via the atmosphere communicating port 222 are implemented while the inner bag 220 is deformed inward in the direction that its inner volume decreases.

At the time of this deformation, as show in FIG. 6, the inner bag 220 is deformed undergoing regulation with the corner section of the ink containing container 201. Deformation of the inner bag 220, that is, exfoliation or separation from the box body 210, is the largest with the two surfaces being the surfaces with the largest area (approximately in parallel with the sectional surface shown in FIG. 6), and is the smallest with the bottom surface being the surface adjacent to that surface. Nevertheless, coinciding with deformation of the inner bag 220, the distance between the ink and the electrode 270 gets bigger, and the capacitance gets smaller in inverse proportion to that distance. However, in the practical embodiment hereof, the main region of the electrode 270 is on the surface approximately perpendicular with the direction of deformation of the inner bag 220, and even if the inner bag 220 is deformed, the electrode 270 and the region in the vicinity of the bottom portion of the inner bag 220 are kept approximately in parallel each other. Consequently, the area forming capacitance is secured so that certain detection becomes possible. In addition, as described above, in the practical embodiment hereof, the angle of the corner section made by the bottom surface of the ink containing container 201 and the rear end surface constitutes an obtuse angle not less than 95 degrees so that, compared with other corner sections, the inner bag 220 is easily separated from the box body 210. Consequently, the practical embodiment hereof is configured so that the ink is easily discharged toward the joint port 230 also when the inner bag 220 is deformed toward the joint port 230.

So far, configurations of the practical embodiment hereof have been described individually, but they can be appropriately combined, and further advantages can be given rise to by implementing combination.

For example, the joint section undergoes combination of the configuration of elongated circle with the above-described valve configuration so that sliding at the time of installation/removal is stabilized and also, as concerns opening/closing of the valve, further certain opening/closing will become possible. In addition, taking the shape of the elongated circle, the quantity of ink supply can be certainly improved. At that time, the fulcrum of rotational mount is shifted upward, but with the bottom surface of the ink tank being inclined toward upward, installation/removal operation, which is with less complication and stable, will become possible.

As described so far, the above-described configurations of the practical embodiment hereof are configurations, which were not present conventionally, respectively and individually give rise to advantageous effect, and with each configuration requirement in a compound fashion give rise to organic configurations. That is, each of the above-described configurations is an excellent invention individually and in a compound manner.

<Ink jet Head Cartridge>

Figure 23:
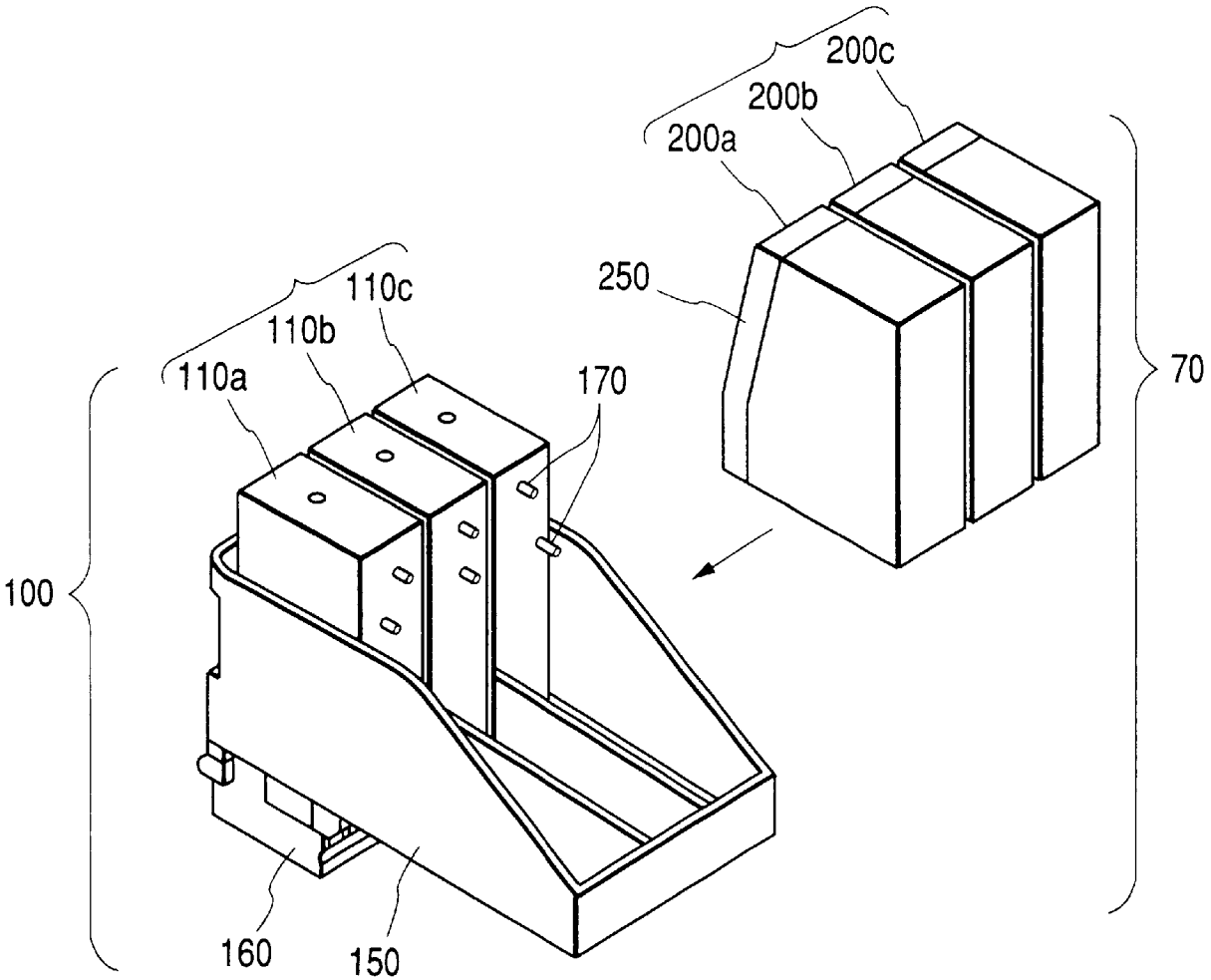
FIG. 23 is a rough explanation figure of the ink jet head cartridge using the ink tank unit applicable to the present invention.

FIG. 23 is a schematic view of an ink jet head cartridge using the ink tank unit applicable to the present invention.

The ink jet head cartridge 70 of the mode shown in FIG. 23 comprises the negative pressure control chamber unit 100 integrating the negative pressure control containers 110*a,* 110*b,* and 110*c* respectively containing a plurality of kinds of liquid (three colors of yellow (Y), magenta (M), and cyanogens (C) for the practical embodiment hereof) which respective liquids can be ejected by the ink jet head unit 160, and for this negative pressure control chamber unit 100, the ink tank units 200*a,* 200*b,* and 200*c* containing respective liquids can undergo installation/removal each other.

In the practical embodiment hereof, in order that the ink tank units 200*a,* 200*b,* and 200*c* are respectively installed in the corresponding negative pressure control containers 110*a,* 110*b,* and 110*c* without any mistake, and a holder 150 covering a part of the external surface of the ink tank unit 200 is provided, an ID member 250 having recess in the front surface in the direction that the ink tank unit 200 is installed is provided, and a convex ID member 170 corresponding to the recess of the ID member 250 is provided to the negative pressure control container 110 so as to be configured to certainly prevent miss-installation.

In the present invention, it goes without saying that the kinds of liquids to be contained may be other than Y, M, and C, and also it goes without saying that the number as well as combination of the liquids to be contained (for example, black (Bk) only to be in an individual tank, and other Y, M, and C to be in an integrated tank) may be optional.

<Recording Device>

Next, an example of the ink jet recoding device in which the above-described ink tank unit or ink jet head cartridge can be installed will be described using FIG. 24.

Figure 24:
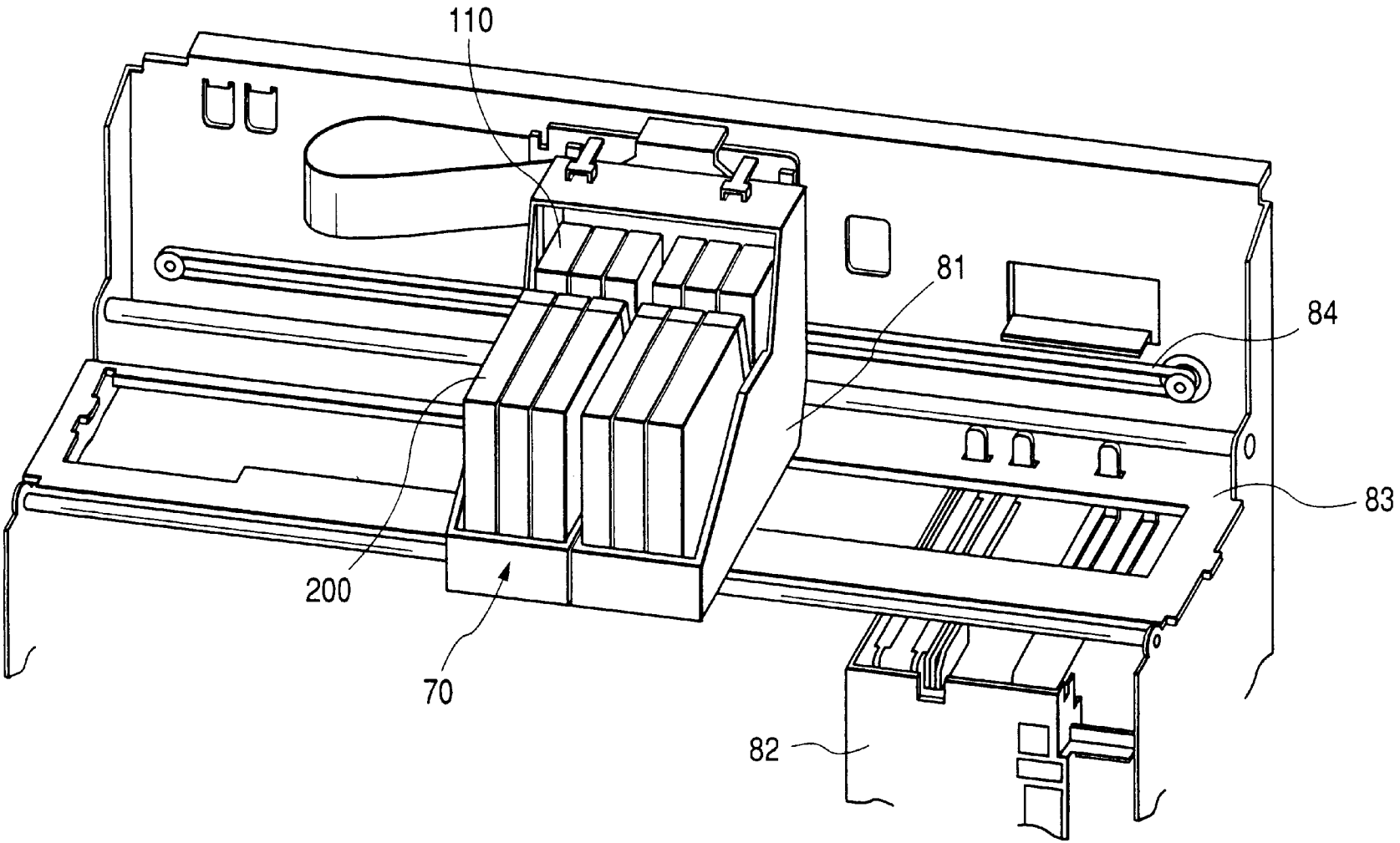
FIG. 24 is a figure showing the rough configuration of a recording device to which the ink jet head cartridge of the present invention is applicable.

The recording device shown in FIG. 24 comprises a carriage 81 in which the ink tank unit 200 as well as the ink jet head cartridge 70 can be installed in an installable/removable fashion, a head restoration unit 82 in which a head cap to prevent the ink from ports of the head from drying and an absorption pump to absorb the ink from the ports at the time of the head's malfunction are integrated, and a paper feeding surface 83 on which the recording paper as the media to be recorded.

The carriage 81, which has its home position upon the position of the restoration unit 82, has its belt 84 to be driven by a motor, etc., so as to be scanned leftward in the drawing. During this scanning, the ink is ejected from the head toward the recording paper conveyed onto the paper feeding surface (platen) 83 so that printing is implemented.

Incidentally, the valve mechanism of the present invention, which is exploitable most suitably in the above-described liquid containing container, is not limited to this mode as the shape of the liquid containing container, but is applicable to other containers, which houses the liquid directly at the supply port section.

Next, a storage container of the ink jet head cartridge of the present invention as well as storage methods will be described.

Figure 26:
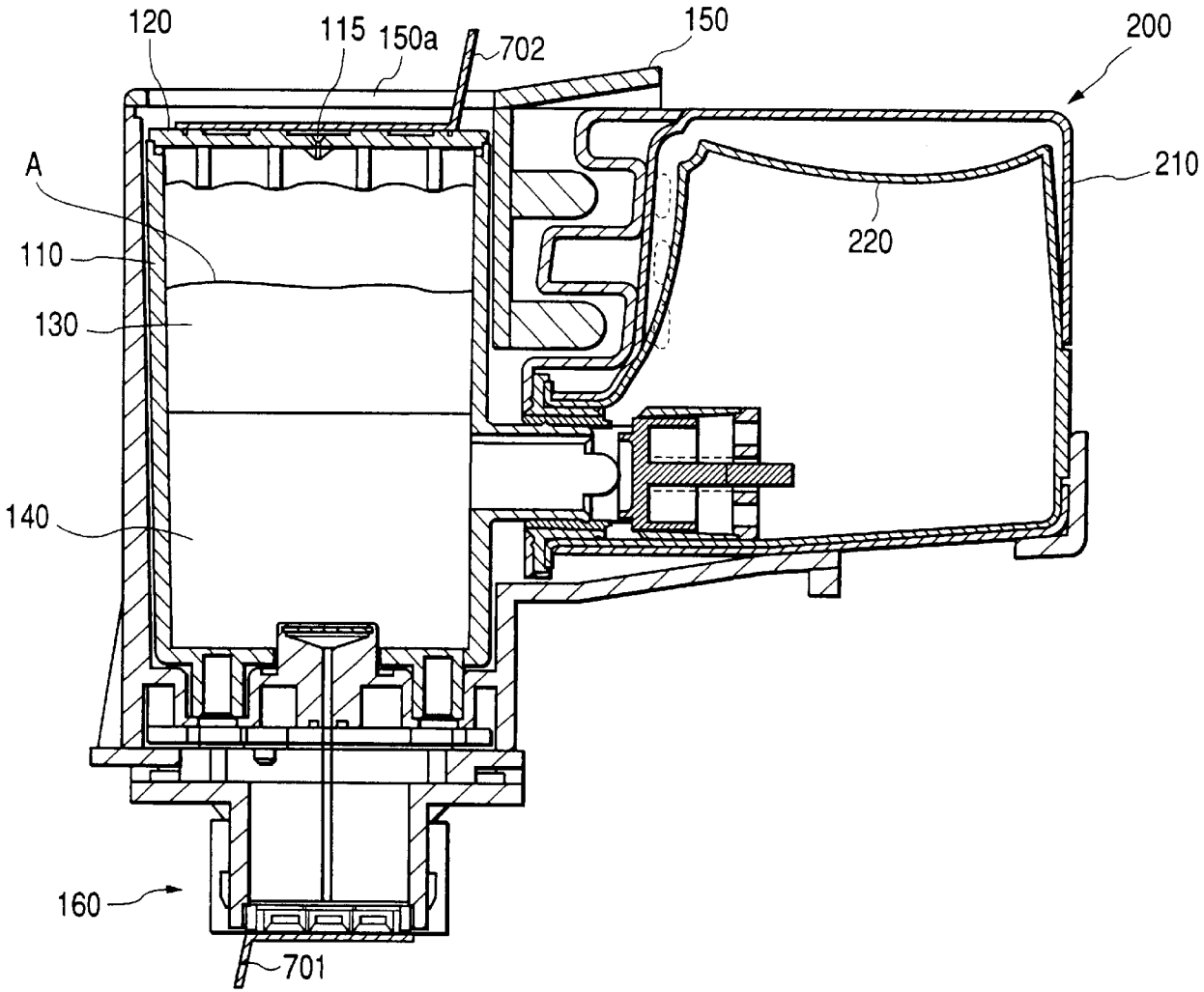
FIG. 26 is a cross sectional view showing an unused ink jet head cartridge contained in a storing container.

FIG. 26 is a sectional view showing the ink jet head cartridge housed inside the storage container prior to its use. However, the storage container is not shown in FIG. 26. As shown in FIG. 26, a face seal member 701 being a first seal member is attached on the nozzle surface of the ink jet head cartridge so that evaporation of the ink from the ejection port of the nozzle or ink leakage based on shocks or environmental changes, etc., will not take place. In addition, attached onto the vacuum control room cover 120 is an atmosphere communication port seal member 702 being the second seal member preventing flow-out of the ink so that the ink inside the negative pressure control container 120 will not be leaked outside from the air communication port 115 due to shocks or environmental changes, etc., and preventing evaporation of the ink so that evaporation of the ink inside during long-term storage will not change the material characteristics or quality of the ink. These seal members are removed when the use of the ink jet head cartridge starts. When the seal members are removed, it is preferable that they are removed from the atmosphere communication seal members 702 which do not remain in direct contact with the ink. In addition, an opening 150*a* is provided in the portion opposing the vacuum control room cover 120 of the holder 150 in order to remove the atmosphere communication port seal member 702.

Incidentally, the atmosphere communication port seal member 702 is integrally provided on the rear surface of the later-described cover member 703 so that the atmosphere communication port seal member 702 is peeled off. Consequently, the order of unsealing of the seal member is automatically stipulated so that unsealing of the seal member in the wrong order is prevented and steps to remove the seal member separately can be reduced.

Figure 27:
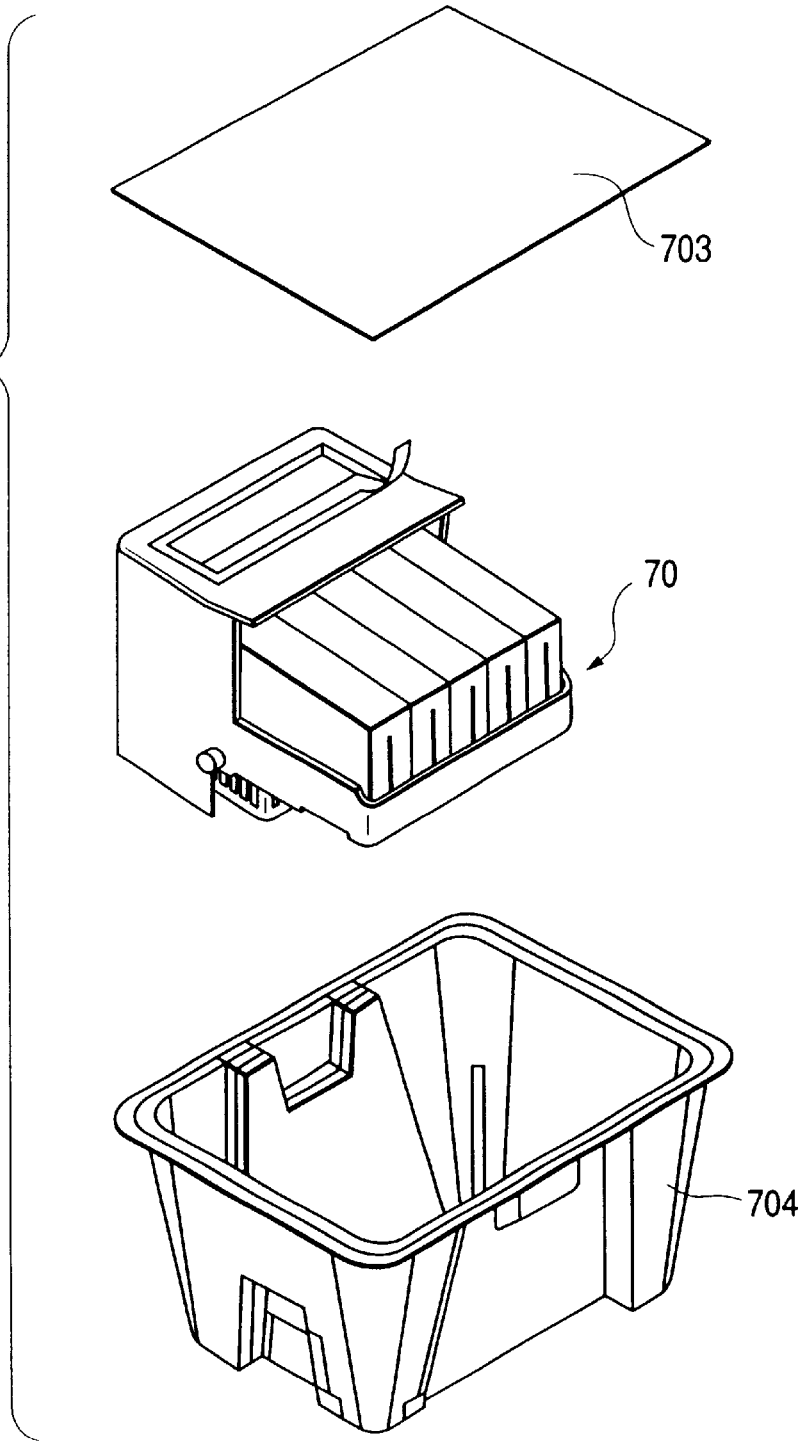
FIG. 27 is an exploded perspective view showing the packaging form at the time of physical distribution of the ink jet head cartridge.

FIG. 27 is an exploded perspective view showing the ink jet head cartridge of a packing mode at the time of distribution.

As shown in FIG. 27, the ink jet head cartridge is housed inside the storage container 704, and moreover the upper surface of the storage container 704 is covered with the cover member 703. This will protect the ink jet head cartridge against shocks applied during distribution, and prevent evaporation of the ink. In the practical embodiment hereof, the storage container 704 contains PP (polypropylene) resin and the cover member 703 contains PET (polyethylene terephthalate) resin as their main components and are formed of compound films. Incidentally, thickness of the storage container 704 is approximately 1 mm. Therefore, the storage container 704 is deformable so that increase in the inner pressure can increase the inner volume, which will give rise to an advantage that pressurization is decreased.

Incidentally, for example in the case where pigment ink is used, under the packed state, installation of a tank for storage which contains clear ink in stead of installation of the ink tank which contains the pigment ink can solve a problem that the pigments are firmly fixed while it is left in vain. In this case, when the ink jet head cartridge is mounted on the recording device for use, the storage tank containing the clear ink is replaced with the ink tank containing pigment ink and the restoration process is implemented until the vacuum generating member containing room is filled with the pigment ink. Incidentally, as the ink that the storage tank contains, other than the above-described ink in the line of clear ink, ink in the line of dye ink that is different from the line of the pigment ink may be used.

Here, methods when to use the ink jet head cartridge housed in the storage container will be described.

At first, the cover member 703 of the storage container of the present invention under the above-described packed state is peeled off from the storage container 704 so that the ink jet head cartridge 70 integrated with the ink tank is taken out from inside the storage container 704.

Next, the seal member 702 attached on the atmosphere communication port 115 of the vacuum generating member containing room of the ink jet head cartridge 70 is taken off, and thereafter the seal member 701 sealing the nozzle surface is taken off. The ink jet head cartridge 70 under this state is installed in the carriage inside the not shown printer. Here, in the case where the storage tank of the ink jet head cartridge is an ink tank containing clear ink as described above, all the storage tanks are taken off from the ink jet head cartridge, and an ink tank filled with pigment ink, etc., which, however, is configured the same as the above described storage tank on the market for sale separately as component, is installed in the ink jet head cartridge to implement recording.

According to the practical embodiment hereof, the vacuum generating member containing room 110 and the ink tank 200 are stored under being brought into connection so that the communicating section between the vacuum generating member containing room 110 and the ink tank 200 does not require any seal member to be attached, and thus the quantity of wrapping material does not increase. Moreover, the ink tank 200 is equipped in advance under packaged-storage state so that it does not take time to take the ink jet head cartridge out from the storage container through to install it in the recording device for use. Moreover, storing it under the state that the liquid supply rout reaching the recording head is filled with the ink, ink supply can be stabilized from the beginning of use.

Figure 28:
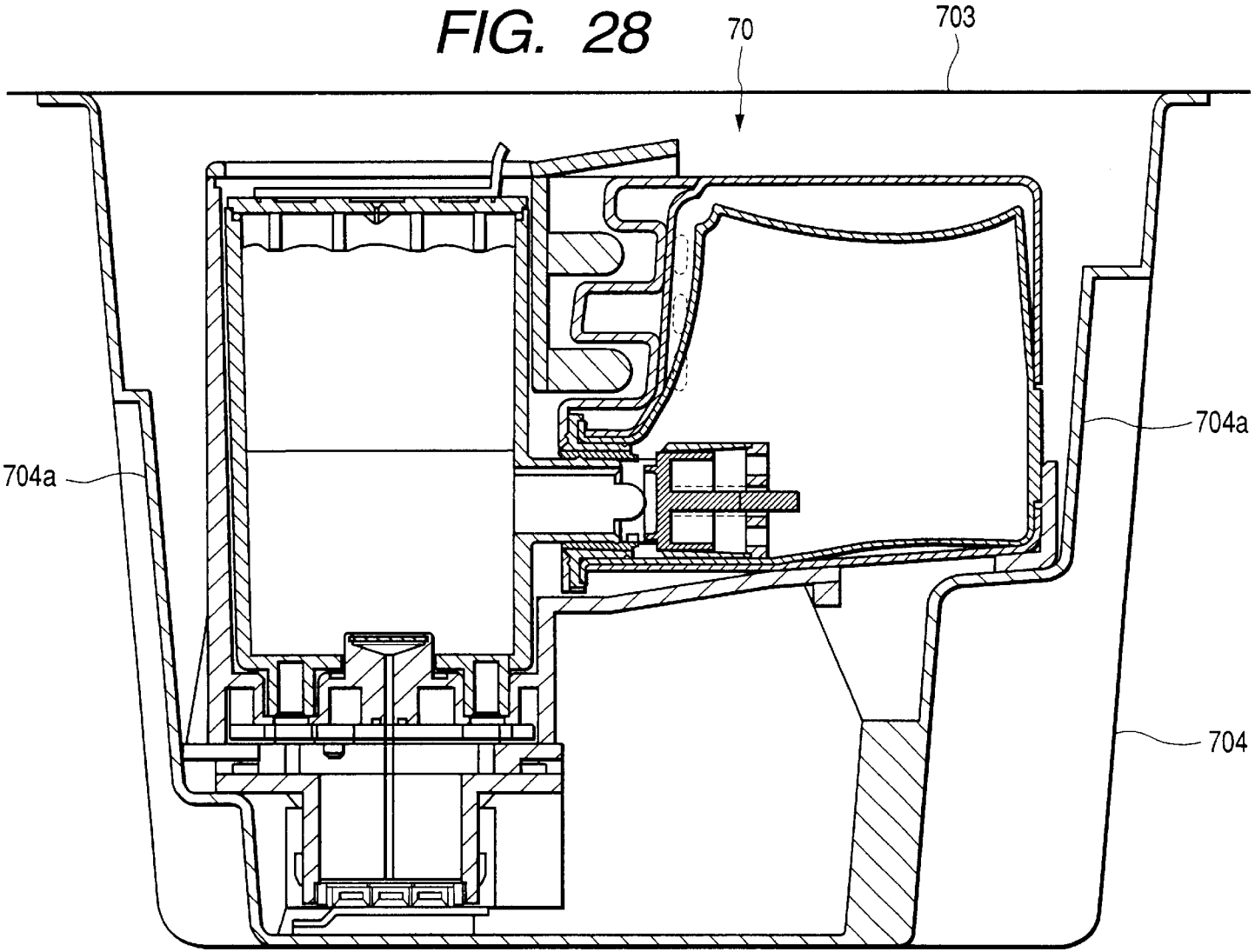
FIG. 28 is a cross sectional view showing the ink jet head cartridge in the state of being packaged in the storing container.

FIG. 28 is a sectional view showing the ink jet head cartridge in the state that it is packaged inside the storage container.

The ink jet head cartridge 70 packed inside the storage container 704 is supported and fixed by the rib 704*a* formed inside the storage container 704. Consequently, even if shocks take place during transportation, etc., the ink jet head cartridge 70 will not be damaged inside the storage container 704.

Here, again with reference to FIG. 26, the absorption bodies 130 and 140 of the vacuum control room are filled with ink, and the ink flow path from the head unit 160 to the ink tank unit 200 is secured. An air region that is not filled with ink exists above the vacuum control room.

The ink tank unit 200 is brought into connection with the holder 150 and the vacuum control room under the state that the inner bag 220 is deformed to have its inner volume to be reduced compared with that of the box body 210. Therefore, the ink tank unit 200 has an inflation margin for the inner bag 220 between the box body 210 and the inner bag 220.

Figure 29:
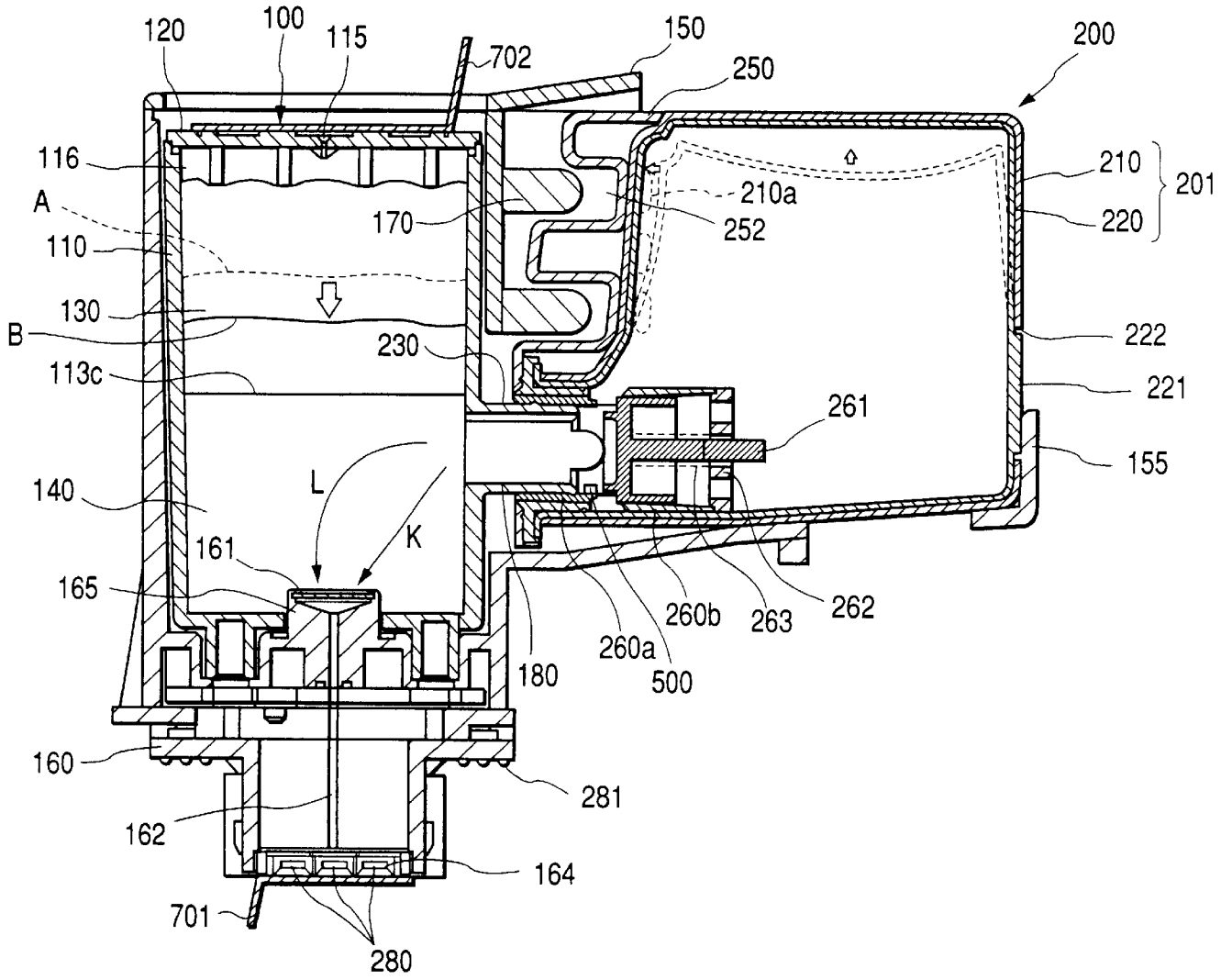
FIG. 29 is a figure showing the state of the ink jet head cartridge when the air in the air area at the upper part of the negative pressure control chamber is expanded.

In the case where the ink jet head cartridge is set at the state shown in FIG. 26 as the normal state, environmental changes, for example changes in the atmospheric pressure (decompressed environment due to the highland transportation) and temperature changes (hot environment due to transportation in a hot area, such as a desert, etc) cause the air in the air region above the vacuum control room to expand to give rise to the state of the ink jet head cartridge as shown in FIG. 29.

As shown in FIG. 29, when the air in the air region above the vacuum control room expands, the ink interface is pushed down from the interface A to the interface B. Then, a portion of the ink filling the vacuum control room flows into inside the inner bag 220 of the ink tank, the inner bag 220 inflates itself to absorb the ink equivalent to the volume due to expansion of the air. This can prevent a big increase in the inner pressure inside the ink tank due to environmental changes.

Figure 30:
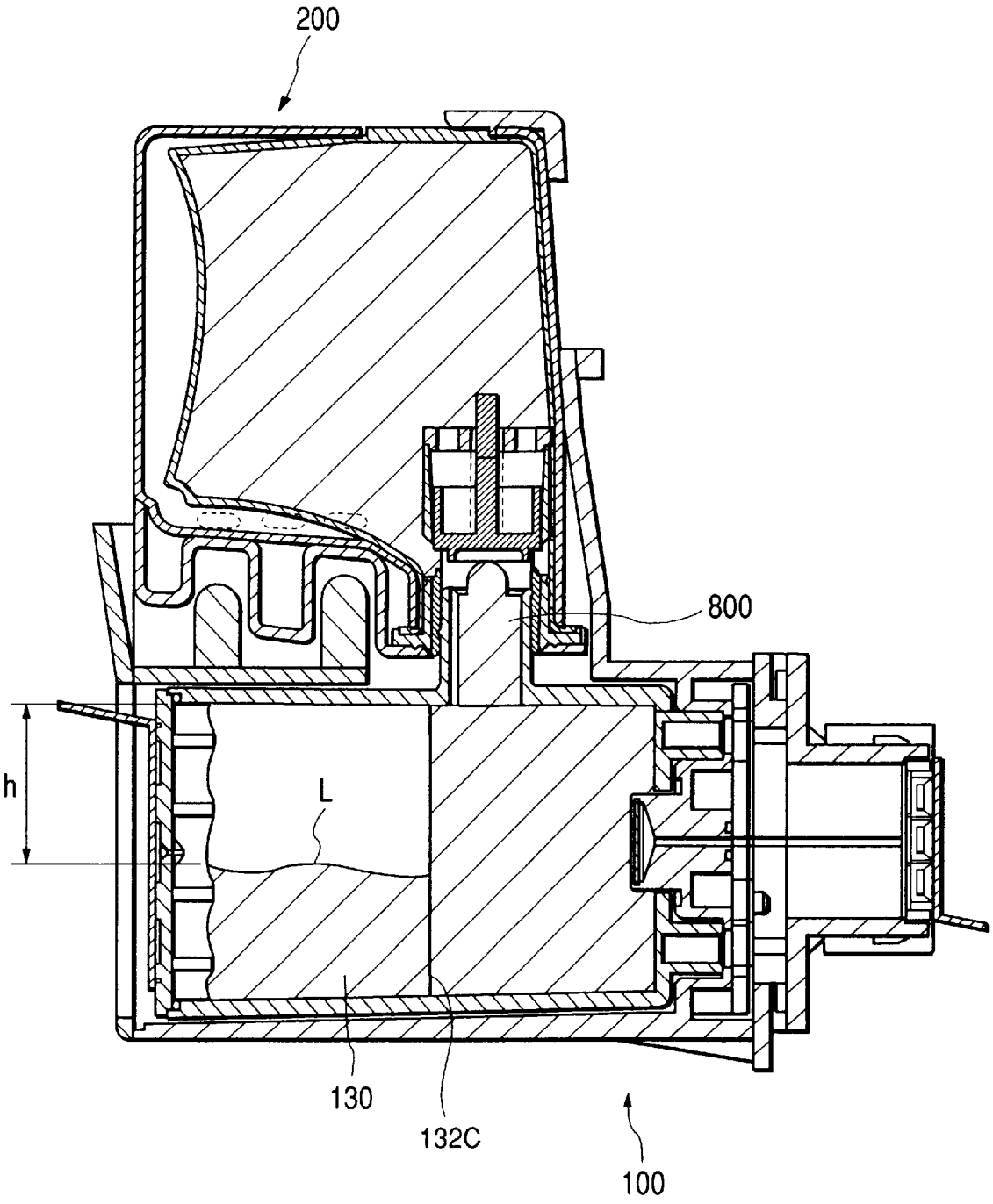
FIG. 30 is a cross sectional view showing the ink jet head cartridge in the state where the ink tank is arranged vertically above the negative pressure control chamber.

FIG. 30 is a sectional view showing the ink jet head cartridge under the state where the ink tank is disposed upward in the vertical direction in the vacuum control room, which state could take place at the time of distribution for example, etc. When the ink jet head cartridge is left as it is with such a posture, the ink inside the vacuum generating member moves from the party with lower capillary force to the party with higher capillary force so as to give rise to a head difference h between the head of the interface L separating the ink from the atmosphere and the head of the ink included in the vacuum generating member boundary layer 132C. Here, with the capillary force of the vacuum generating member 130 being P2 and with the capillary force of the vacuum generating member boundary layer 132C being Ps, in the case where this head difference h is greater than the capillary force difference between P2 and Ps, the ink included in the boundary surface 132C tries to flow into the second vacuum generating member 130 until this head difference h gets equal to the capillary force difference between P2 and Ps.

However, the ink tank of the practical embodiment hereof, the head difference h is smaller than (or equal to) the capillary force difference between P2 and Ps so that the ink included in the boundary surface 132C is held and the quantity of the ink contained in the second vacuum generating member 130 will not increase.

For other postures, the difference between the head of the ink-atmosphere boundary surface L and the head of the ink included in the vacuum generating member boundary surface 132C will become further smaller than the capillary force difference between P2 and Ps, the boundary surface 132C is ready to maintain the state having the ink over its whole area despite its posture. Consequently, in any posture, the boundary surface 132C functions as the air introduction obstructing means to obstruct the air not to enter the liquid containing room from the communication section 800 in association with the partition wall and the ink contained in the vacuum generating member containing room so that the ink is leaked out from the vacuum generating member.

In addition, as described above, the capillary force Ps of the vacuum generating member boundary surface 132C is greater than the capillary force P2 of the second vacuum generating member 130, and thus when the movement of the ink takes place from the vacuum control room 100 to inside the inner bag 220 of the ink tank 200 as shown in FIG. 29, the decrease in the ink interface within the vacuum generating member is once put under control at the boundary surface 132C. In addition, likewise when the movement of the ink from inside the inner bag 220 of the ink tank 200 to the vacuum control room 100 takes place, the ink interface within the vacuum generating member is once put under control at the boundary surface 132C. Therefore, the buffer space can be exploited efficiently, and dispersion of the ink interface within the vacuum generating member can be controlled so that the stable ink supply will become possible when the ink jet head cartridge is used.

(Second Practical Embodiment)

A second practical embodiment of the ink tank of the present invention will be described with reference to FIG. 31 and FIG. 32.

Figure 31:
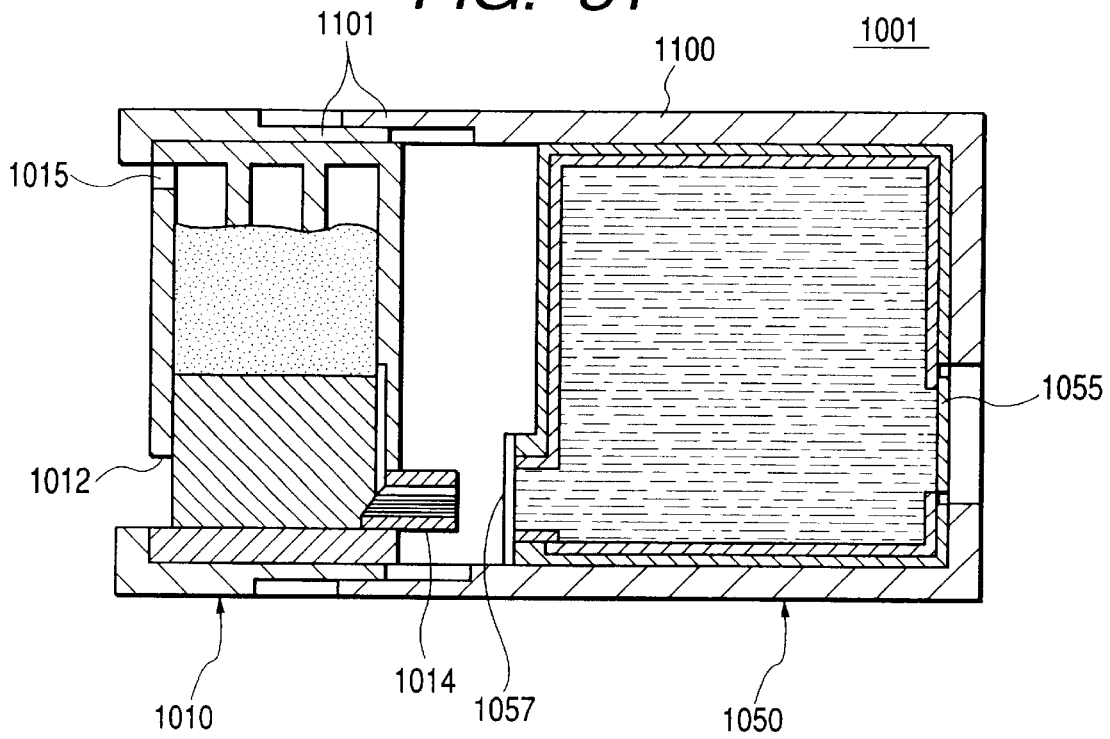
FIG. 31 is a cross sectional view showing the state before connecting a negative pressure generating member containing chamber and a liquid containing chamber, of a second embodiment of the ink tank of the present invention.

FIG. 31 is a sectional view showing the state of the ink tank of the practical embodiment hereof prior to its vacuum generating member containing room being brought into junction with the liquid containing room. As shown in FIG. 31, the ink tank 1001 as a liquid containing container is configured by comprising a vacuum generating member containing room 1010 and a liquid containing room 1050 as in the above-described first practical embodiment. The vacuum generating member container room has an atmosphere communication port 1015 enabling communication between its inside portion and the atmosphere and a supply port to lead the liquid out into the recording head. The vacuum generating member containing room 1010 has a communication tube 1014 communicable to the liquid containing room 1050. In addition, the ink (liquid) containing section of the liquid containing room 1050 is configured so that it is substantially tightly sealed with the sealing means 1057. Other configurations of the ink tank, description of the ink consumption steps, and function of the ink tank, etc. are the same as in the above-described first practical embodiment, and description thereon will be omitted.

Next, the installation/removal structure between the vacuum generating member containing room 1010 and the liquid containing room 1050 featured in the present invention will be described.

During distribution, that is, prior to user's use of the ink jet recording device, the ink tank of the present invention is in a state that the vacuum generating member containing room 1010 and the liquid containing room 1050 are separated each other as shown in FIG. 31. That is, during distribution, the communication tube 1014 of the vacuum generating member containing room 1010 and the opening section of the liquid containing room 1050 are not brought into connection. Thus, although the communication tube 1014 of the vacuum generating member containing room 1010 and the opening section of the liquid containing room 1050 are not brought into connection each other, in the ink tank of the embodiment hereof, the vacuum generating member containing room 1010 and the liquid containing room 1050 are temporally held by the guide member 1100 as the regulating means.

This guide member 1100, in the embodiment hereof, is configured so as to cover the portions other than the surface having the ink supply port 1012 of the vacuum generating member containing room 1010 and the atmosphere communication port 1015, and the portion of the atmosphere communication port 1055 of the liquid containing room 1050. Moreover, the slide portion 1101 in provided in the guide portion 1100, and this slide portion 1101 is caused to slide so that the vacuum generating member containing room 1010 and the liquid containing room 1050 can be disposed closer or departed.

The user, at the time when he uses this ink tank 1001, brings the vacuum generating member containing room 1010 and the liquid containing room 1050 into combination for the first time prior to installation of the ink tank 1001 into the printer. When the both parties are bought into combination, the slide portion 1101 is caused to slide so that the both parties is pushed in each other. This makes the communication tube 1014 of the vacuum generating member containing room 1010 break through the seal means 1057 of the liquid containing room 1050 so that the communication tube 1014 of the vacuum generating member containing room 1010 and the opening section of the liquid containing room 1050 are brought into communication.

Figure 32:
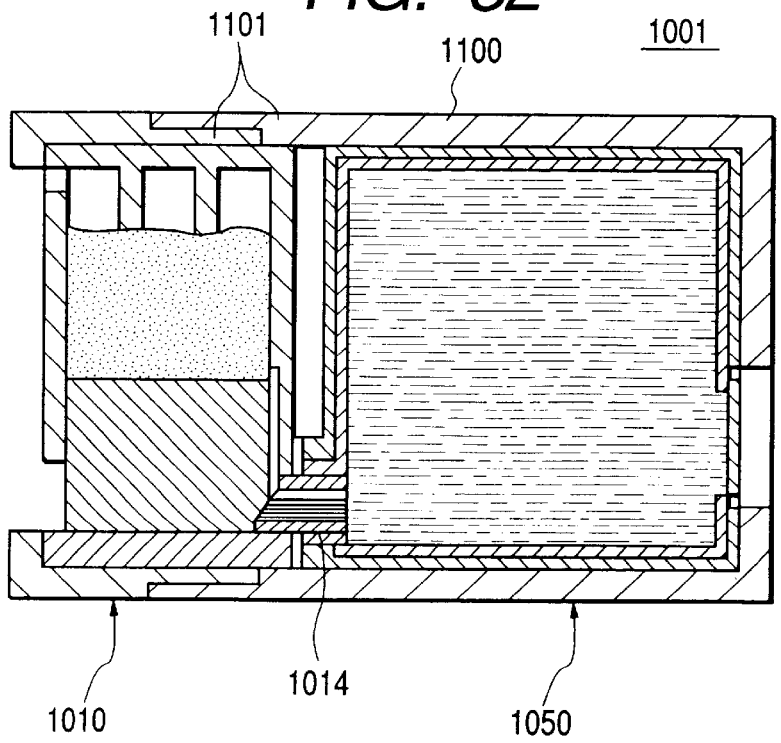
FIG. 32 is a cross sectional view showing the state after connecting the negative pressure generating member containing chamber and the liquid containing chamber, of a second embodiment of the ink tank of the present invention.

FIG. 32 is a sectional view showing a state after the vacuum generating member containing room and the liquid containing room of the ink tank of the practical embodiment hereof are brought into combination.

When the vacuum generating member containing room 1010 and the liquid containing room 1050 are brought into combination, the guide member 1100 covers the region in the vicinity of the combined portion of the communication tube 1014 of the vacuum generating member containing room 1010 and the opening section of the liquid containing room 1050 so that, even if ink leakage or scattering takes place from the combined portion, that ink will be scavenged into inside the guide member 1100 and will never be leaked out outside the guide member 1100.

In addition, the guide member 1100 is provided with the slide section 1101 so that the both containing rooms 1010 and 1050 can be regulated so as to be aligned in the direction of pushing in each other, that is, the direction of installation/removal of the both containing rooms into one direction. This prevents the communication tube 1014 of the vacuum generating member containing room 1010 from being inserted into the opening of the liquid containing room 1050 in an inclined position when they are combined. Thus, with the slide portion 1101 being configured so that the containing rooms 1010 and 1050 are inserted into inside the guide portion 1100 each other when they are bought into combination, miniaturization of the ink tank 1001 at the time of combination can be pursued and the both containing rooms 1010 and 1050 will be able to be certainly brought into combination.

In addition, in the above description, a configuration with the guide member 1100 covering the periphery of the ink tank 1001 is exemplified, but the configuration of the guide member is not limited hereto, but the configuration covering only the upper as well as lower portion of the ink tank 1001 will do if, for example, the direction of combination can be maintained certainly. In this case, the guide member is configured not to cover in the vicinity of the combination portion, but regulation on the direction of the combination can prevent ink leakage or scattering at the time of combination.

In addition, after the ink in the liquid containing room 1050 is all used up, the ink tank 1001 is abandoned with the both containing sections 1010 and 1050 being left combined, and a new ink tank 1001 is installed in the printer or the vacuum generating member containing room 1010 as well as the liquid containing room 1050 is replaced with new ones from the guide member 1100, and the guide member 1100 is closed again so that they are installed in the printer, and thus the user can implement ink exchange operation without being concerned about suffering from ink stains.

Moreover, according to the configuration of the practical embodiment hereof, after the ink inside the liquid containing room 1050 is used up, the slide section 1101 is opened so that the only the liquid containing room 1050 can be replaced with a new one, and the slide section 1101 of the guide member 1100 can be closed again and the both containing sections 1010 and 1050 can be brought into combination. This is preferable from the point of view to recycle resources or to reduce running costs.

Figure 33:
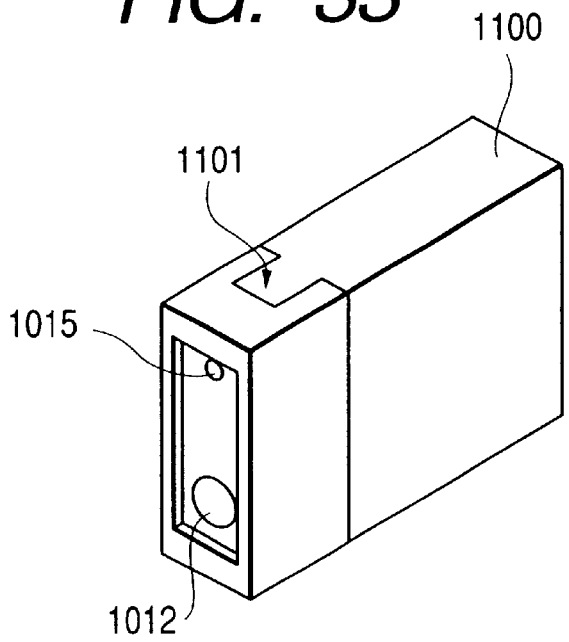
FIG. 33 is a perspective view showing the ink tank in the state where the negative pressure generating member containing chamber and the liquid containing chamber are connected.

FIG. 33 is a perspective view showing the ink tank in the state where the vacuum generating member containing room and the liquid containing room are brought into combination.

As shown in FIG. 33, the ink tank of the practical embodiment hereof is configured to have the surface in which the ink supply port 1012 and the atmosphere communication port 1015 are provided not to be covered with the guide member 1100.

Figure 34:
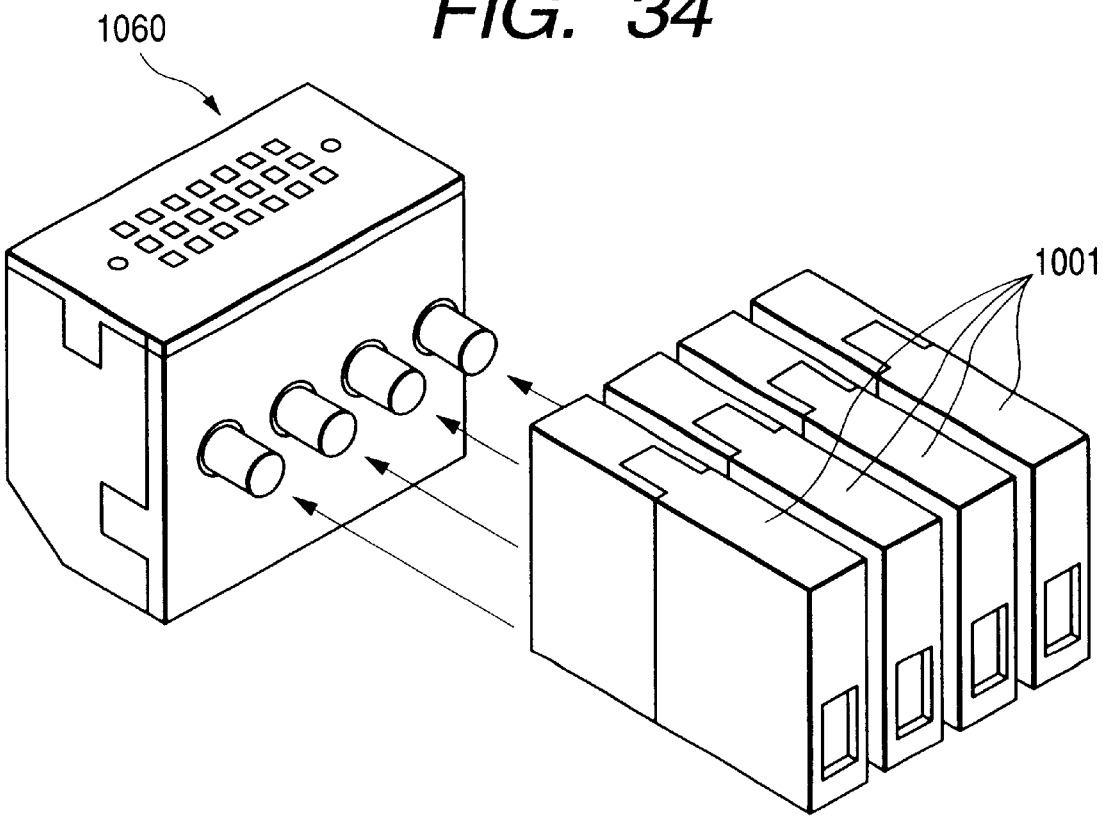
FIG. 34 is a perspective view showing the state when mounting the ink tank of the present invention to a record head.

FIG. 34 is a perspective view showing the state when the ink tank 1001 of the practical embodiment hereof configured as described above is installed in the later described recording head 1060. As shown in FIG. 34, four ink tanks 1001 are installed in the recording head 1060. Respective ink tanks 1001 are configured to contain ink colors different from each other (for example, yellow, magenta, cyanogen, and black) so that color printing can be implemented with the recording head 1060.

(Third Practical Embodiment)

Figure 35:
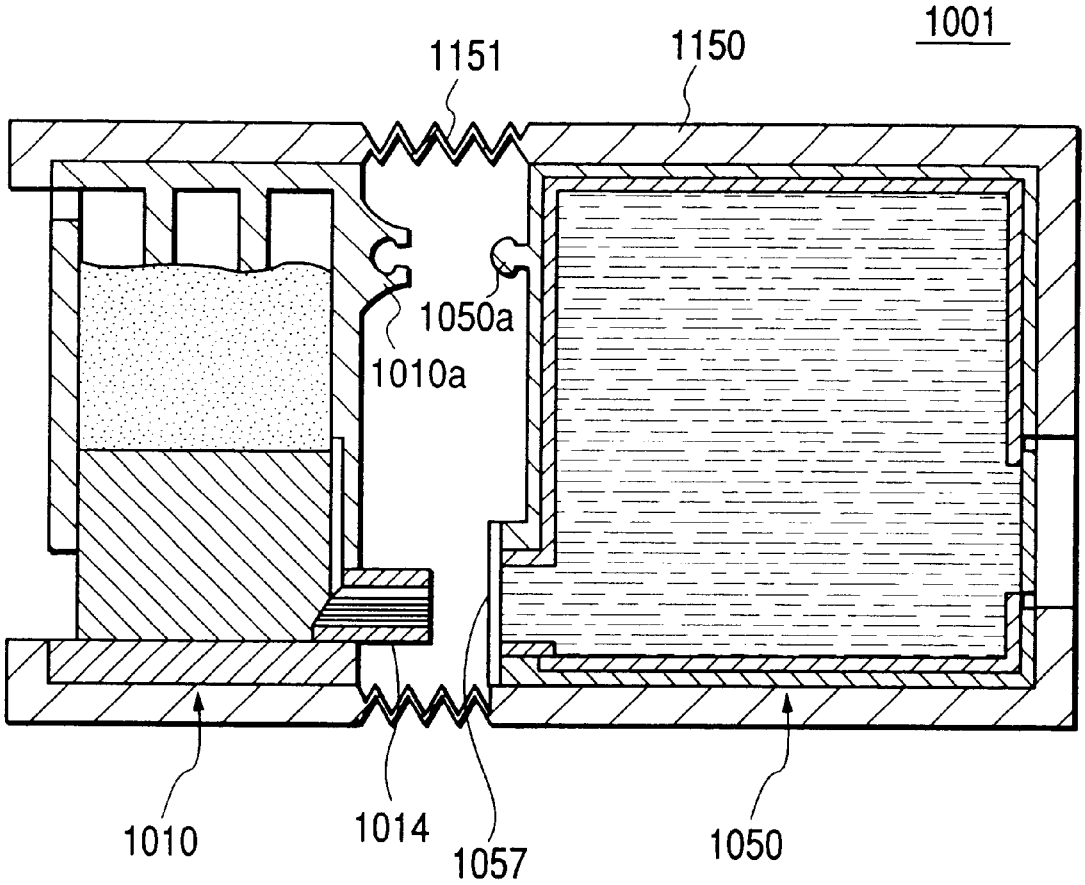
FIG. 35 is a cross sectional view showing a third embodiment of the ink tank of the present invention.

FIG. 35 is a sectional view showing a third practical embodiment of the ink tank of the present invention.

The ink tank 1001 of the practical embodiment hereof has as the ink tank of the second practical embodiment the vacuum generating member containing room 1010 and the liquid containing room 1050 to be integrally held with the guide member 1150 being the regulating means. The guide member 1150 in the practical embodiment hereof is provided with a flexible accordion section 1151 so that expansion and contraction of this accordion section 1151 can cause the vacuum generating member containing room 1010 and the liquid containing room 1050 to get closer or departed each other.

Moreover, in the practical embodiment hereof, an engaging concave section 1010*a* is formed in the vacuum generating member containing room 1010 and an engaging convex section 1050*a* is formed in the liquid containing room 1050. The engaging concave section 1010*a* and the engaging convex section 1050*a* are brought into engagement each other when the vacuum generating member containing room 1010 and the liquid containing room 1050 are brought into combination so as to hold the combined state of the both containing sections 1010 and 1050. Incidentally, the combining operation of the both containing sections 1010 and 1050 in the practical embodiment hereof is the same as in the second practical embodiment, and thus the detailed description will be omitted.

Also according to the practical embodiment hereof, when the vacuum generating member containing room 1010 and the liquid containing room 1050 are brought into combination, the guide member 1150 covers the combined portion of the communication tube 1014 of the vacuum generating member containing room 1010 and the opening of the liquid containing room 1050 so that, even if ink leakage or scattering takes place from the combined portion, that ink will be scavenged into inside the guide member 1150 and will never be leaked out outside the guide member 1150.

In addition, the guide member 1150 is provided with the accordion section 1151 so that with a simple configuration the both containing rooms 1010 and 1050 can be regulated in the direction of pushing in each other into one direction and at the time of combination, the communication tube 1014 of the vacuum generating member containing room 1010 can be prevented from being inserted into the opening of the liquid containing room 1050 in an inclined position. Moreover, the state of combination of the both containing sections 1010 and 1050 can be held by the engaging concave portion 1010*a* and the engaging convex section 1050*a,* so that the combining state of the both combining rooms each other can be stabilized and the ink supply operation can become more reliable.

Incidentally, the above-described engaging concave section 1010*a* as well as the engaging convex section 1050*a* are applicable to the ink tank having the slide member described with reference to FIG. 31.

What is claimed is:

1. A stored ink jet head cartridge, in a closed space comprising:

an ink jet recording head having an ejection port for ejecting ink;

a negative pressure generating member containing chamber which has a negative pressure generating member for generating negative pressure and an atmosphere communicating part for communicating with outside;

a mounting part;

a liquid supply container exchangeably mounted to the mounting part, said liquid supply container having a liquid containing part forming a substantially closed space except for a communicating part communicating with said negative pressure generating member containing chamber and generating negative pressure by deforming accompanied with flowing-out of liquid contained therein, and having a box-like body with an inside surface equal to or analogous to an outside surface of said liquid containing part and with an atmosphere communicating part for introducing atmosphere, the liquid supply container being mounted onto said mounting part so as to form said communicating part communicating with said negative pressure generating member containing chamber; and a first sealing member for sealing said ejection port and a second sealing member for sealing the atmosphere communicating part of said negative pressure generating member containing chamber, and wherein part of said liquid containing part is stored in a state of being separated from said box-like body, and the interior of said liquid containing part of said liquid supply container and a liquid supply passage from said communicating part to said recording head are filled with liquid.

2. The stored ink jet head cartridge according to claim 1, wherein said negative pressure generating member is configured by two fellow absorbents made of fiber material, and a boundary surface of said two fellow absorbents is arranged on the atmosphere communicating part side of said negative pressure generating member containing chamber relative to said communicating part.

3. The stored ink jet head cartridge according to claim 2, wherein a main fiber direction of said fiber material is arranged approximately horizontally in an attitude of said ink jet head cartridge in use.

4. The stored ink jet head cartridge according to claim 2, wherein the boundary surface of said two fellow absorbents is arranged near said communicating part.

5. The stored ink jet head cartridge according to claim 1, further comprising a storage container and a sealed lid for forming the closed space.

6. A stored liquid container comprising:

a negative pressure generating member containing chamber which has a liquid supply part for supplying liquid to outside and an atmosphere communicating part for communicating with the atmosphere and which contains a negative pressure generating member for keeping liquid therein;

a liquid containing chamber which forms a substantially closed space except for a communicating part to said negative pressure generating member containing chamber and which has a liquid containing part for containing liquid;

regulating means for regulating a connecting direction of said negative pressure generating member containing chamber and said liquid containing chamber; and engaging means for each of said negative pressure generating member containing chamber and said liquid containing chamber to facilitate a mutually connected state, wherein said negative pressure generating member containing chamber and said liquid containing chamber are stored separated from each other with said communicating part to said negative pressure generating member containing chamber of said liquid containing chamber being closed, and said negative pressure generating member containing chamber and said liquid containing chamber are connectable to each other such that closure of said communicating part is released for the first time when said liquid container is used, and wherein both of said negative pressure generating member containing chamber and said liquid containing chamber are connected to each other while regulating the connecting direction of said negative pressure generating member containing chamber and said liquid containing chamber by said regulating means, and when using said liquid container.

7. The stored liquid container according to claim 6, further comprising a storage container and a sealed lid for forming the closed space.

8. A liquid container comprising: a negative pressure generating member containing chamber which has a liquid supply part for supplying liquid to outside and has an atmosphere communicating part for communicating with the atmosphere and which contains a negative pressure generating member capable of keeping liquid therein; and a liquid containing chamber which forms a substantially closed space except for a communicating part to said negative pressure generating member containing chamber and which has a liquid containing part for containing liquid, wherein said negative pressure generating member containing chamber and said liquid containing chamber are separated from each other, and the liquid container further comprises:

closing means for closing the communicating part to said negative pressure generating member containing chamber of said liquid containing chamber; and regulating means for regulating the connecting direction when connecting said negative pressure generating member containing chamber and said liquid containing chamber.

9. The liquid container according to claim 8, wherein said negative pressure generating member containing chamber has liquid therein before being connected to said liquid containing chamber.

10. The liquid container according to claim 8, wherein said negative pressure generating member containing chamber has no liquid therein before being connected to said liquid containing chamber.

11. The liquid container according to claim 8, wherein said regulating means is a sliding member capable of expanding and contracting in one direction.

12. The liquid container according to claim 8, wherein said regulating means is a bellows member capable of expanding and contracting in one direction.

13. The liquid container according to claim 8, wherein each of said negative pressure generating member containing chamber and said liquid containing chamber has engaging means for keeping the mutually connected state.

14. The liquid container according to claim 8, wherein said regulating means is configured so as to cover at least the periphery of the connecting area of said negative pressure generating member containing chamber and said liquid containing chamber.

15. The liquid container according to claim 14, wherein said regulating means is configured so as to cover the periphery except for a liquid supply port surface of said negative pressure generating member containing chamber and an atmosphere communicating port surface of said liquid containing chamber.

* * * * *

UNITED STATES PATENT AND TRADEMARK OFFICE

CERTIFICATE OF CORRECTION

PATENT NO. : 6,450,631 B1 
DATED : September 17, 2002
INVENTOR(S) : Hiroki Hayashi et al.

It is certified that error appears in the above-identified patent and that said Letters Patent is hereby corrected as shown below:

Column 1,
Line 38, “can” should read -- can be --.

Column 7,
Line 6, “resent” should read -- recent --;

Column 9,
Line 13, “easy” should read -- ease --; and
Line 15, “easy” should read -- ease --.

Column 10,
Line 1, “26b” should read -- 260b --;
Line 2, “scoverably” should read -- coverably --;
Line 3, “26b” should read -- 260b --; and
Line 15, “26b” should read -- 260b --.

Column 15,
Line 28, “stronger” should read -- strong --.

Column 17,
Line 26 “a” should read -- α --.

Column 18,
Line 1, “situated” should read -- be situated --.

Column 21,
Line 41, “scoveres” should read -- coverably --;
Line 43, “scoverability” should read -- coverability --;
Line 44, “is” should read -- are --;
Line 58, “According” should read -- Accordingly, --; and
Line 64, “scovering” should read -- covering --.

Column 22,
Line 23, “According” should read -- Accordingly, --.

UNITED STATES PATENT AND TRADEMARK OFFICE

CERTIFICATE OF CORRECTION

PATENT NO. : 6,450,631 B1
DATED : September 17, 2002
INVENTOR(S) : Hiroki Hayashi et al.

It is certified that error appears in the above-identified patent and that said Letters Patent is hereby corrected as shown below:

Column 24,
Line 25, “part,” should read -- point, --;
Line 59 and 66, “scoveres” should read -- covers --.

Column 27,
Line 34, “laps” should read -- lapse --.

Column 28,
Line 22, “Consequently” should read -- Consequently, --.

Column 29,
Line 46, “party” should read -- partly --.

Column 32,
Line 42, “party” should read -- partly --.

Column 33,
Line 4, “party” should read -- part --; and
Line 9, “party” should read -- part --.

Column 34,
Line 65, “party” should read -- part --.

Column 35,
Line 2, “grater” should read -- greater --;
Line 23, “party” should read -- part --.
Line 26, “cation” should read -- cated --;
Line 31, “give” should read -- gives --;
Line 48, “the both” should read -- both --, and “different” should read -- different from --; and
Line 65, “enter” should be deleted.

Column 36,
Line 63, “party” should read -- part --.

UNITED STATES PATENT AND TRADEMARK OFFICE

CERTIFICATE OF CORRECTION

PATENT NO. : 6,450,631 B1
DATED : September 17, 2002
INVENTOR(S) : Hiroki Hayashi et al.

It is certified that error appears in the above-identified patent and that said Letters Patent is hereby corrected as shown below:

Column 37,
Line 49, “that” should read -- the --.

Column 40,
Line 3, “purposes,” should read -- purpose, --.

Column 42,
Line 14, “party” should read -- part --.

Column 44,
Line 43, “party” should read -- part --.

Column 45,
Line 35, “parallel” should read -- parallel with --.

Column 46,
Line 16, “each” should read -- of each --.

Column 47,
Line 47, “in stead” should read -- instead --.

Column 48,
Line 25, “rout” should read -- route --.

Column 49,
Line 4, “party” should read -- part --; and
Line 5, “party” should read -- part --.

Column 50,
Line 20, “rated” should read -- rated from --;
Line 27, “connection” should read -- connection with --;
Line 47, “the both” should read -- both --; and
Line 49, “the both parties is pushed in” should read -- both parties are pushed toward --.

UNITED STATES PATENT AND TRADEMARK OFFICE

CERTIFICATE OF CORRECTION

PATENT NO. : 6,450,631 B1 
DATED : September 17, 2002
INVENTOR(S) : Hiroki Hayashi et al.

It is certified that error appears in the above-identified patent and that said Letters Patent is hereby corrected as shown below:

Column 51,
Line 13, “into inside” should read -- inside --;
Line 14, “each other” should be deleted; and
Line 16, “the both” should read -- both --.

Column 52,
Line 12, “departed” should read -- depart from --;
Line 19, “engagement” should read -- engagement with --;
Line 28, “Also” should read -- Also, --; and
Line 50, “the both combining rooms” should read -- both combining rooms with --.

Signed and Sealed this

Twenty-fifth Day of March, 2003

JAMES E. ROGAN
*Director of the United States Patent and Trademark Office*